US008925203B2

(12) United States Patent
Scott

(10) Patent No.: US 8,925,203 B2
(45) Date of Patent: Jan. 6, 2015

(54) SYSTEMS AND METHODS FOR MANUFACTURING A CARRIAGE STYLE SECTIONAL DOOR

(76) Inventor: Robert Scott, Highland, UT (US)

( * ) Notice: Subject to any disclaimer, the term of this patent is extended or adjusted under 35 U.S.C. 154(b) by 332 days.

(21) Appl. No.: 13/403,742

(22) Filed: Feb. 23, 2012

(65) Prior Publication Data

US 2012/0211178 A1 Aug. 23, 2012

Related U.S. Application Data

(63) Continuation-in-part of application No. 12/502,886, filed on Jul. 14, 2009, now abandoned.

(60) Provisional application No. 61/080,682, filed on Jul. 14, 2008.

(51) Int. Cl.
*B21K 23/02* (2006.01)
*E06B 3/70* (2006.01)
*E06B 3/48* (2006.01)

(52) U.S. Cl.
CPC ..... *E06B 3/7001* (2013.01); *E06B 3/485* (2013.01)
USPC ..... 29/897.32; 29/897; 29/897.3; 160/232; 160/236

(58) Field of Classification Search
USPC ..... 29/897, 897.3, 897.32, 458, 469.5; 160/232, 236
See application file for complete search history.

(56) References Cited

U.S. PATENT DOCUMENTS 1,776,610 A 9/1930 Andrews
2,643,714 A 6/1953 Wolf
2,825,099 A 3/1958 Simmons
2,836,266 A 5/1958 Leeser
2,863,503 A 12/1958 Stroup
2,871,056 A 1/1959 Levitt
3,070,196 A 12/1962 Switzgable, Jr.
3,104,699 A 9/1963 Wolf et al.
3,220,519 A 11/1965 De Ridder
3,328,927 A 7/1967 Kates
3,334,464 A 8/1967 Charles
3,402,457 A 9/1968 Landow et al.
3,455,078 A 7/1969 Brown et al.
3,611,548 A 10/1971 Parris
3,740,916 A 6/1973 Kenaga
3,891,021 A 6/1975 Geoffrey
4,008,745 A 2/1977 Bailey
(Continued)

FOREIGN PATENT DOCUMENTS

IT 0414869 8/1946

*Primary Examiner* — Richard Chang
(74) *Attorney, Agent, or Firm* — Kunzler Law Group, PC

(57) ABSTRACT

Systems and methods for manufacturing carriage house style sectional doors. A plurality of fabricated door sections, each section having a length that spans the garage opening. Each section includes an upper molding, a lower molding, and a paneled skin interposed between the upper and lower moldings. Each section is separately fabricated and then hingedly attached to an adjacent section via a plurality of hinges. The paneled skin is fabricated by bending a piece of sheet metal to provide a plurality of alternating raised and recessed surfaces. The paneled skin further includes features for coupling an upper and lower end of the paneled skin to the upper and lower moldings. Once completed, the hinged door sections are installed to selectively cover the garage opening. In yet another embodiment, a raised surface of the paneled skin creates a cavity into which a finger guard is inserted.

18 Claims, 55 Drawing Sheets

(56) References Cited

U.S. PATENT DOCUMENTS

| | | | | |
|---|---|---|---|---|
| 4,075,810 | A | | 2/1978 | Zakrzewski |
| 4,182,080 | A | | 1/1980 | Naylor |
| 4,183,393 | A | | 1/1980 | Bailey |
| 4,284,119 | A | | 8/1981 | Martin et al. |
| 4,347,653 | A | | 9/1982 | Martin et al. |
| RE31,461 | E | | 12/1983 | Martin et al. |
| 4,492,067 | A | | 1/1985 | Martin et al. |
| 4,716,705 | A | | 1/1988 | Formanek |
| 4,752,517 | A | | 6/1988 | Bertel |
| 5,285,608 | A | | 2/1994 | Costello |
| 5,445,208 | A | * | 8/1995 | Shaner et al. ..... 160/232 |
| 5,743,057 | A | | 4/1998 | Martin |

* cited by examiner

SYSTEMS AND METHODS FOR MANUFACTURING A CARRIAGE STYLE SECTIONAL DOOR

CROSS-REFERENCE TO RELATED APPLICATION

This application is a continuation in part of U.S. patent application Ser. No. 12/502,886, filed Jul. 14, 2009, and entitled METHOD OF MANUFACTURING A CARRIAGE STYLE SECTIONAL DOOR, which claims priority to U.S. Provisional Patent Application Ser. No. 61/080,682, filed Jul. 14, 2008, and entitled METHOD OF MANUFACTURING A CARRIAGE STYLE SECTIONAL DOOR, each of which is incorporated herein in its entirety by reference.

BACKGROUND OF THE INVENTION

1. Field of the Invention

The present invention relates to systems and methods for manufacturing overhead, sectional doors. Specifically, the present invention relates to methods for manufacturing wood style carriage house sectional doors from steel or other metal coil.

2. Background and Related Art

Sectional doors are commonly referred to as "overhead doors" or "garage doors," and are designated by such names by reason of their operation. Sectional doors are designed to selectively provide closure for a garage opening, such as an automotive garage opening associated with a home. In order to accommodate the closure of the opening, the sectional door is typically assembled from a plurality of horizontally oriented door sections having a length that spans the door opening.

Current esthetic trends in sectional doors seek to mimic a carriage house door, which resembles a barn door style of the $19^{th}$ Century that has the appearance of swinging open. While methods and procedures currently exist to manufacture carriage house sectional doors from wood and extruded aluminum, these materials are costly and require extensive manual labor to produce quality sectional doors.

Thus, while techniques currently exist that are used to manufacture a variety of sectional doors, challenges still exist. Accordingly, it would be an improvement in the art to augment or even replace current techniques with other techniques.

SUMMARY OF THE INVENTION

The present invention relates to systems and methods for manufacturing overhead, sectional doors. Specifically, the present invention relates to methods for manufacturing wood style carriage house sectional doors from steel or other metal coil.

Implementation of the present invention provides a multistep method for manufacturing a carriage house style sectional door from sheet or coiled metal. The sheet or coiled metal is 24 or 26 gauge steel; however one of skill in the art will appreciate that other gauges of steel can be used within the scope of this invention. The method includes fabricating a plurality of door sections, each section having a length that spans the garage door opening. Each section is separately fabricated and then hingedly attached to an adjacent section via a plurality of hinges. Once completed, the hinged door sections are installed to selectively cover the garage opening.

Each section includes a minimum of three components, namely an upper molding, a lower molding, and a paneled skin interposed between the upper and lower moldings. The paneled skin is fabricated by bending a piece of sheet metal to provide a plurality of alternating raised and recessed surfaces. The paneled skin further includes features for coupling an upper and lower end of the paneled skin to the upper and lower moldings. For example, in one embodiment a recessed surface of the paneled skin includes a lip for engaging a mounting channel of the upper and lower moldings. In another embodiment, a raised surface of the paneled skin includes a flange that is coupled to a mounting surface of the upper and lower moldings. In yet another embodiment, a raised surface of the paneled skin creates a cavity into which a finger guard is inserted.

The upper and lower moldings are linear components of the sectional door that frame the upper and lower ends of the paneled skin. The upper and lower moldings are fabricated by bending pieces of sheet or coiled metal to a desired shape and length, as required by the sectional door. Each molding further includes a mounting surface and a mounting channel for coupling respective features of the paneled skin. Following fabrication, the components of the individual panels are assembled and then permanently coupled together. In one embodiment, the lip and the mounting channel are compressed and bent to approximately 45° thereby locking together the two features. In another embodiment, the flange and the mounting surface are coupled together via a hemming, rivet and/or spot weld process. Further, in some embodiments a bolt clamp is used to lock together various features of the present invention. Still further, in some embodiments a square washer is used in combination with a bolt or a spot weld process to lock together various features of the present invention.

Some implementations of the present invention incorporate tubular structures having various interlocking features and surfaces to receive windows or panel sections of the sectional door. Some implementations further include methods of assembly, whereby the interlocking features and various surfaces of the tubular structures enable a structurally rigid sectional door to be provided having windows.

While the methods and processes of the present invention have proven to be particularly useful in the area of fabricating sectional doors, those skilled in the art will appreciate that the methods and processes can be used in a variety of different applications and in a variety of different areas of manufacture to yield similarly configured doors.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

The present invention relates to systems and methods for manufacturing overhead, sectional doors. Specifically, the present invention relates to methods for manufacturing wood style carriage house sectional doors from steel or other metal coil.

Figure 1:
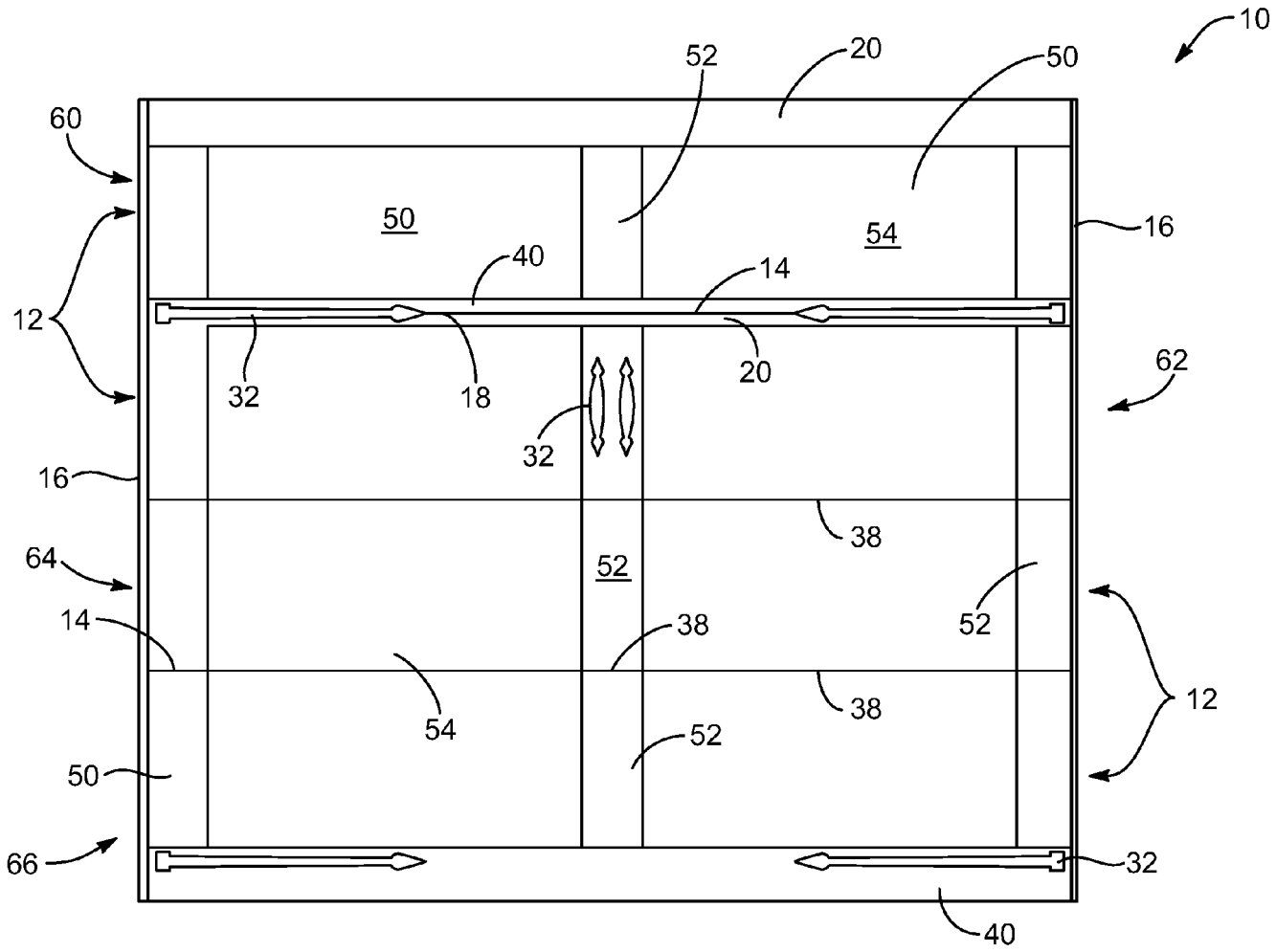
FIG. 1 is a perspective view of a representative embodiment of the present invention.

Referring now to FIG. 1, a perspective view of a carriage style sectional door 10 is shown. The sectional door 10 comprises a plurality of sections 12, each section 12 having a length sufficient to span the width of an opening in a building or structure (not shown). For example, the embodiment of FIG. 1 comprises a sectional door 10 having four sections 12. Each section 12 is separately manufactured and then hingedly coupled to another section 12 thereby forming a joint 14 between adjacent sections 12. Each section 12 further comprises a pair of stiles 16. The stiles 16 are generally comprised of sheet metal and are fixedly coupled to the lateral ends of each section 12. The stiles 16 substantially cap the lateral ends of each section and provide a solid, finished surface for the lateral ends capable of accommodating hardware and fasteners necessary for the installment and use of the sectional door 10.

Each section 12 of the door 10 further comprises an upper molding 20, a lower molding 40, and a paneled skin 50. The upper molding 20 and the lower molding 40 act as the horizontal perimeters for each section 12, and the paneled skin 50 provides the structural surface of each section 12. Different upper and lower moldings 20 and 40 are used in conjunction with the paneled skin 50 to achieve a desired aesthetic feature or style. For example, as shown in FIG. 1, a first section 60 comprises an exposed upper and a lower molding 20 and 40 thereby creating a framed appearance for the section 60. Conversely, a second section 62 comprises an exposed upper molding 20 and a concealed lower molding (not shown). As such, the upper molding 20 of the second section 62 combines with the lower molding 40 of the first section to provide a framed finger shield joint 18. Additionally, the concealed lower molding of the second section 62 compliments the concealed upper and lower moldings (not shown) of the third section 64 to create the appearance of one continuous section or aesthetic feature. The concealed moldings of adjacent sections 12 provide a concealed joint 38. The concealed joints 38 between the second, third, and fourth section 62, 64, and 66 combine to create an appearance of one continuous section or aesthetic feature. Thus, the exposed upper molding 20 of the second section 62, and the exposed lower molding 40 of the fourth section 66 combine with the concealed moldings of the second, third, and fourth sections 62, 64, and 66 to create the appearance of a single, unitary section. Specifics regarding the various upper and lower moldings 20 and 40 are discussed in detail below.

The paneled skin 50 comprises a single piece of sheet or coiled metal that has been bent and shaped to comprise a plurality of alternating raised 52 and recessed 54 surfaces. The paneled skin 50 further comprises various surfaces and features to compatibly engage and fixedly attach to the upper and lower moldings 22 and 42. Thus, the stiles 16, the upper molding 20 and the lower molding 40 are coupled to the paneled skin 50, thereby framing an outer perimeter of the paneled skin 50 and providing a section 12 of the door 10. Once each section 12 has been separately manufactured, the individual sections 12 are aligned and adjacent moldings 20 and 40 are linked together via hinges to provide the sectional door 10. Additional aesthetic features 32, such as faux hinges and handles, may also be added to the sections 12 to further enhance the cottage-style appearance of the sectional door 10.

Figure 2:
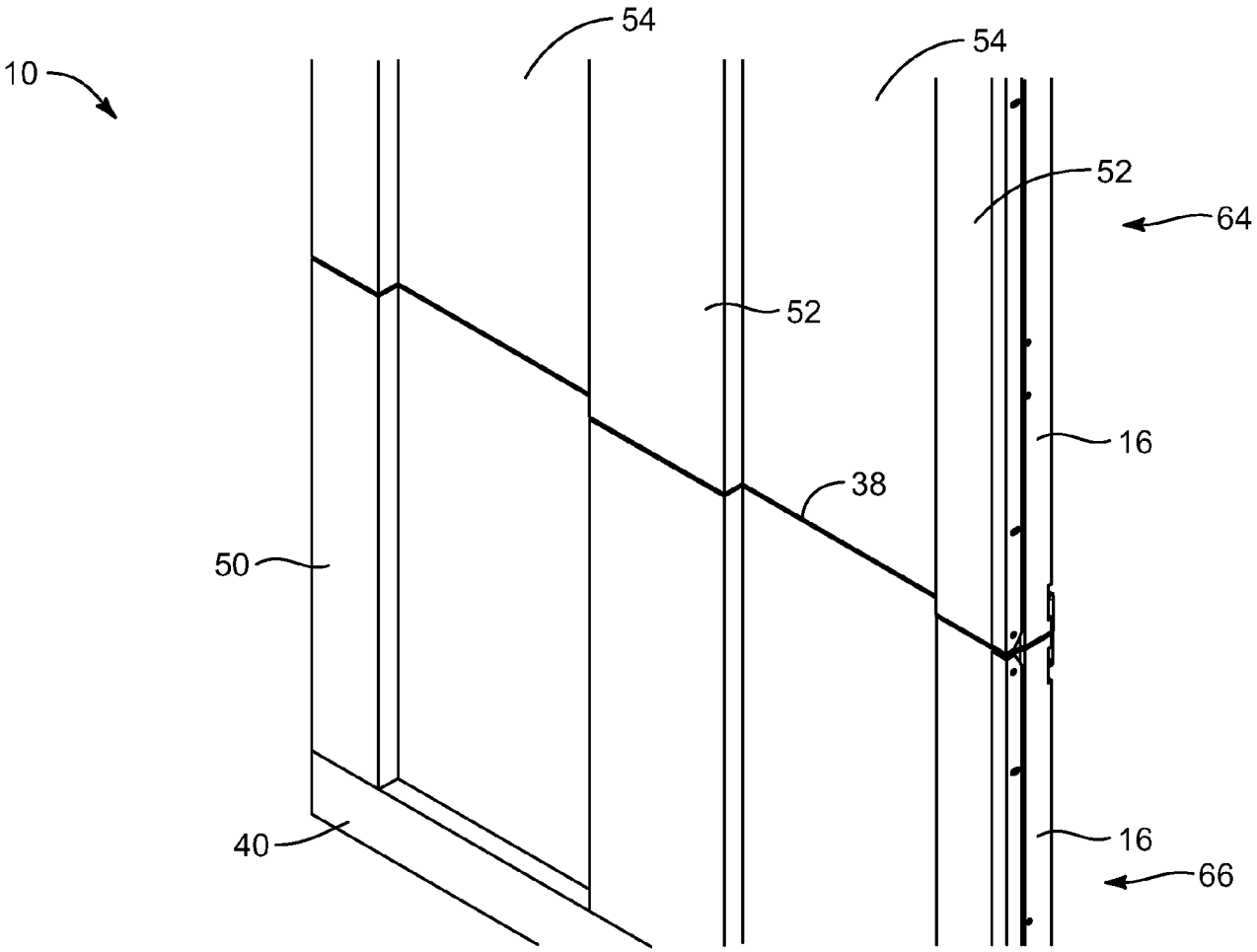
FIG. 2 is a perspective view of a concealed joint of a carriage style sectional door in accordance with a representative embodiment of the present invention.
Figure 3:
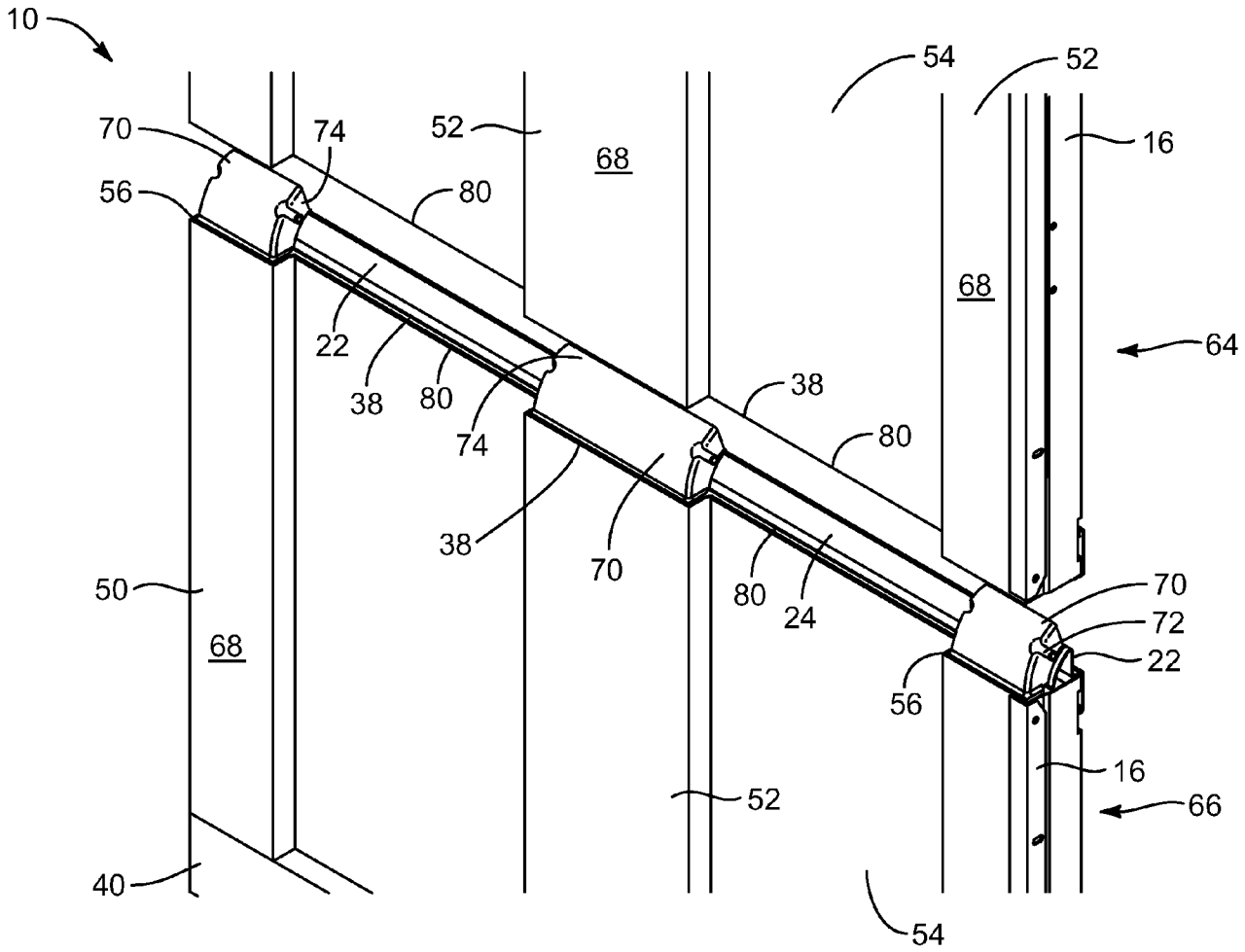
FIG. 3 is an exploded, perspective view of the concealed joint of FIG. 2 in accordance with a representative embodiment of the present invention.
Figure 4:
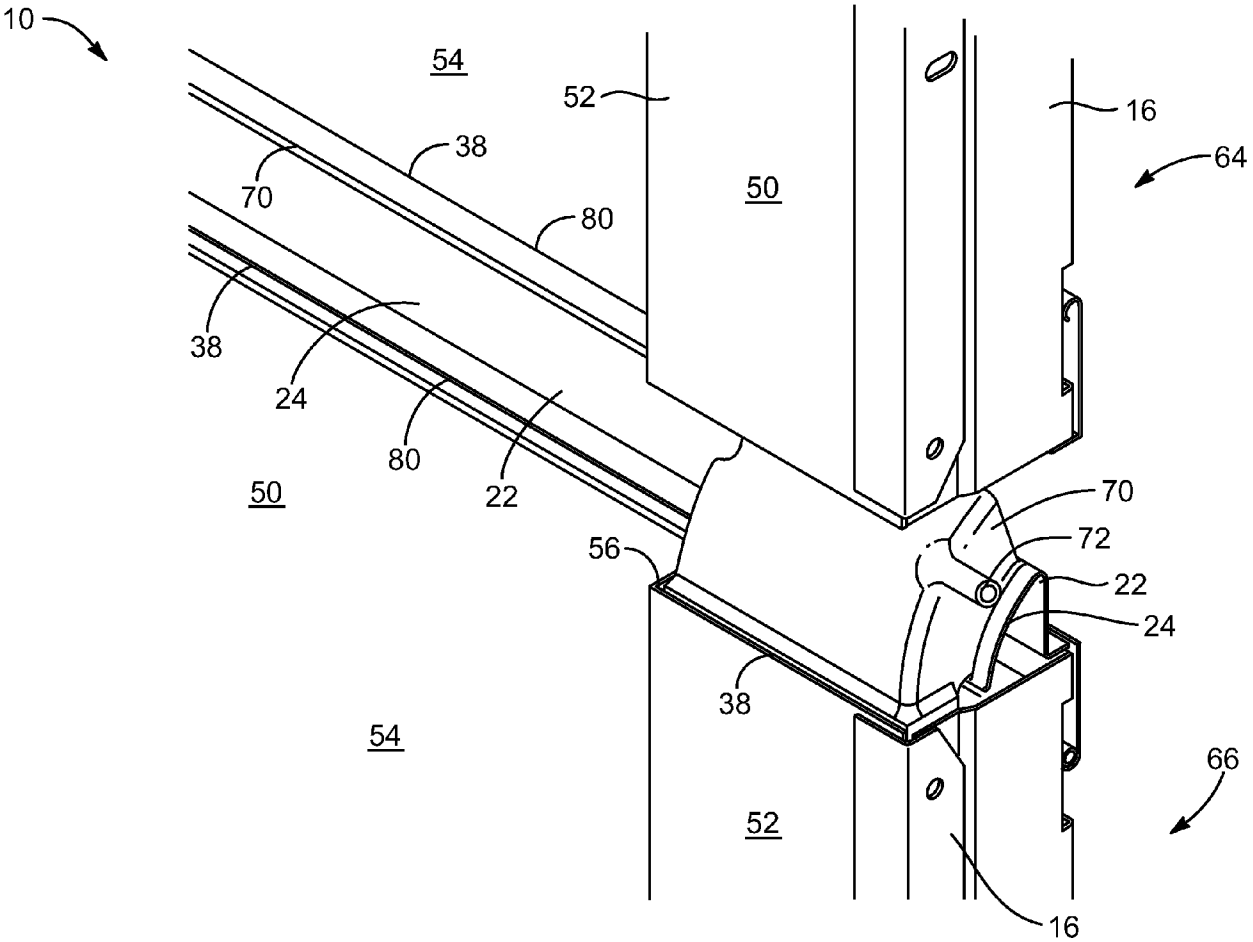
FIG. 4 is an exploded, perspective view of the concealed joint end stile of FIG. 3 in accordance with a representative embodiment of the present invention.

Referring now to FIGS. 2-4, various views of the concealed joint 38 of the third and fourth sections 64 and 66 are shown. In one embodiment, the paneled skin 50 of each section 64 and 66 is bent and shaped to provide identically spaced surfaces 52 and 54. Therefore, when the individual sections 64 and 66 are hingedly coupled, the lines and features of each section 64 and 66 match and provide a uniform appearance. The concealed upper and lower moldings 22 and 42 each comprise a bent and shaped piece of sheet metal that is tooled to the appropriate shape and then cut to a length sufficient to span the width of the sectional door 10. Additionally, the moldings 22 and 42 comprise features and elements to compatibly seat within one another, as well as to compatibly couple to mounting features of the paneled skin 50.

Figure 7:
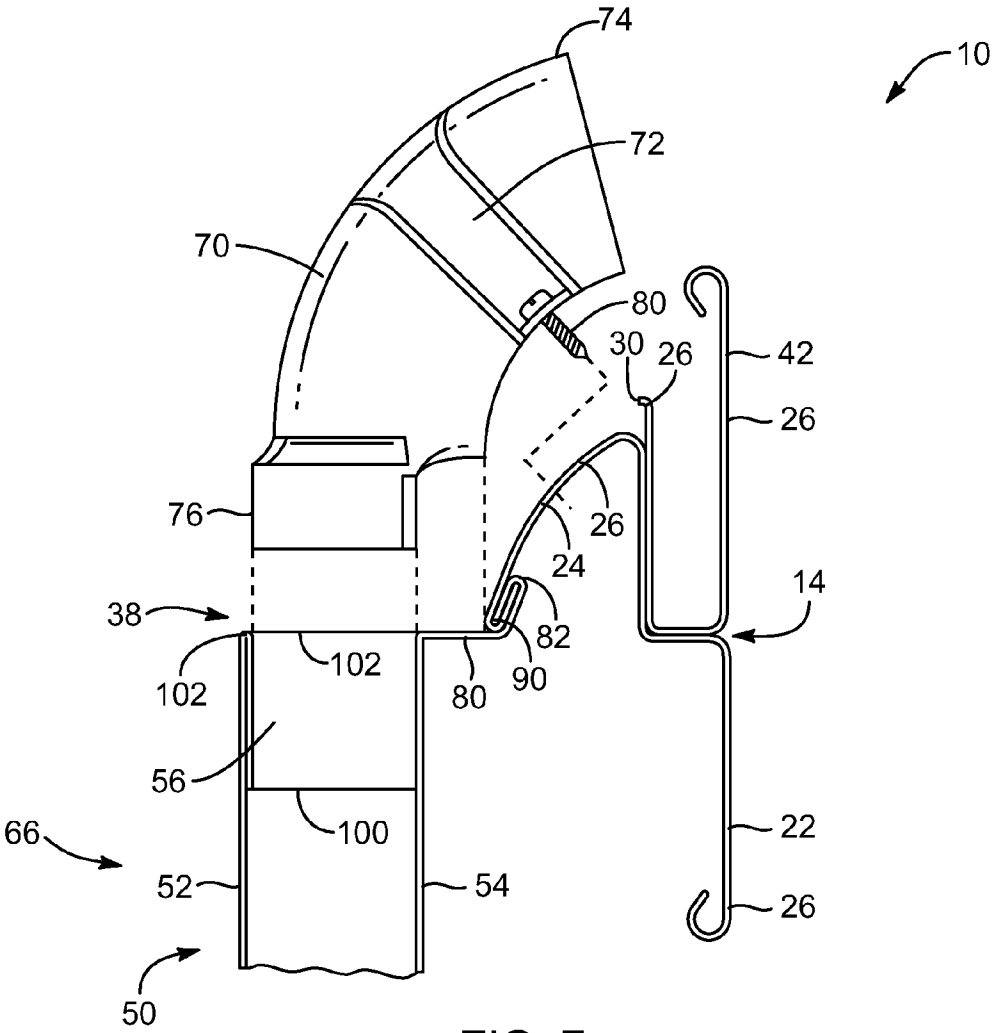
FIG. 7 is a cross-sectioned side view of an upper and lower molding of a concealed joint in a plane including an implementation of a finger guard in accordance with a representative embodiment of the present invention.

Referring now to FIGS. 3 and 4, exploded views of section 64 and 66 are shown. The raised surfaces 52 of the paneled skin 50 create an aesthetic appearance of raised, vertical panels 68 or moldings that appear to frame the recessed surfaces 54 of the door 10. The raised, vertical panels 68 provide a desirable, vertical board effect that is necessary to reproduce some embodiments of cottage-style doors. Additionally, the raised surfaces 52 or vertical panels 68 provide a cavity 56 into which a finger guard 70 is partially inserted. The finger guard 70 comprises a polymer material and is configured to compatibly seat within the opening of the cavity 56. The finger guard 70 is secured to a contoured surface 24 of the concealed upper molding 22 by any fastening means, such as screws or an adhesive. Where the fastening means is a screw 80, the finger guard 70 is fastened to the concealed upper molding 22 via the mounting channel 72, as shown in FIG. 7.

An upper portion 74 of the finger guard 70 is configured to compatibly insert within the cavity 58 of the raised surface 52 of the adjacent section 64. Thus, when the two sections 64 and 66 are hingedly attached, the finger guard 70 prevents insertion of fingers between the opposing raised surfaces 52 of the adjacent sections 64 and 66. This feature is more clearly illustrated in FIG. 8, wherein the third and fourth section 64 and 66 are joined and shown in a hinged position. In addition to preventing insertion of fingers, the finger guard 70 also provides a finished transition between the opposing raised surfaces 52 of each section 64 and 66. In one embodiment, the finger guard 70 is colored to match the color of the door 10. In another embodiment, the finger guard 70 comprises translucent plastic through which the color of the door 10 is displayed.

The concealed upper molding 22 and the concealed lower molding (not shown) are fixedly attached to a portion of the horizontal perimeter edges 80 of the paneled skin's 50 recessed surfaces 54 to provide the required door thickness. For example, in an embodiment where the final thickness of the sectioned door 10 is two inches, the one and one quarter inch wide concealed molding 22 is coupled to the recessed surface 54 of the paneled skin 50 to form the appropriate door thickness of two inches, the raised surface 52 of the paneled skin 50 being three quarters of an inch in depth.

Figure 5:
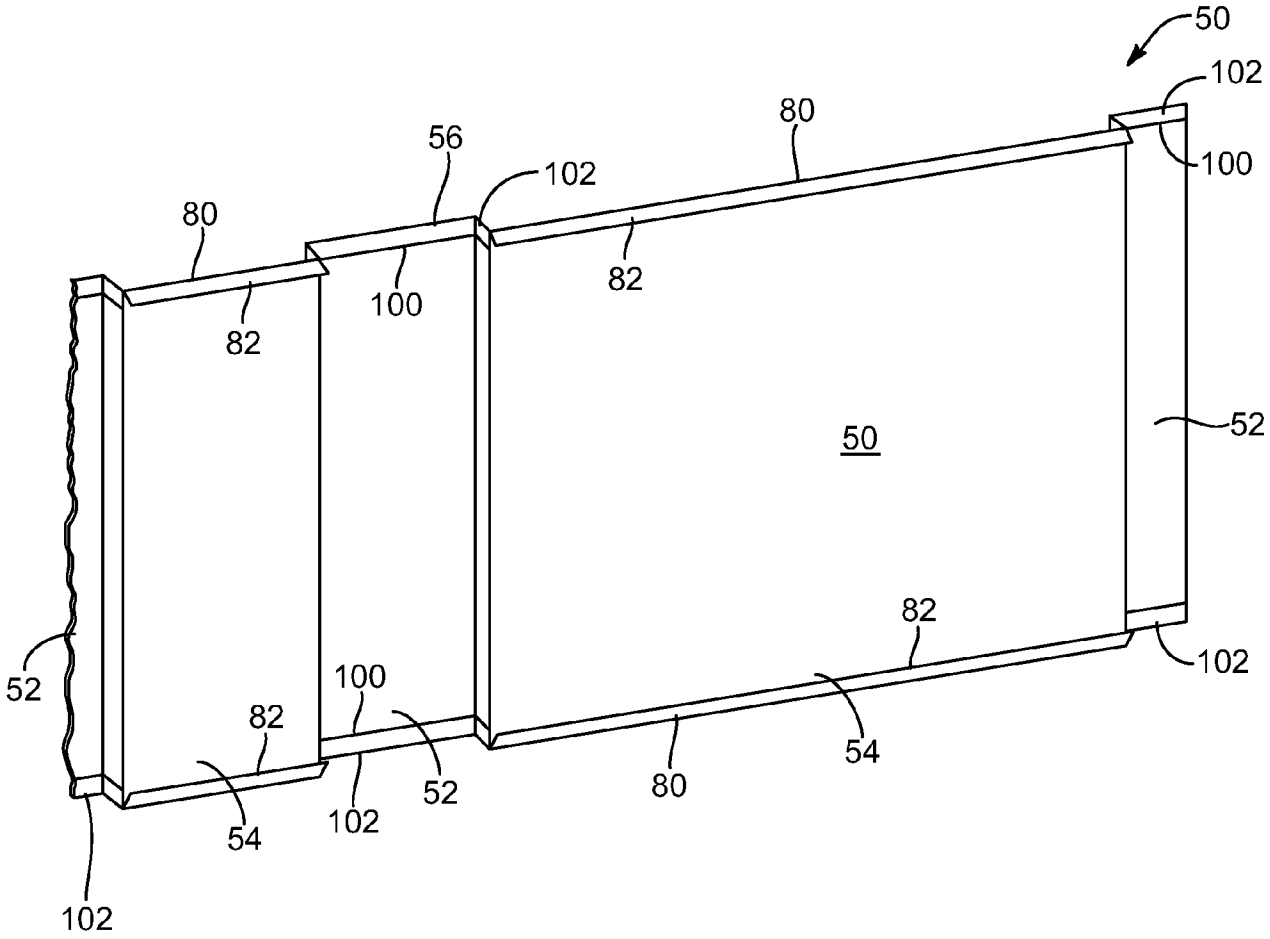
FIG. 5 is perspective, rear view of a paneled skin in accordance with a representative embodiment of the present invention.
Figure 6:
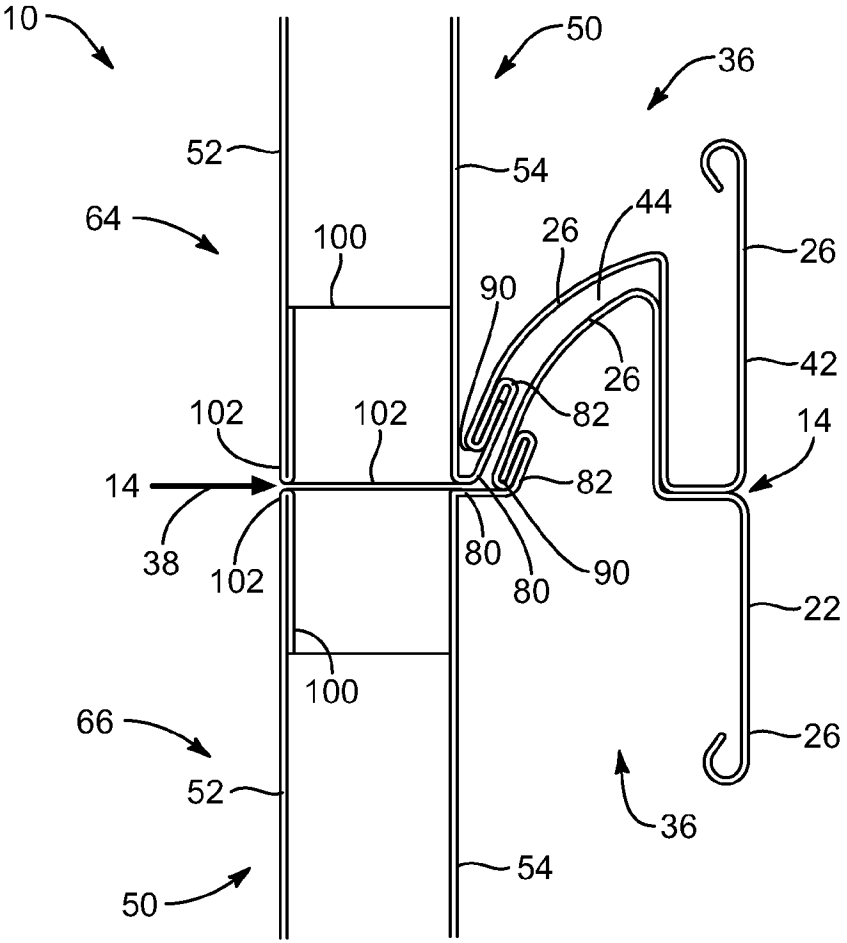
FIG. 6 is a cross-sectioned side view of an upper and lower molding of a concealed joint in accordance with a representative embodiment of the present invention.

Referring now to FIG. 5, a rear perspective view of the paneled skin 50 is shown. Of particular note are the generally horizontal edges 80 and 100 of the paneled skin 50. The horizontal edges of the paneled skin 50 are cut, shaped and bent to provide various surfaces and features to compatibly engage and fixedly attach the upper and lower molding 22 and 42 of the door 10. For example, the horizontal perimeter edges 80 of the recessed surfaces 54 are bent to provide a lip 82 extending outwardly from the paneled skin 50. The lip 82 provides an elongate, compatible surface to which a mounting channel 90 of the upper and lower concealed moldings 22 and 42 may be coupled and secured, as shown in FIG. 6. Conversely, the perimeter edges 100 of the raised surfaces 52 are folded inwardly, back onto the paneled skin 50 thereby forming a folded edge 102. As such, the folded edge 102 provides a finished opening 56 for the raised surfaces 52 that is aesthetically pleasing and exactly sized to receive the finger guard 70. One of skill in the art will appreciate that the perimeter edges 80 and 100 of the paneled skin 50 may be bent and shaped to any configuration to permit successful coupling of the paneled skin 50 to the other components 50, 16, 22 and 24 of the door 12 assembly.

Referring now to FIG. 6, a cross-sectional side view of the concealed joint 38 is shown without the finger guard, more clearly showing the relationship between the paneled skin 50 and the upper and lower concealed moldings 22 and 42. Each molding 22 and 42 comprises a backing flange 26, a mating surface 28, and a mounting channel 90. The backing flange 26 extends upwardly from the joint 14 of the sections 64 and 66, and is generally parallel to the plane of the paneled skin 50. A gap 36 is provided between the backing flange 26 and the paneled skin 50 to allow placement of insulation or another backing material within the door 10. The upper concealed molding 22 is further configured to compatibly seat within a receiving channel 44 of the lower concealed molding 42. Thus, the receiving channel 44 of the lower molding 42 and the contoured surface 24 of the upper molding 22 form mating surfaces 26 to prevent unwanted passing of wind and moisture through the joint 38. The contoured surface 24 further provides a finger shielding feature for preventing insertion of fingers or other items within the joint 14, more clearly shown in FIGS. 8 and 16 below.

The concealed moldings 22 and 42 each further include a mounting channel 90. The mounting channels 90 are u-shaped bends that form a terminal end of the moldings 22 and 42 opposite the backing flanges 26. The mounting channels 90 compatibly engage the lip 82 of the recessed surfaces 54 and are further rolled together and pressed to achieve coupling between the paneled skin 50 and the moldings 22 and 42. This coupling may include any method of metal joining, including hemming, seaming, welding, spot welding, riveting, crimping, and use of an adhesive. For example, in one embodiment the lip 82 is seated within the mounting channel 90 and then the mounting channel 90 and lip 82 are pressed to form a hemmed seam. As such, the coupling between the mounting channels 90 and the lip 82 create a weather tight seal as required by sectional garage doors.

Referring now to FIG. 7, an exploded, cross-sectional side view of the bottom half of the concealed joint 38 is shown in a plane including the finger guard 70. A base portion 76 of the finger guard 70 is configured to compatibly fit within the opening 56 of the raised surface 52. The finger guard 70 is further accommodated by removing a portion of the mating surface 26 of the lower concealed molding 42, which portion corresponds to the placement of the finger guard 70. The removed portion of the lower molding 42 creates a gap or window 30 in the molding 42 that is filled by the inserted finger guard 70. Finally, the finger guard 70 is secured to the contoured surface 24, or mating surface 26 of the upper concealed molding 22 via a screw 80 through the mounting channel 72, or by another appropriate fastening means, as previously discussed.

Figure 8:
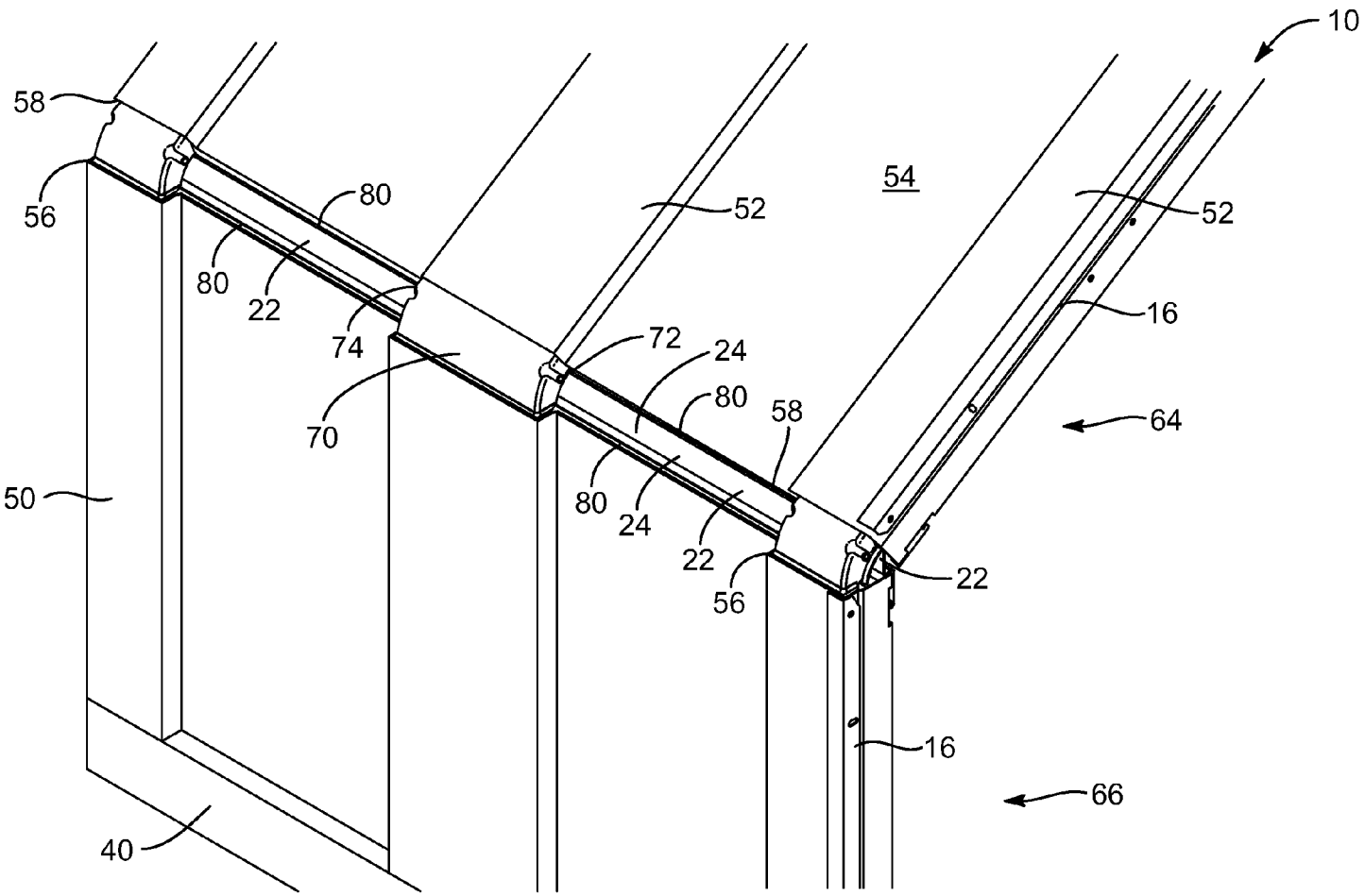
FIG. 8 is a perspective view of a sectioned door in a hinged position in a plane including an implementation of a finger guard in accordance with a representative embodiment of the present invention.

Referring now to FIG. 8, the third and fourth sections 64 and 66 are shown in a hinged position. As previously discussed, the hingedly coupled sections 64 and 66 are combined with the inserted finger shields 70 to provide the aesthetic appearance of continuous panels running between the separate sections 64 and 66. Furthermore, the contoured surface 24 of the upper concealed molding 22 and the contoured surface of the finger guard 70 permit the sections 64 and 66 to hingedly flex but prevent fingers or other items from being inserted there between. Thus, the concealed joint 38 is aesthetically pleasing and a functional safety element of the sectional door 10.

Figure 9:
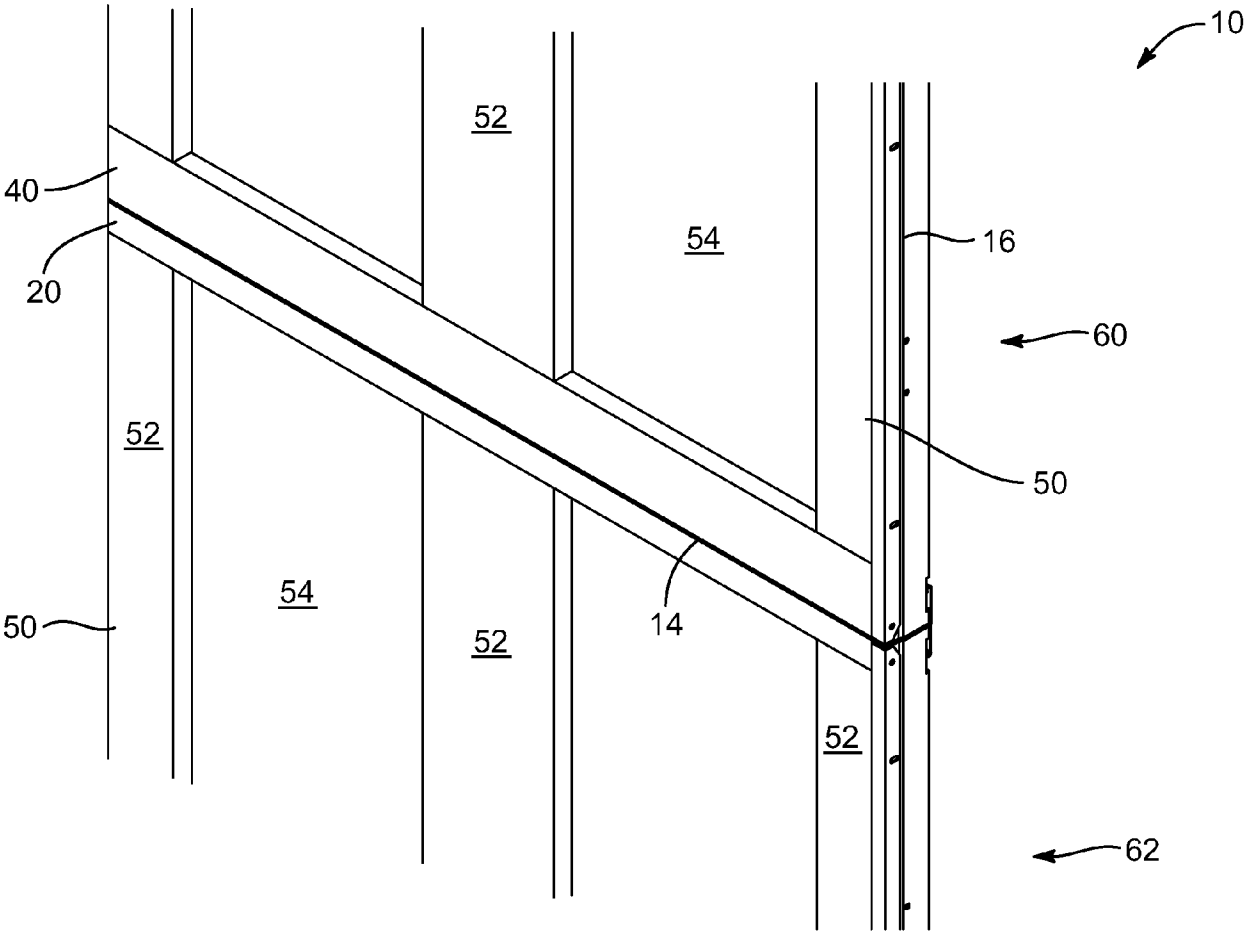
FIG. 9 is a perspective view of a framed finger shield joint of a carriage style sectional door in accordance with a representative embodiment of the present invention.
Figure 10:
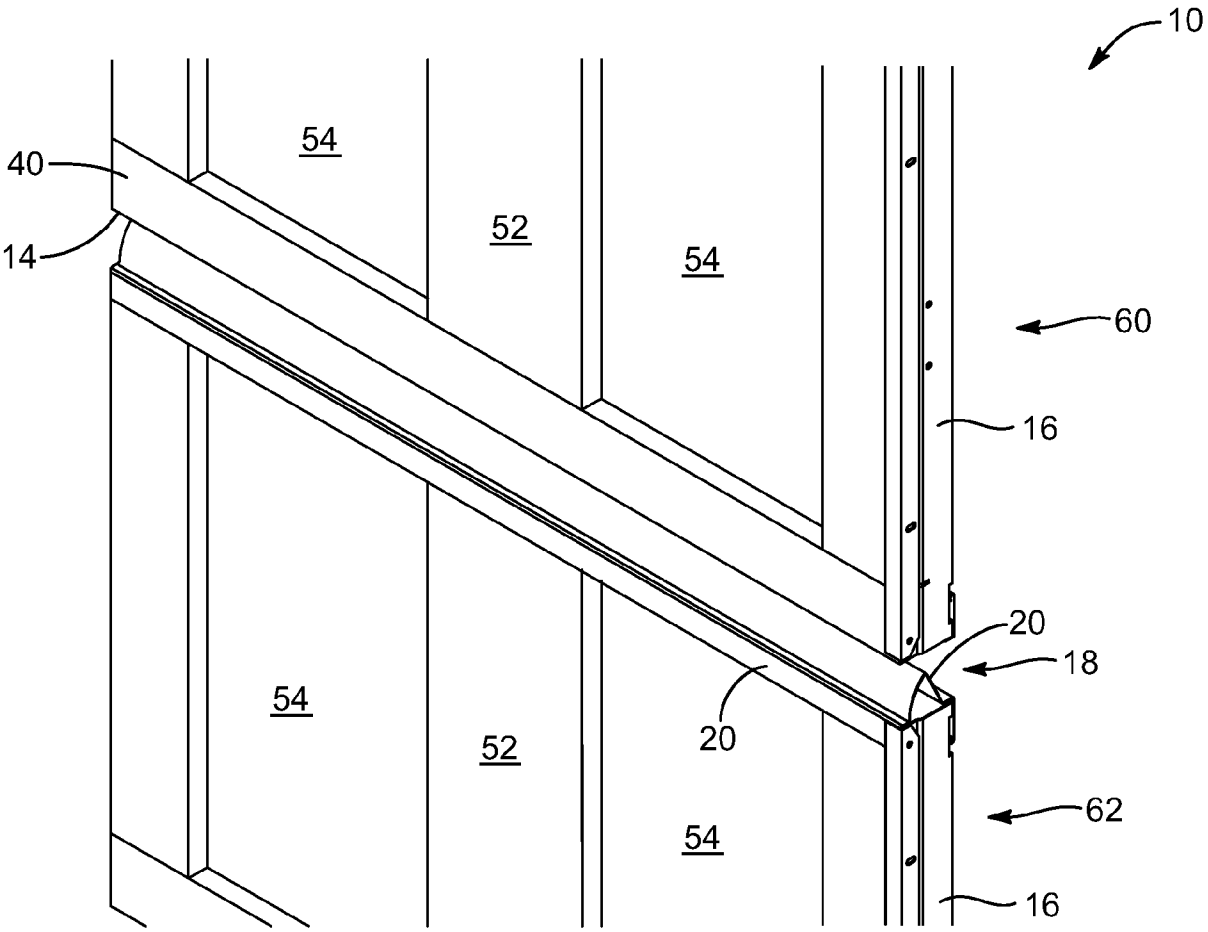
FIG. 10 is an exploded perspective view of the framed finger shield joint of FIG. 9 in accordance with a representative embodiment of the present invention.
Figure 11:
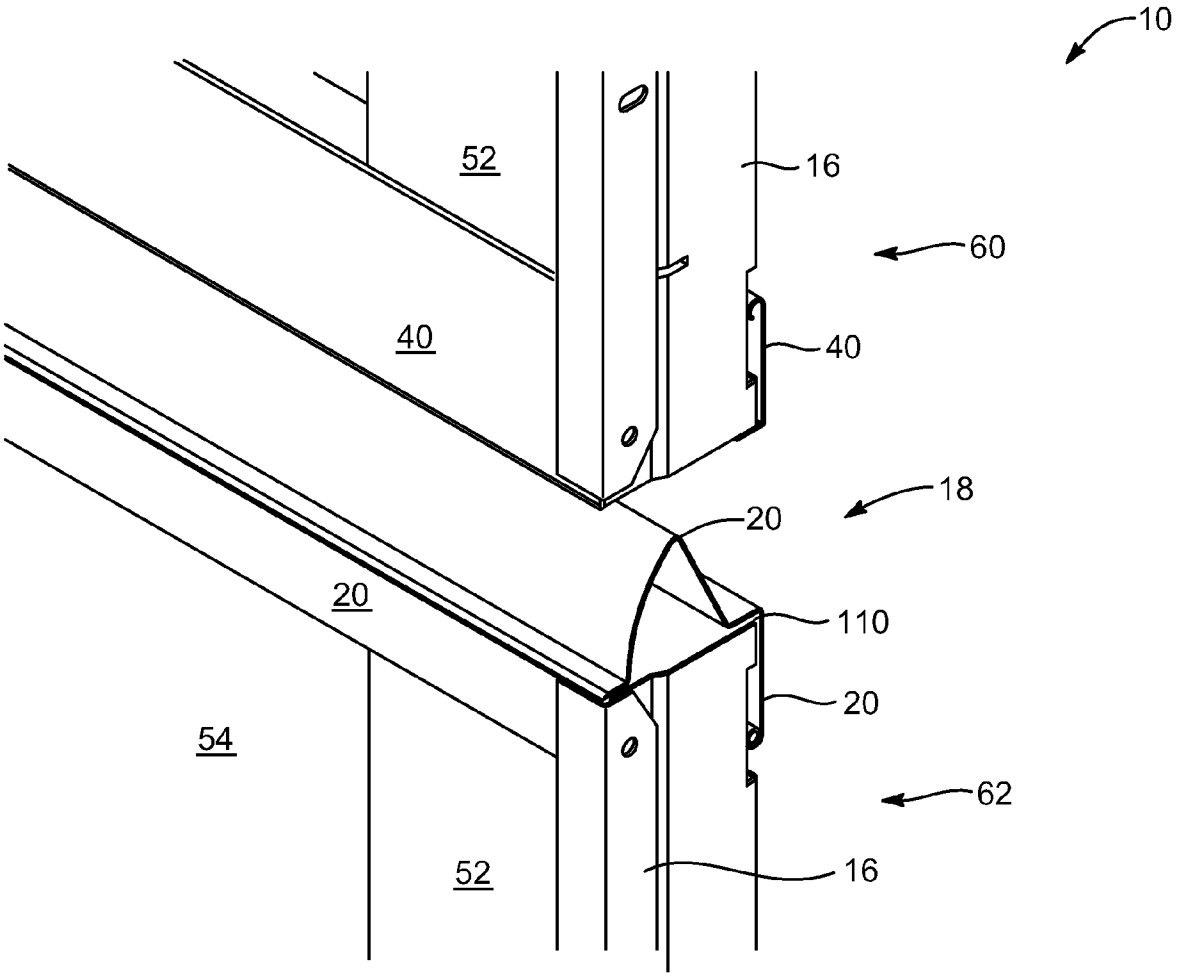
FIG. 11 is an exploded, perspective view of the framed finger shield joint end stile of FIG. 10 in accordance with a representative embodiment of the present invention.

Referring now to FIGS. 9-11, various views of the framed finger shield joint 18 of the first and second sections 60 and 62 are shown. As with the paneled skins 50 of the third and fourth sections 64 and 66, the paneled skins 50 of the first and second sections 60 and 62 are bent and shaped to provide identically spaced surfaces 52 and 54. Again, the raised 52 and recessed 54 surfaces of the paneled skin 50 create an aesthetic appearance of a carriage style paneled door. However, unlike the third and fourth section 64 and 66 previously discussed, the upper 20 and lower 40 moldings of the first and second 60 and 62 sections are exposed and visually divide the sections 60 and 62 from one another. As such, the framed finger shield joint 18 and the raised surfaces 52 visually combine to frame the recessed surfaces 54 of the sections 60 and 62. Therefore, by selectively using concealed and exposed moldings, a wide variety of aesthetic configurations can be achieved. For example, in one embodiment a sectional door 10 is provided utilizing a plurality of concealed and framed finger shield joints to create an aesthetically pleasing, carriage style sectional door 10.

Referring now to FIGS. 10 and 11, exploded views of section 60 and 62 are shown. The upper molding 20 and the lower molding 40 each comprises a bent and shaped piece of sheet metal that is tooled to the appropriate shape and then cut to a length sufficient to span the width of the sectional door 10. The upper and lower moldings 20 and 40 are then fixedly attached to the perimeter edges 110 of both the raised 52 and recessed 54 surfaces. Therefore, in one embodiment where the final thickness of the sectioned door 10 is two inches and the width of the paneled skin 50 is three-quarter of an inch, the raised 52 and recessed 54 surfaces of the paneled skin 50 are coupled to a two inch wide exposed molding 40 to form the desired door thickness of two inches. Unlike the concealed moldings 22 and 42, the exposed upper and lower moldings 20 and 40 comprise the complete interface surface between the adjacent sections 60 and 62 and therefore do not require finger guards or other protective hardware in addition to the moldings 20 and 40.

Figure 12:
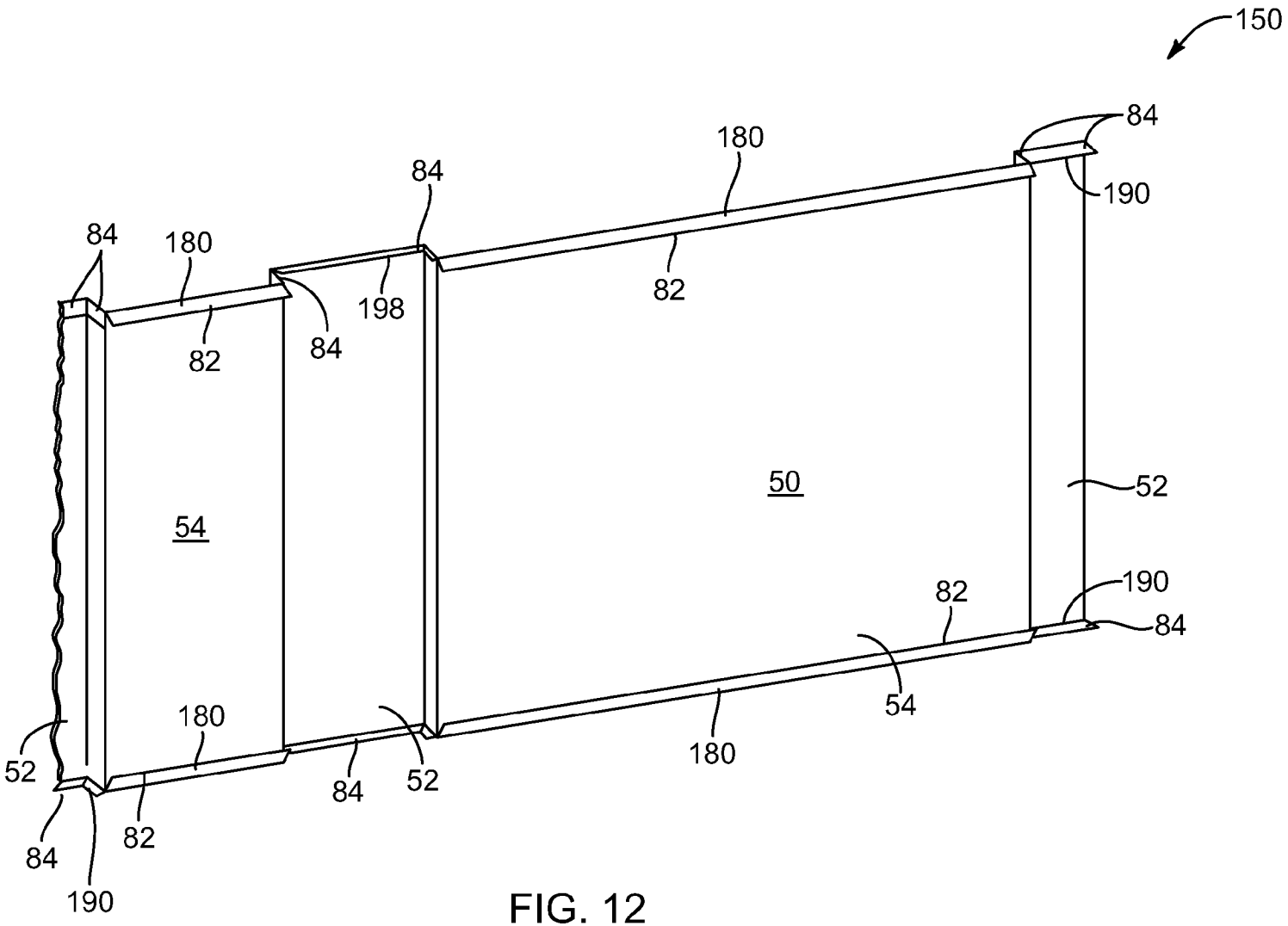
FIG. 12 is a perspective, rear view of a paneled skin in accordance with a representative embodiment of the present invention.
Figure 13:
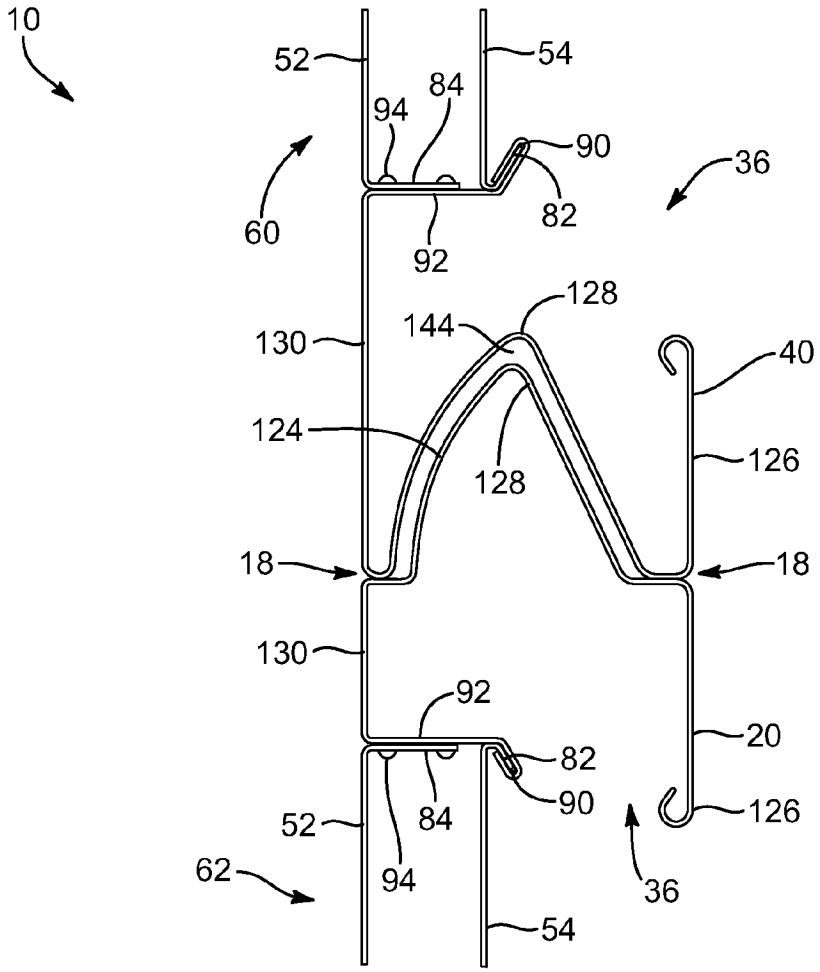
FIG. 13 is a cross-sectioned side view of an upper and lower molding of a framed finger shield joint in accordance with a representative embodiment of the present invention.

Referring now to FIG. 12, a rear perspective view of the paneled skin 150 is shown. Of particular note are the generally horizontal edges 180 and 190 of the paneled skin 150. The horizontal edges of the paneled skin 150 are cut, shaped and bent to provide various surfaces and features to compatibly engage and fixedly attaché the upper and lower moldings 20 and 40 of the door 10. For example, the horizontal perimeter edges 180 of the recessed surfaces 54 are bent to provide a lip 82 extending outwardly from the paneled skin 150. The lip 82 provides an elongate, compatible surface to which a mounting channel 90 of the upper and lower moldings 20 and 40 may be coupled and secured, as shown in FIG. 13. Conversely, the perimeter edges 190 of the raised surfaces 52 are cut and bent to approximately 90° relative to the paneled skin 150. As such, the perimeter edges 190 form a plurality of flanges 84 to which a mounting surface 92 of the upper and lower moldings 20 and 40 is attached. As such, the paneled skins 150 and the moldings 20 and 40 are compatibly and permanently coupled to provide an aesthetically pleasing carriage style sectional door.

Referring now to FIG. 13, a cross-sectional side view of the framed finger shield joint and attached paneled skins 150 is shown. Each molding 20 and 40 is generally an opened box shape and comprises a backing flange 126, a mating surface 128, a mounting channel 90, a mounting surface 92, and a face surface 130. The backing flange 126 extends upwardly from the framed finger shield joint 18 and is generally parallel to the plane of the paneled skin 150. A gap 36 is provided between the backing flange 126 and the paneled skin 150 to allow placement of insulation or another backing material within the door 10. The upper molding 20 is further configured to compatibly seat within a receiving channel 144 of the lower molding 40. Thus, the receiving channel 144 of the lower molding 40 and the contoured surface 124 of the upper molding 20 form mating surfaces 26 to prevent unwanted passing of wind and moisture through the joint 18.

The moldings 20 and 40 each further include a mounting channel 90. The mounting channels 90 are configured and operate in an identical manner to the mounting channels previously discussed in connection with the concealed moldings 22 and 42, above. However, the mounting channels 90 of the upper and lower moldings 20 and 40 are not directly attached to the mating surface of the moldings, but rather are directly attached to the mounting surfaces 92 of the moldings 20 and 40. The mounting surface 92 comprise a short, linear length of molding that is perpendicular to and directly attached to the face surface 130 of the molding 20 and 40. The mounting surface 92 is positioned so as to align with the flange 84 features of the raised surfaces 52. As such, the flange 84 and the mounting surface 92 are coupled together via a rivet 94, a metal punch, or another fastening means, such as spot welding or an adhesive. As configured, the coupling of the flange 84 and the mounting surface 92, as well as the coupling of the lip 82 and the mounting channel 90 effectively join the paneled skin 150 and the moldings 20 and 40 to provide stylized sectional door 10 sections. Additionally, the coupling between the compatible features creates a weather tight seal as required by sectional garage doors.

Figure 14:
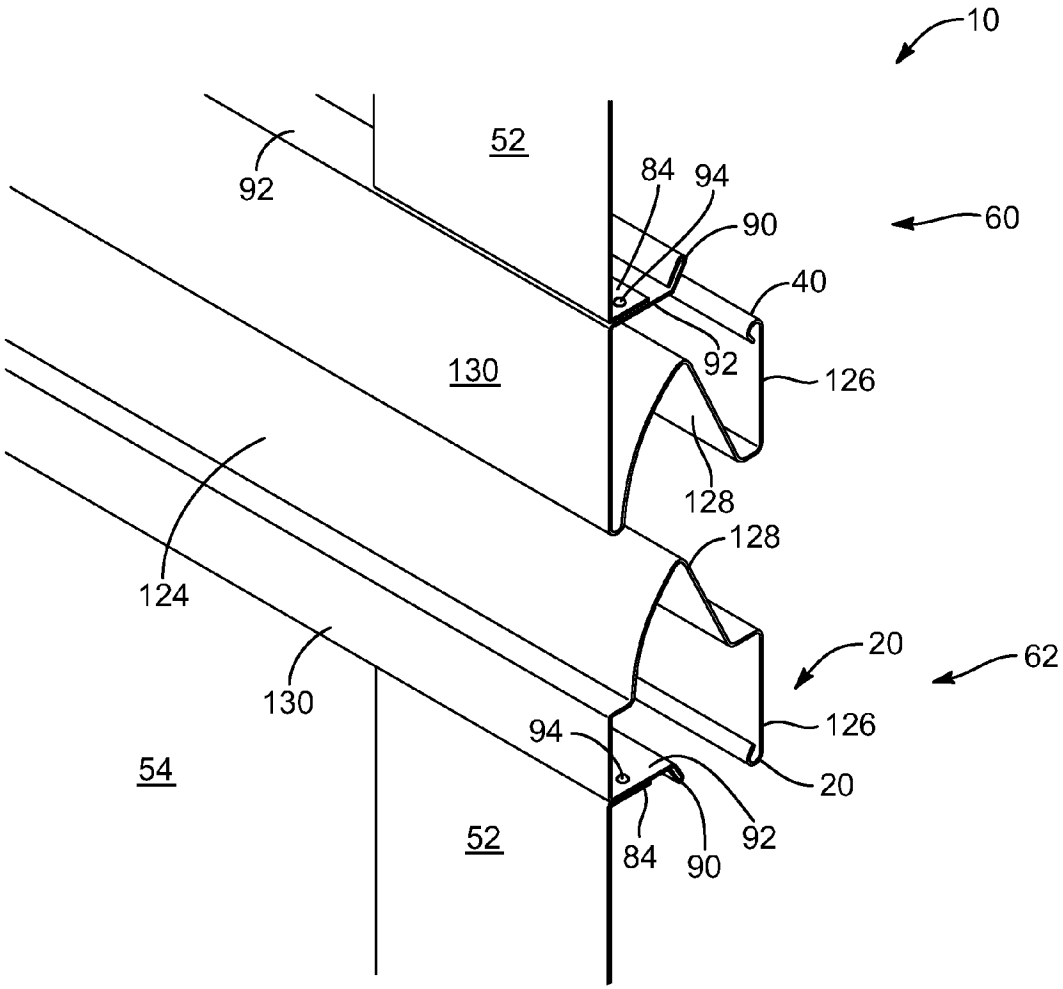
FIG. 14 is an exploded, perspective view of an upper and lower molding of a framed finger shield joint without stiles in accordance with a representative embodiment of the present invention.
Figure 15:
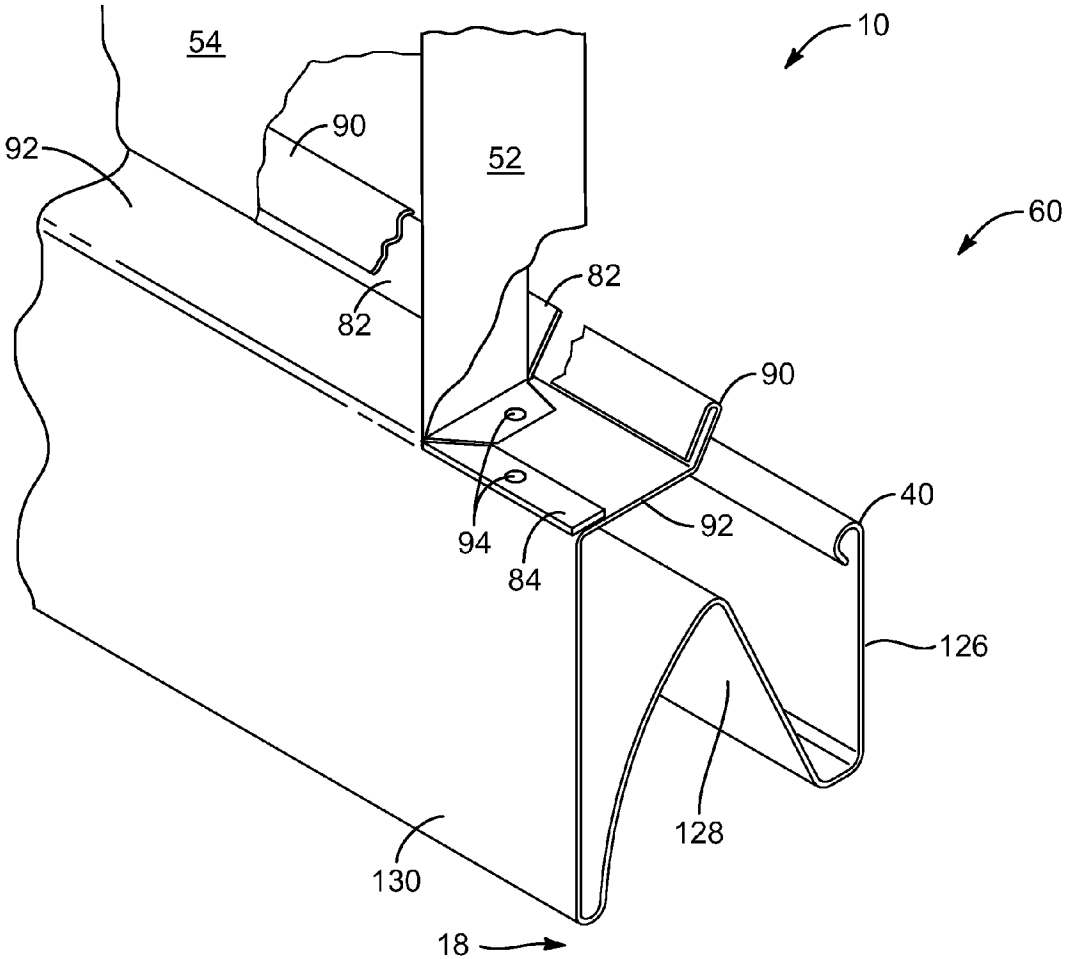
FIG. 15 is a partially cut away, perspective view of a framed finger shield joint detailing the relationship between the various components in accordance with a representative embodiment of the present invention.

Referring now to FIGS. 14 and 15, various detailed views of the sectional door 10 are shown. Specifically, FIGS. 14 and 15 more clearly illustrate the relationship between the paneled skin 150, the mounting channel 90 and the lip 82, and the flange 84 and the mounting surface 92. Referring now to FIG. 14, an exploded, perspective view of FIG. 13 is shown. Of particular note is mounting surface 92. Specifically, the relationship between the paneled skin 150 and the moldings 20 and 40 results in mounting surface 92 intermittently being concealed and exposed across the sections 60 and 62. For example, where the paneled skin 150 is raised 52, the mounting surface 92 is concealed and riveted or otherwise attached to the flange 84 of the skin 150. Additionally, where the paneled skin 150 is recessed 54, the mounting surface 92 is exposed visually as ledge of a raised or outwardly extending molding or framing surface. Furthermore, where the paneled skin 150 is recessed 54, a mounting channel 90 of the molding 20 and 40 is coupled with a lip portion 82 of the skin 150 and pressed to further couple the paneled skin 150 and the moldings 20 and 40, as shown in FIG. 15. This intricate configuration provides an aesthetically pleasing and customizable carriage house style sectional door that overcomes the difficulties associated with current carriage house style doors.

Figure 16:
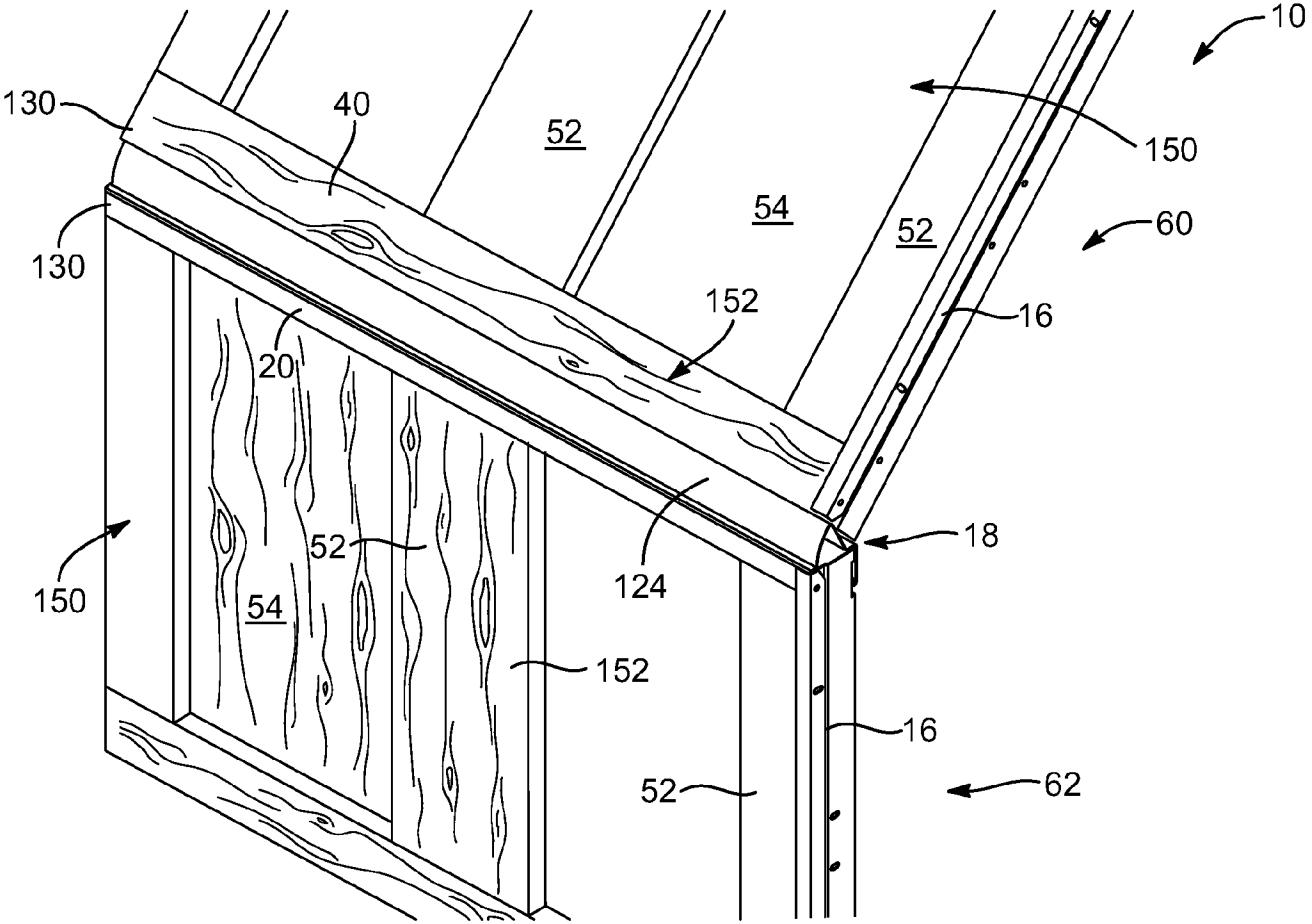
FIG. 16 is a perspective view of a sectioned door in a hinged position in a plane including an implementation of a finger shield in accordance with a representative embodiment of the present invention.

Referring now to FIG. 16, the first and second sections 60 and 62 are shown in a hinged position. As previously discussed, the raised and recessed surfaces 52 and 54 of the paneled skin 150, along with the upper and lower moldings 20 and 40 are provided to create an aesthetically pleasing and accurate carriage style sectional door 10. In addition to being aesthetically pleasing, the contoured surface 124 of the upper molding 20 permit the sections 60 and 62 to hingedly flex but prevent fingers or other objects from being inserted therebetween. Thus, the framed finger shield joint 18 is aesthetically pleasing and a functional safety element of the sectional door 10.

The sectional door 10 may include other features or details to further enhance the aesthetic quality of the door 10. For example, in one embodiment the materials of the paneled skin 150 and the moldings are embossed with a pattern or design 152. In one embodiment the embossing 150 is a wood grain pattern to simulate a wood material. In another embodiment the embossing 150 is a geometric shape, such as a pattern of parallel grooves or a corrugated pattern. In yet another embodiment, a paint and/or texture is added to the paneled skin 150 and the moldings 20 and 40 to simulate a material or style.

The process for fabricating the sectioned door 10 may be accomplished by any known method or methods of sheet metal fabrication and tooling. One advantage of some implementations of the current invention is that the process for fabricating the sectioned door 10 may be automated and requires a minimal number of parts. For example, in one embodiment a carriage style sectional door is fabricated by first cutting a 24 or 26 gauge piece of sheet metal into three pieced, the dimensions of each piece corresponding to one of a paneled skin, an upper molding, or a lower molding. Each piece is then run through a sheet metal tooling device to cut, bend, and shape each piece to achieve the required contours, surfaces, and features as discussed in detail above. Next, a first molding and the paneled skin are abutted along a common edge and ran through a second sheet metal tooling device that folds, hems, presses and/or rivets the necessary surfaces of the two pieces. Finally, the second molding and the paneled skin are abutted along a second common edge and ran through the second sheet metal tooling device to likewise attach the second molding and the paneled skin. Additional steps may include attaching the stiles, cutting windows along the moldings to accommodate the finger shields and/or hinges, and embossing and painting the various pieces as desired.

Thus, embodiments of the present invention relate to systems and methods for manufacturing overhead, sectional doors. Specifically, the present invention relates to methods for manufacturing wood style carriage house sectional doors from steel or other metal coil.

Figure 17A:
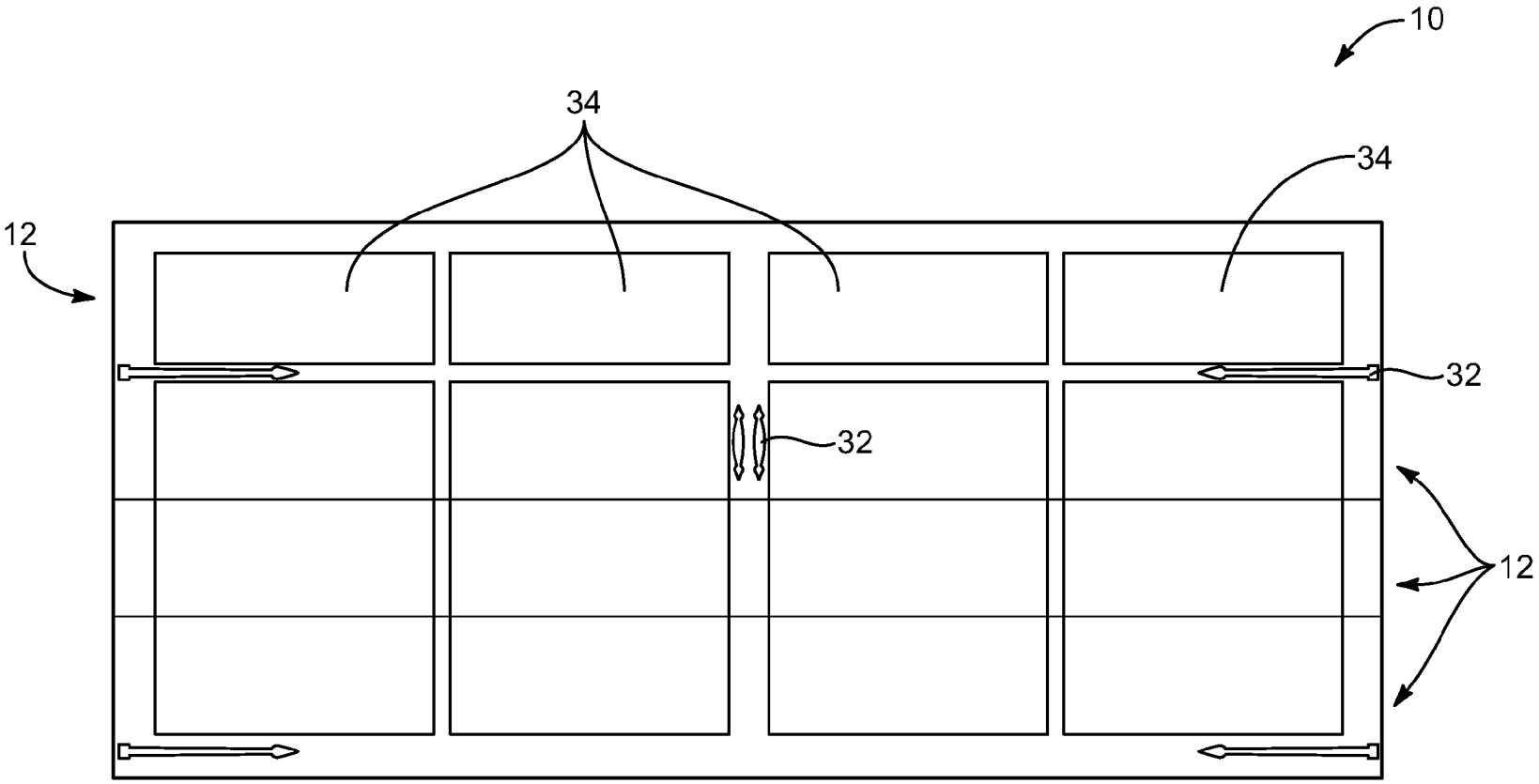
FIGS. 17A-17W are perspective views of various implementations of the current invention providing a sectional door in accordance with representative embodiments of the present invention.
Figure 17B:
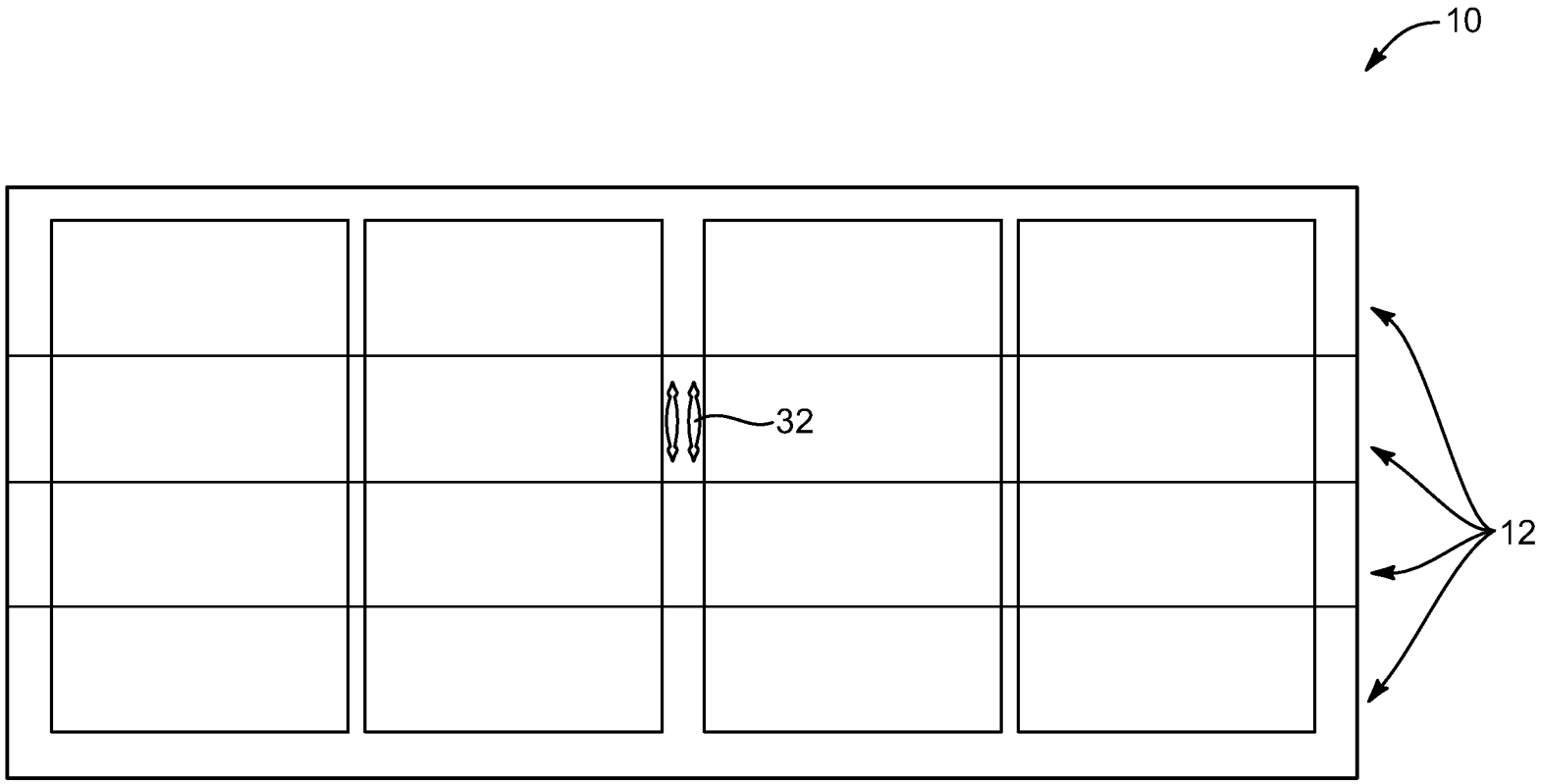
Figure 17C:
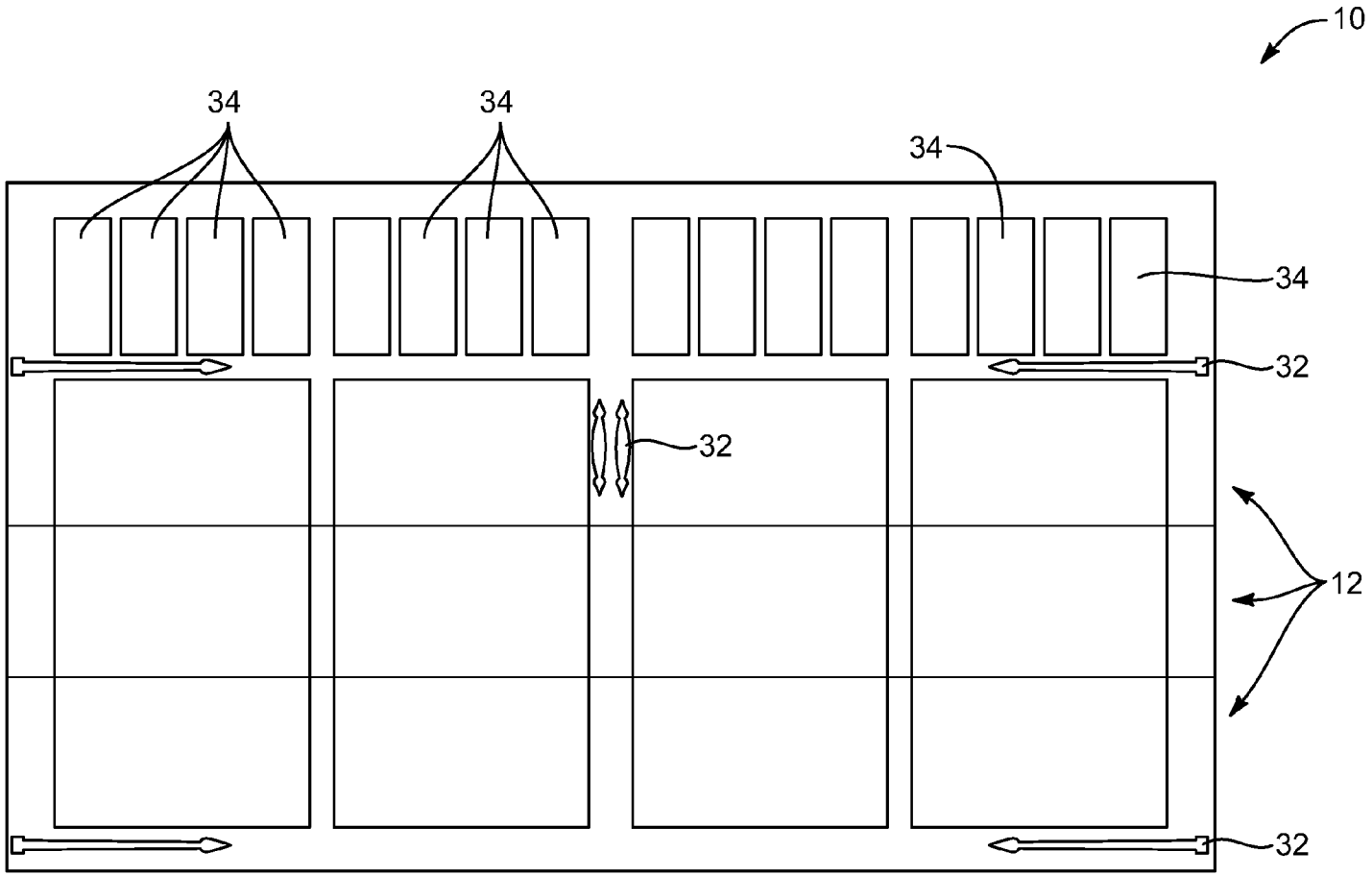
Figure 17D:
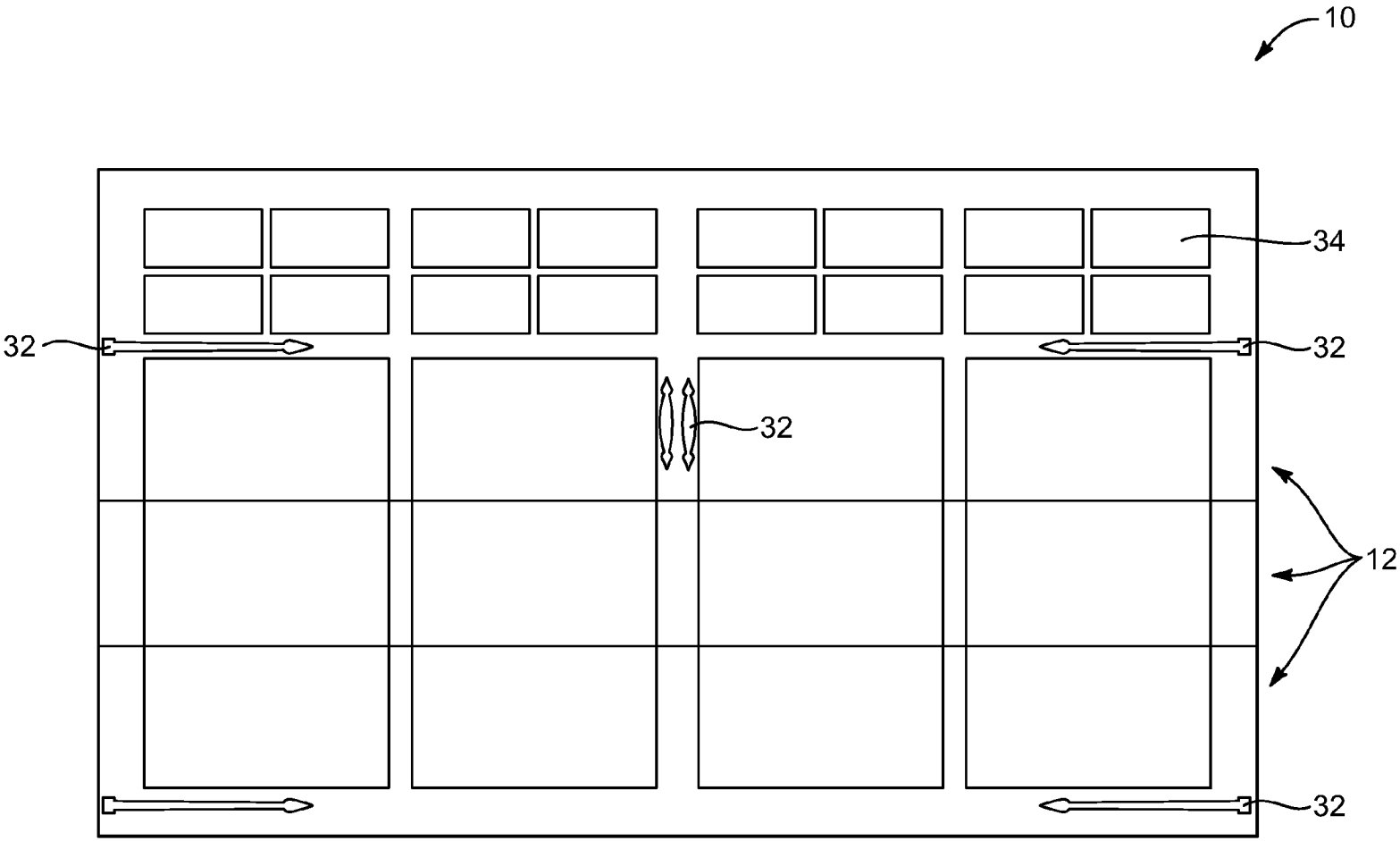
Figure 17E:
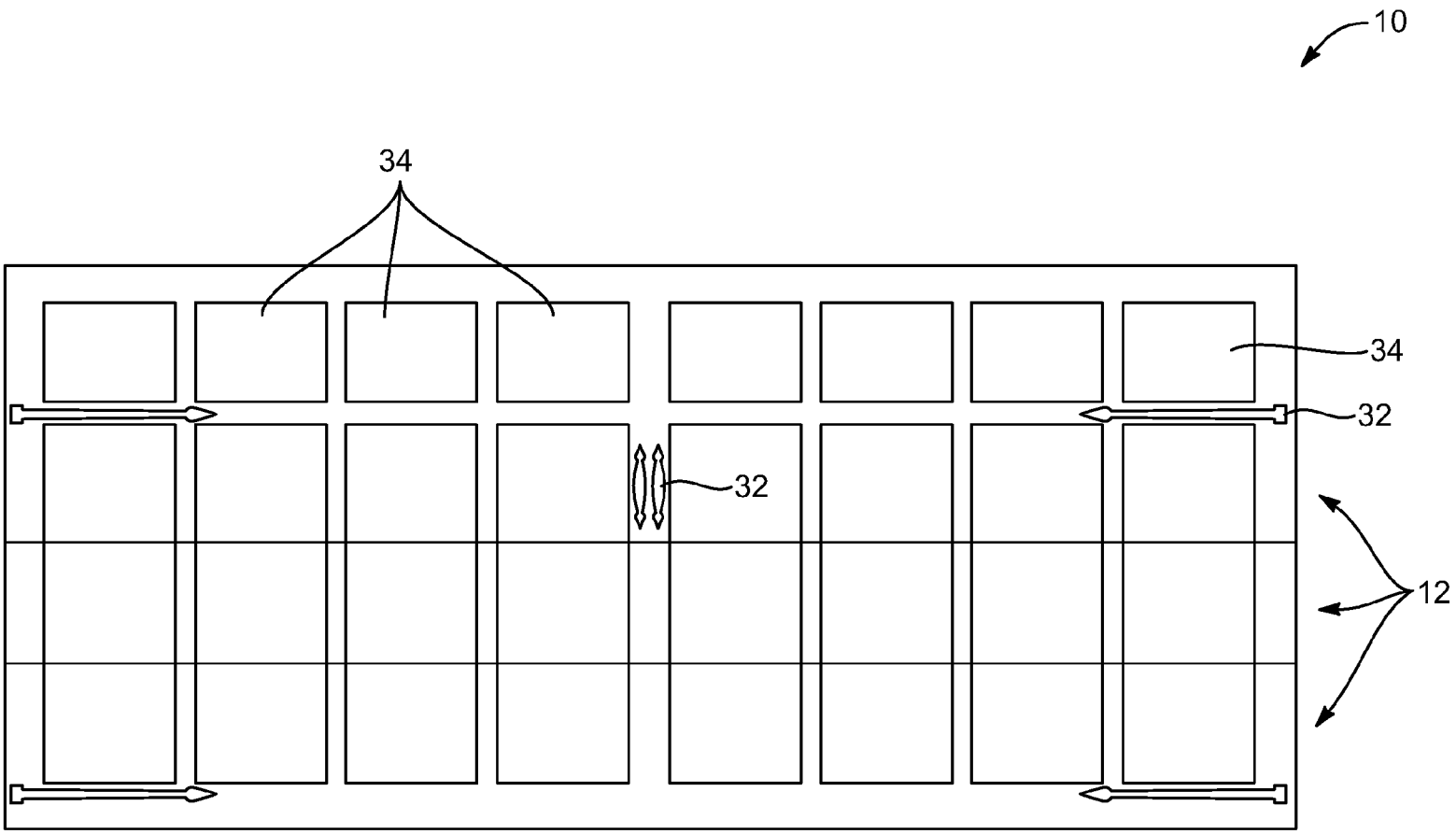
Figure 17F:
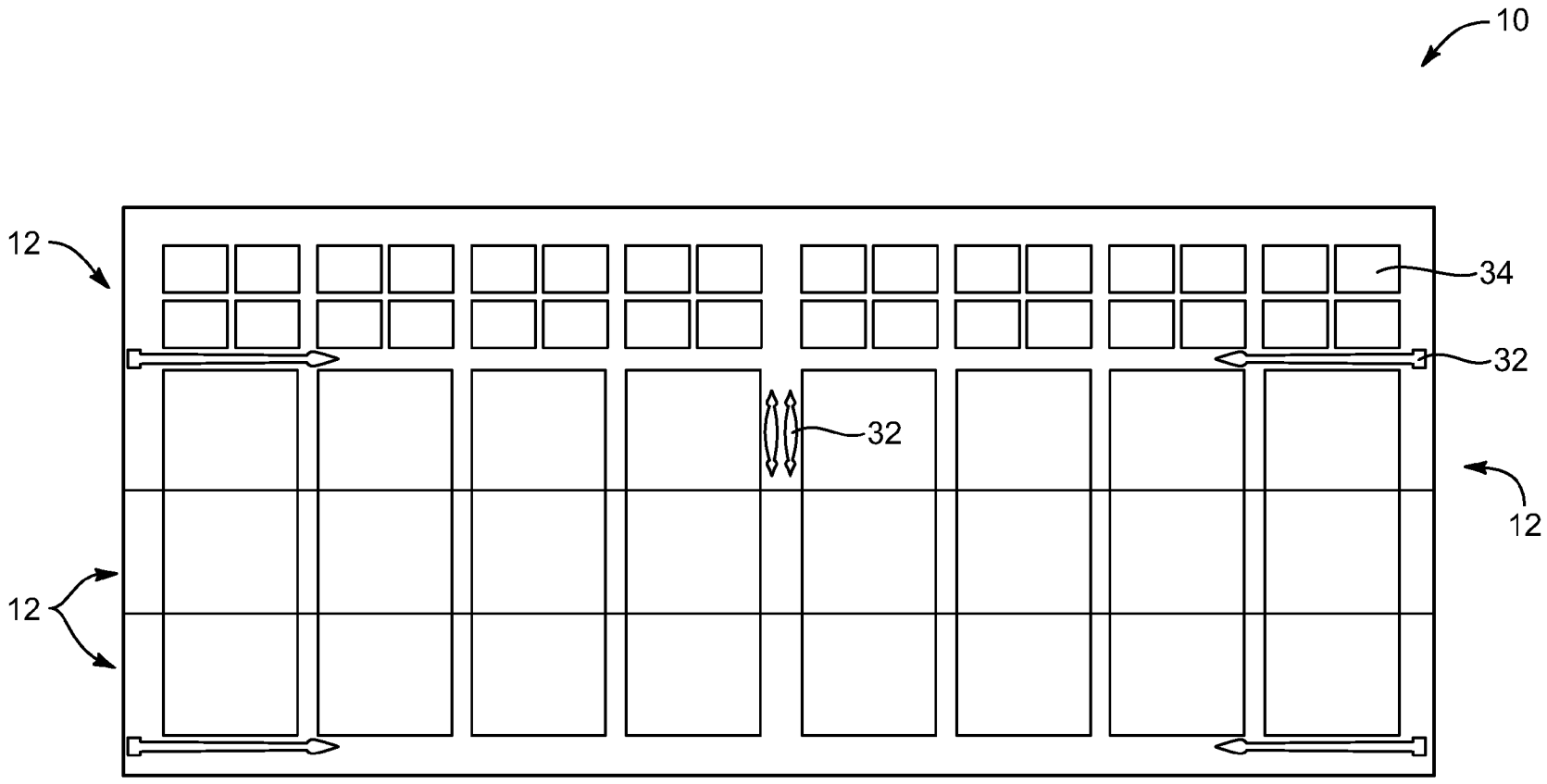
Figure 17G:
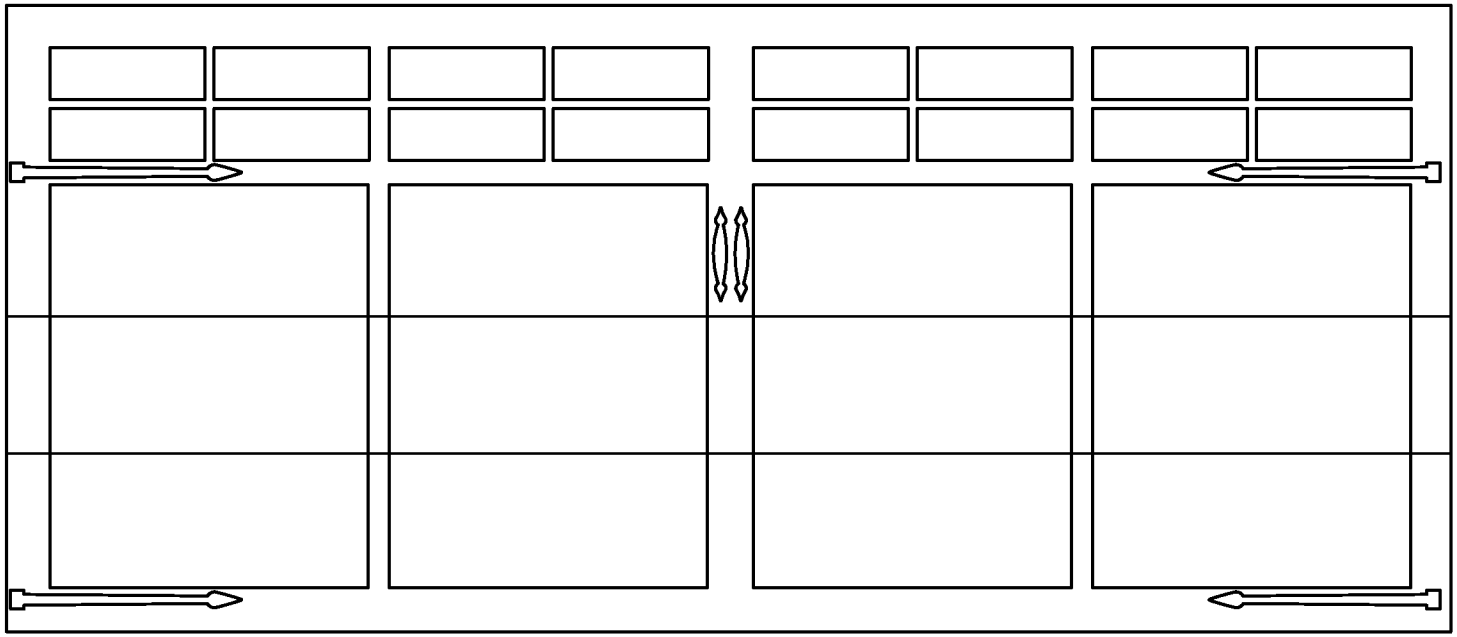
Figure 17H:
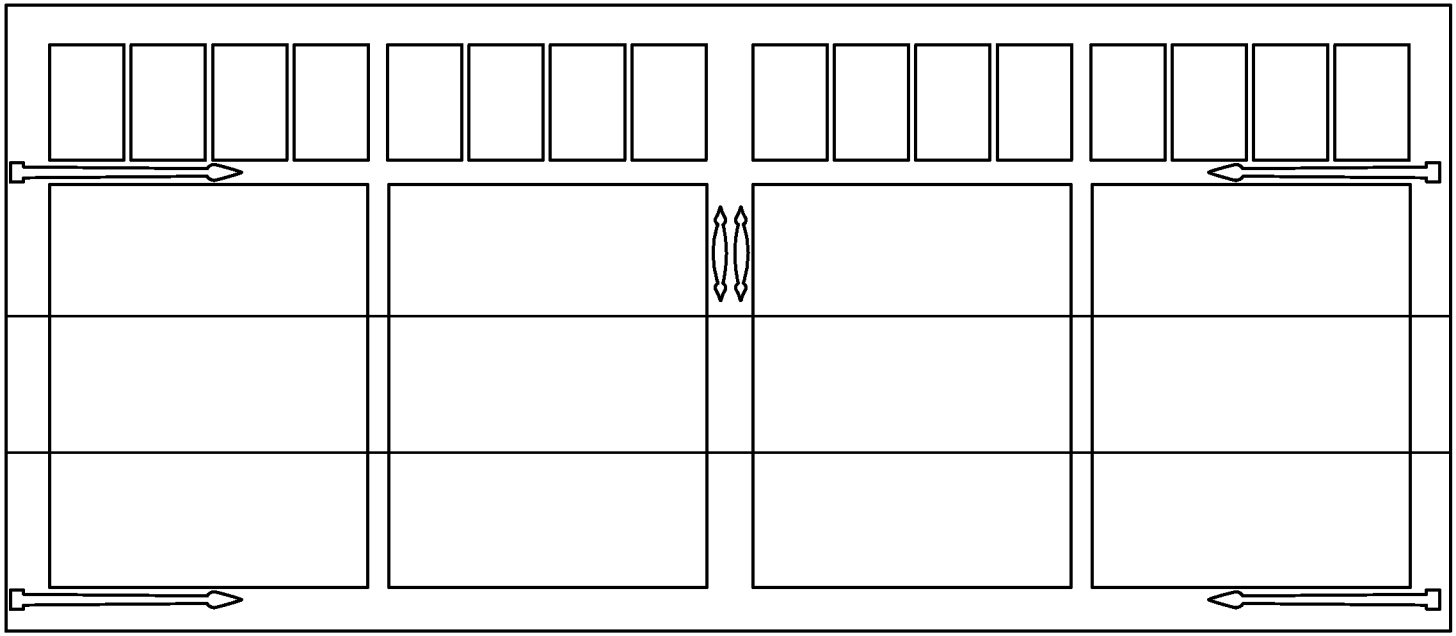
Figure 17I:
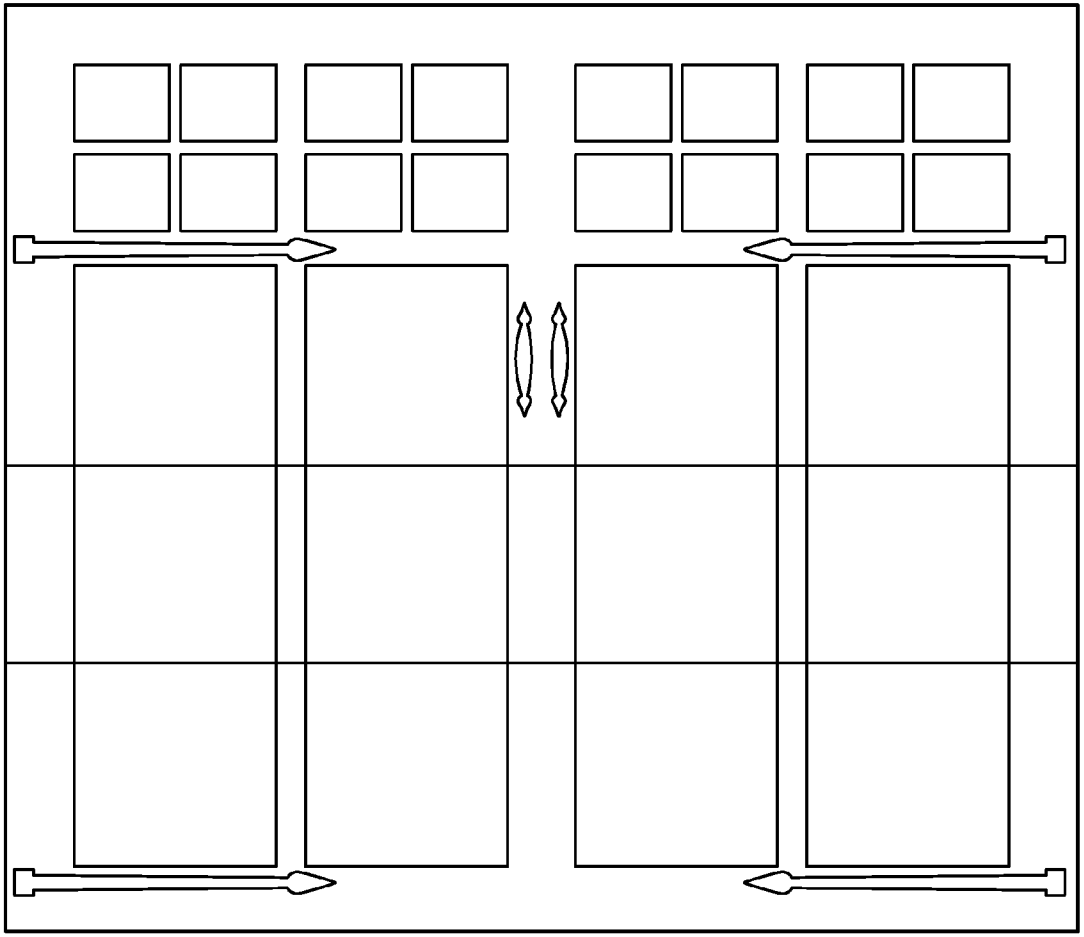
Figure 17J:
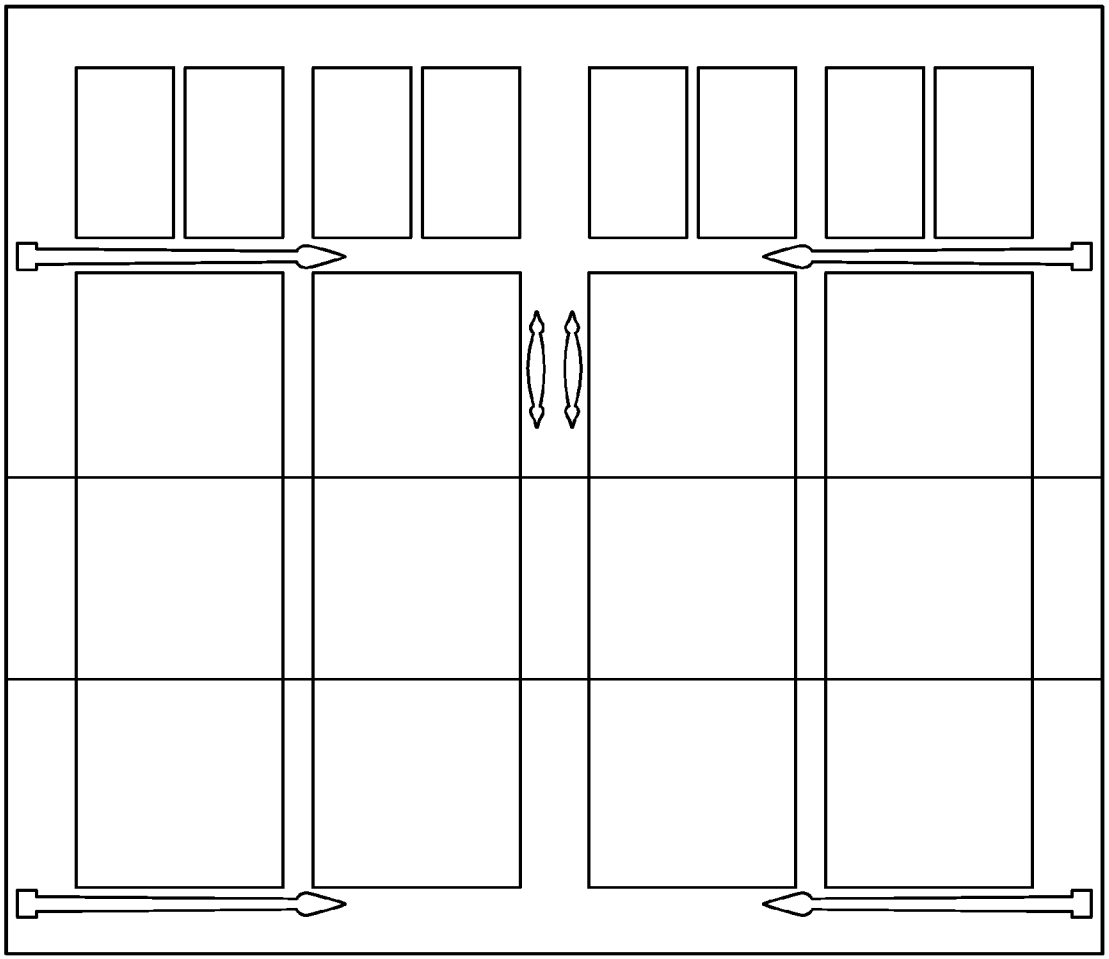
Figure 17K:
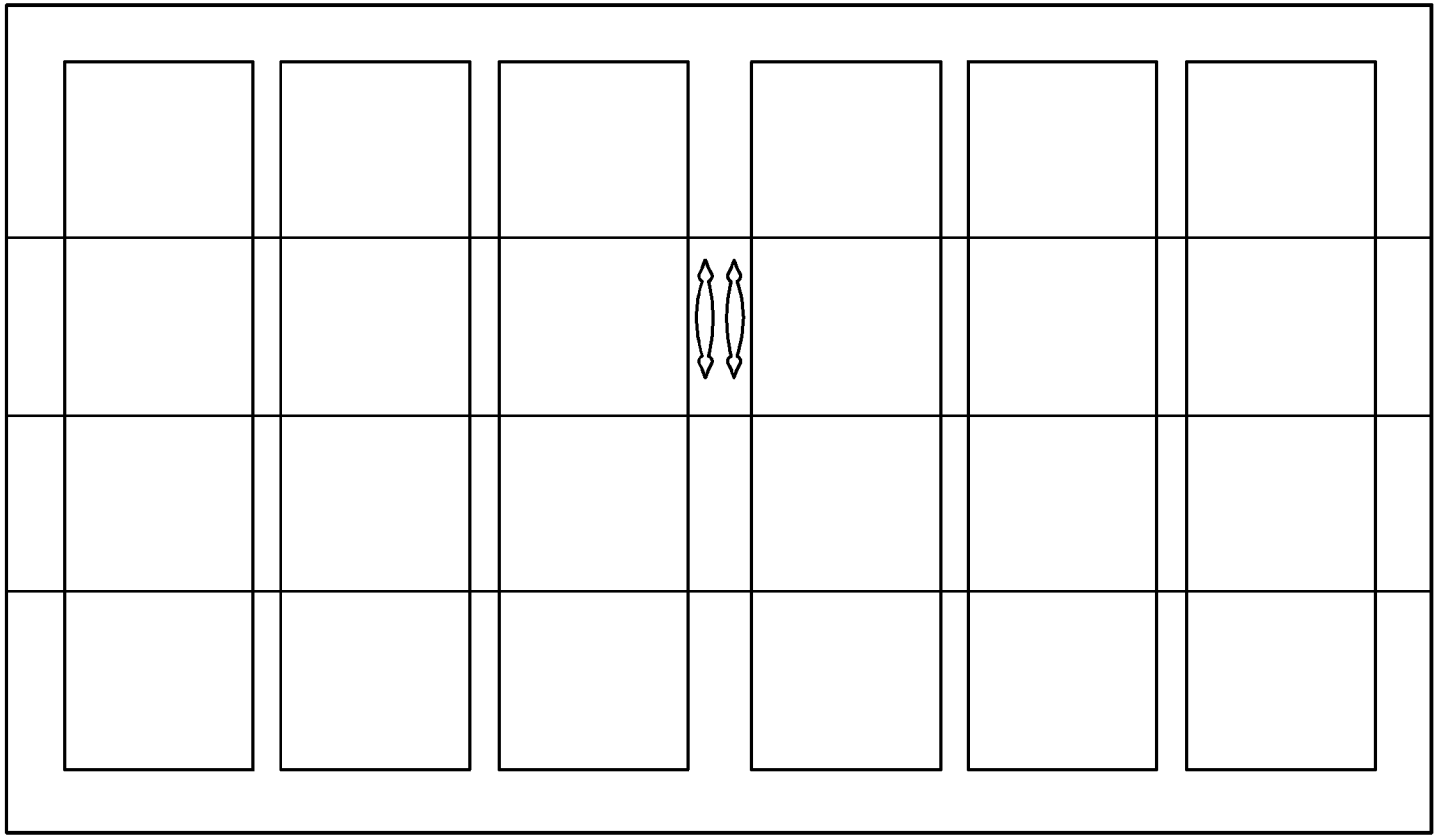
Figure 17L:
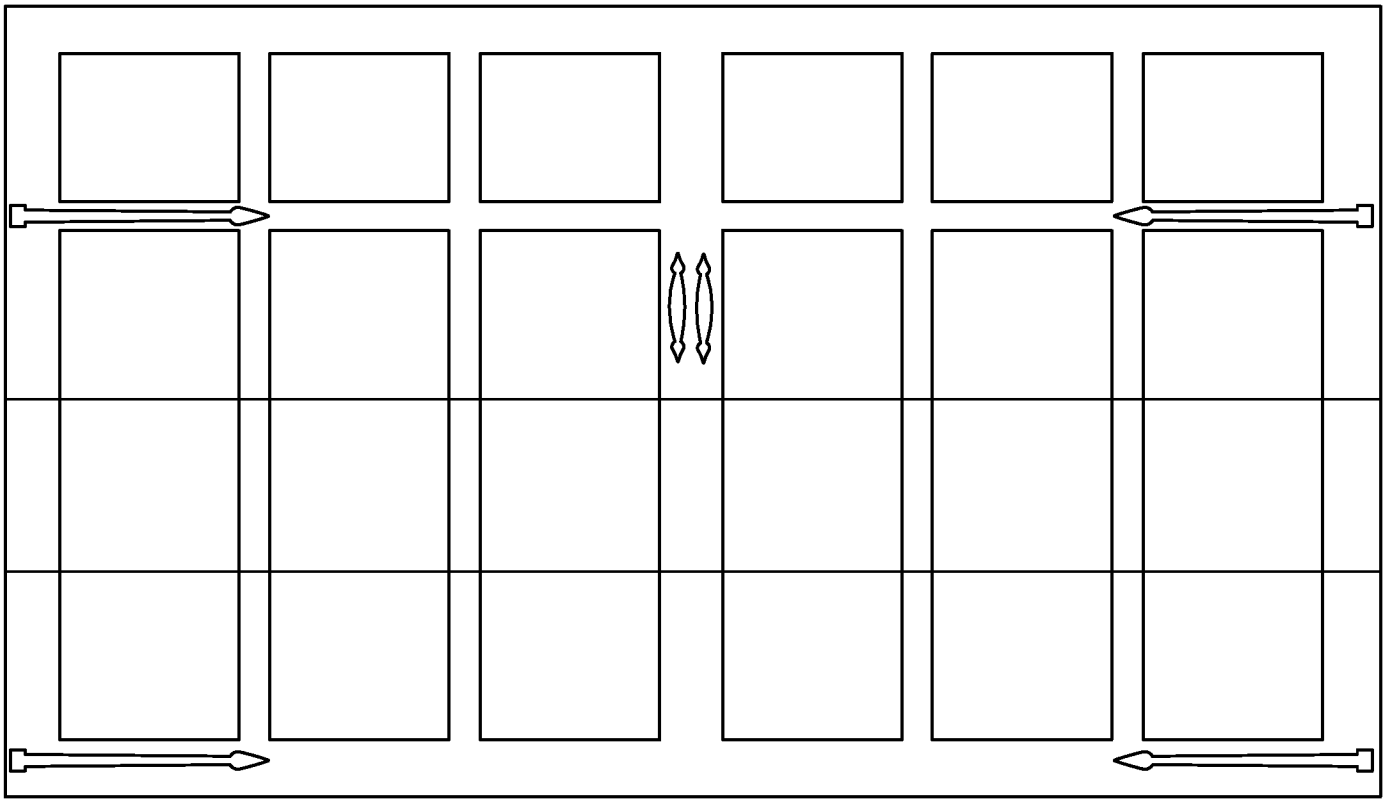
Figure 17M:
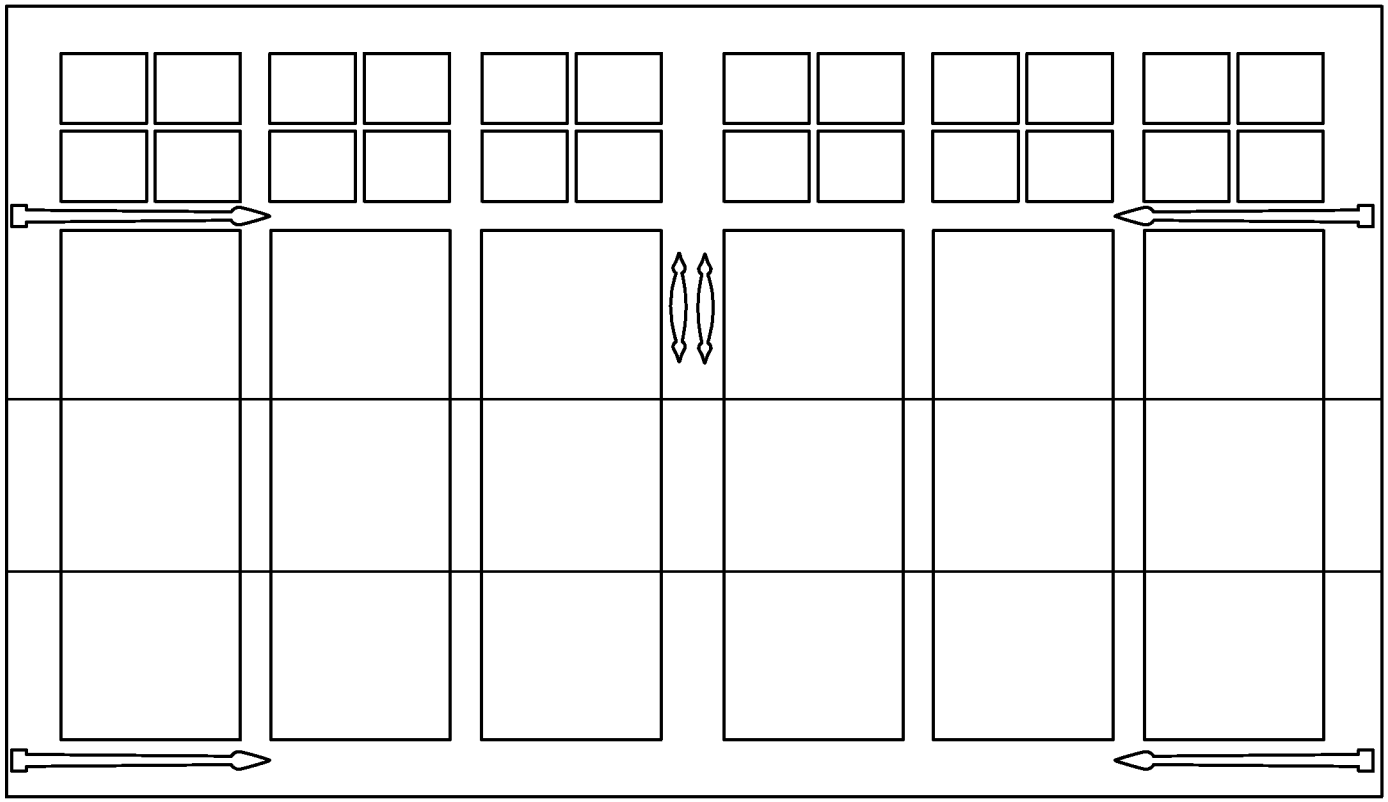
Figure 17N:
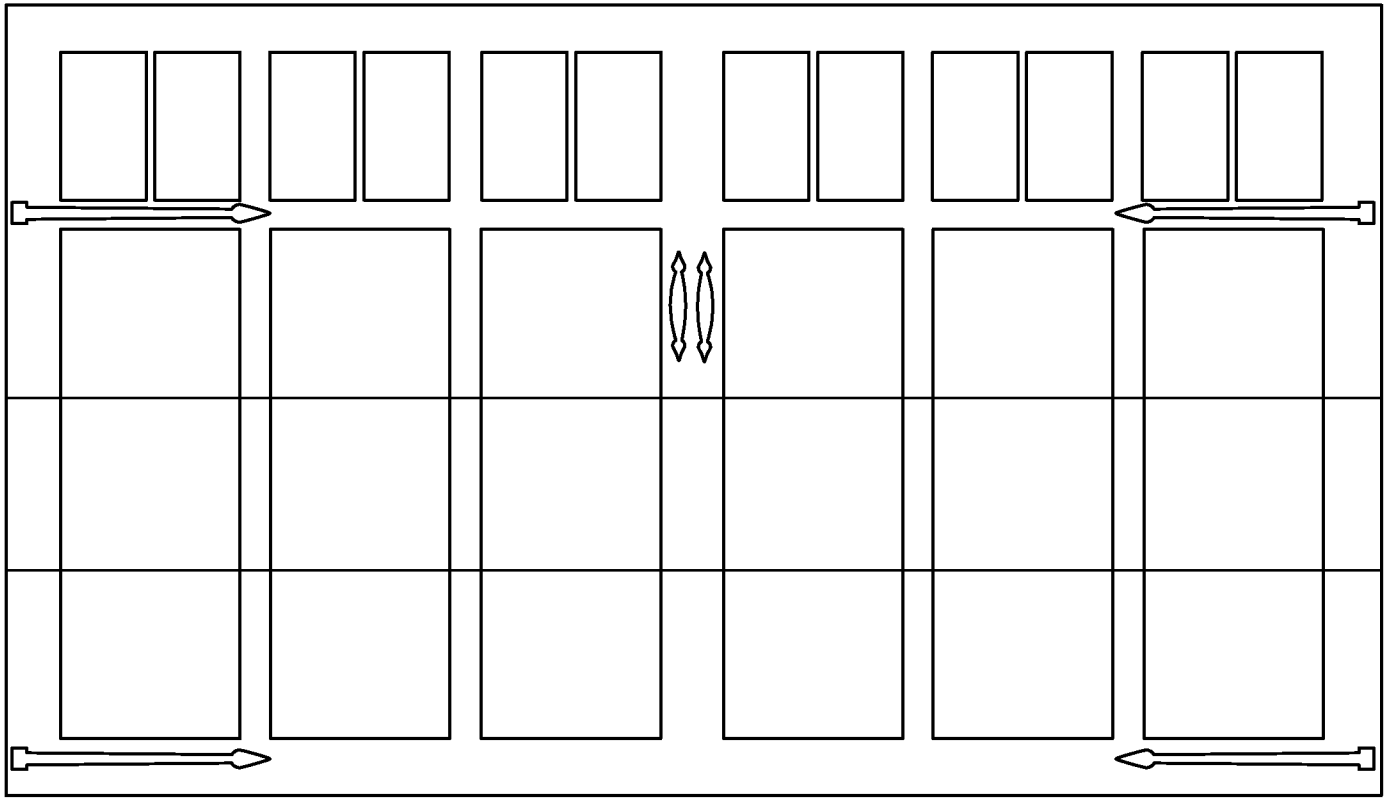
Figure 17O:
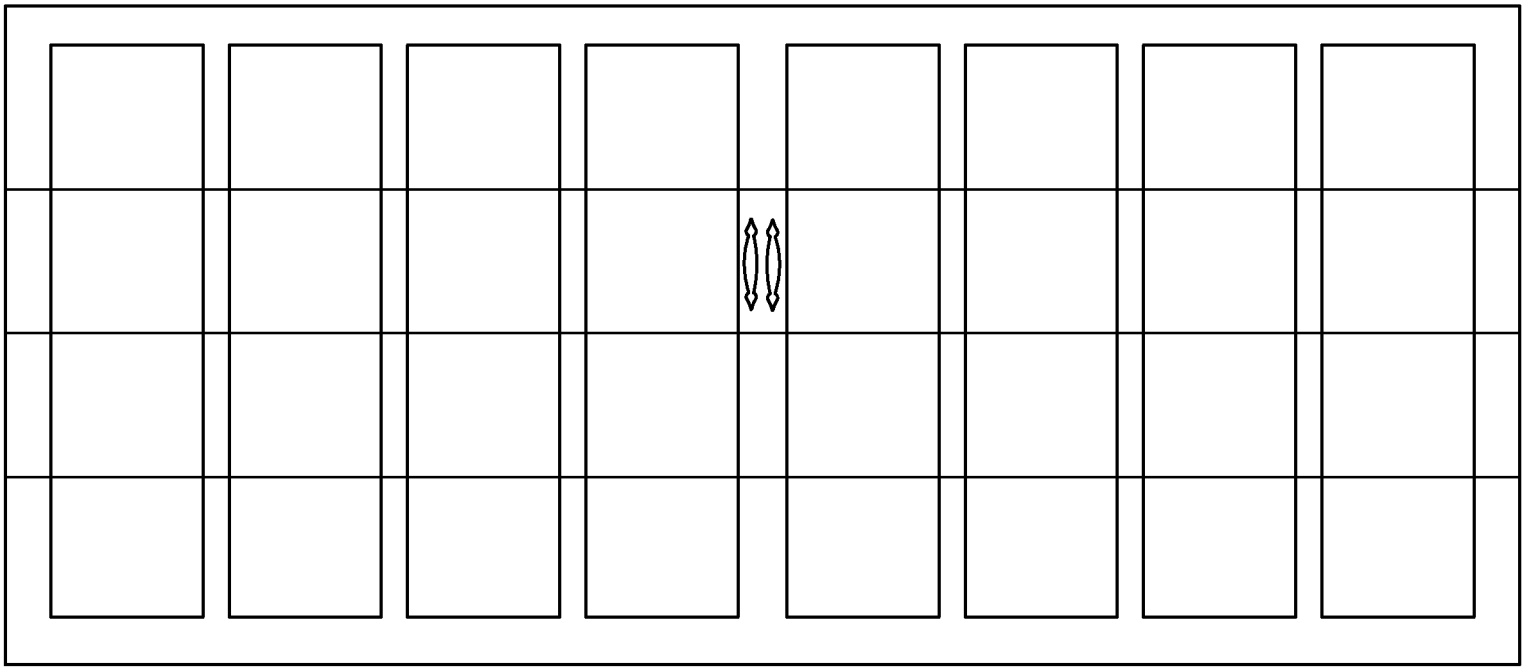
Figure 17P:
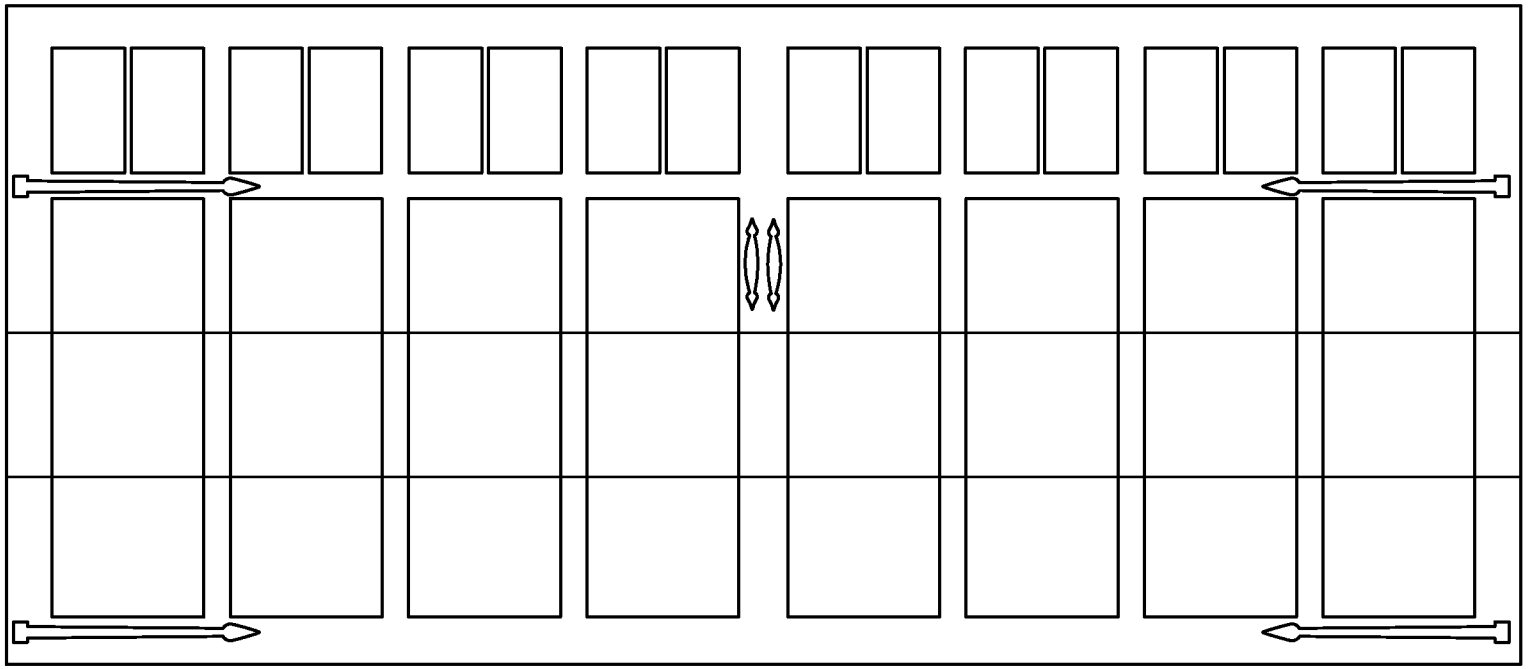
Figure 17Q:
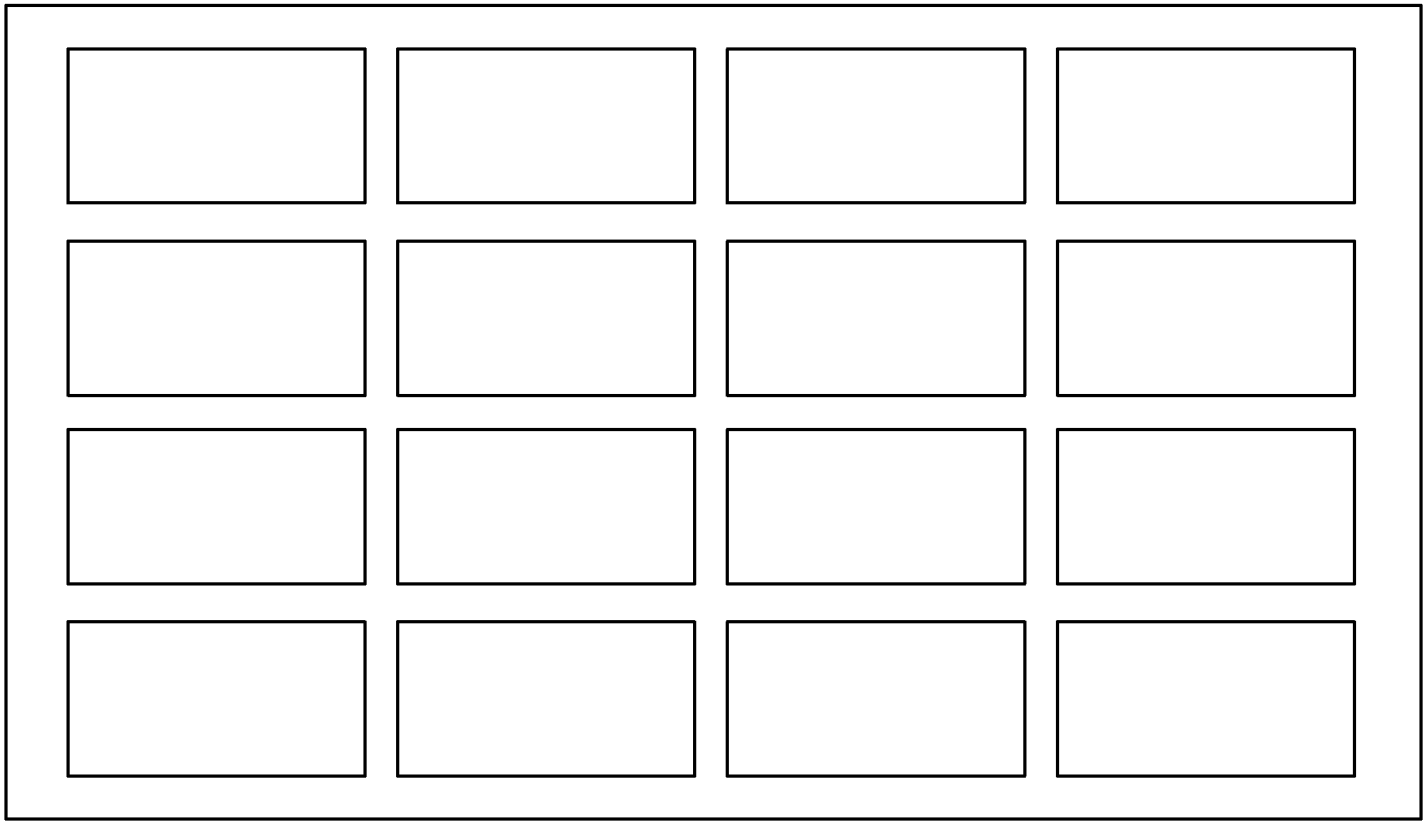
Figure 17R:
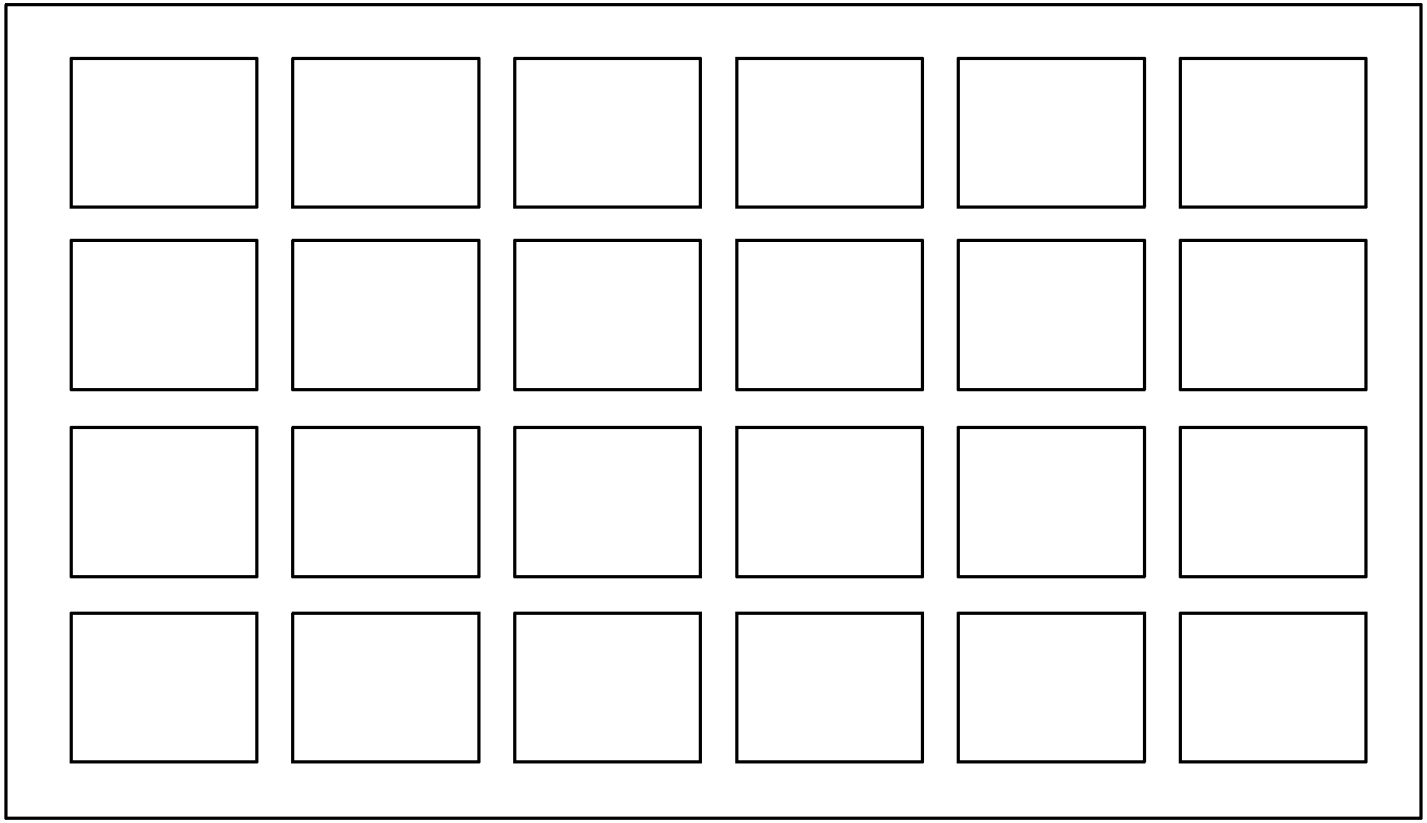
Figure 17S:
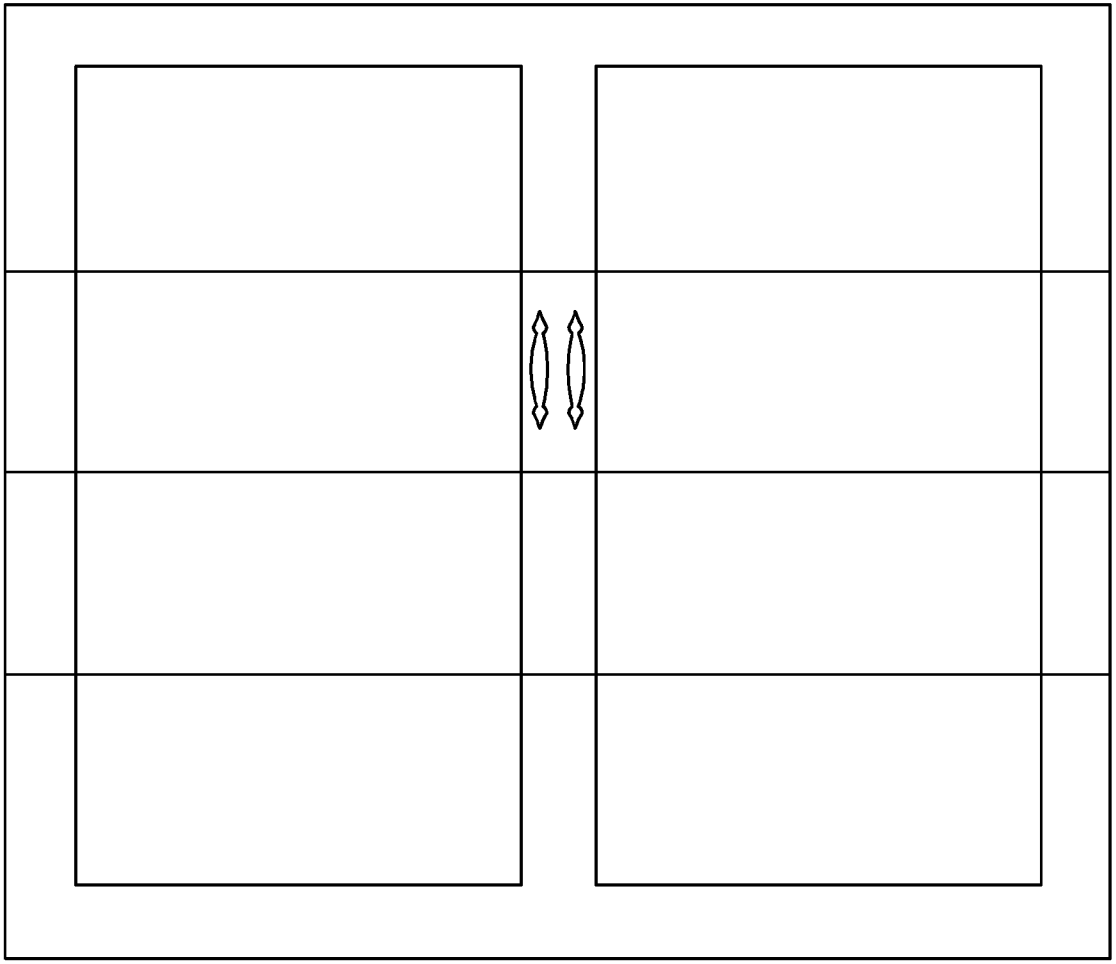
Figure 17T:
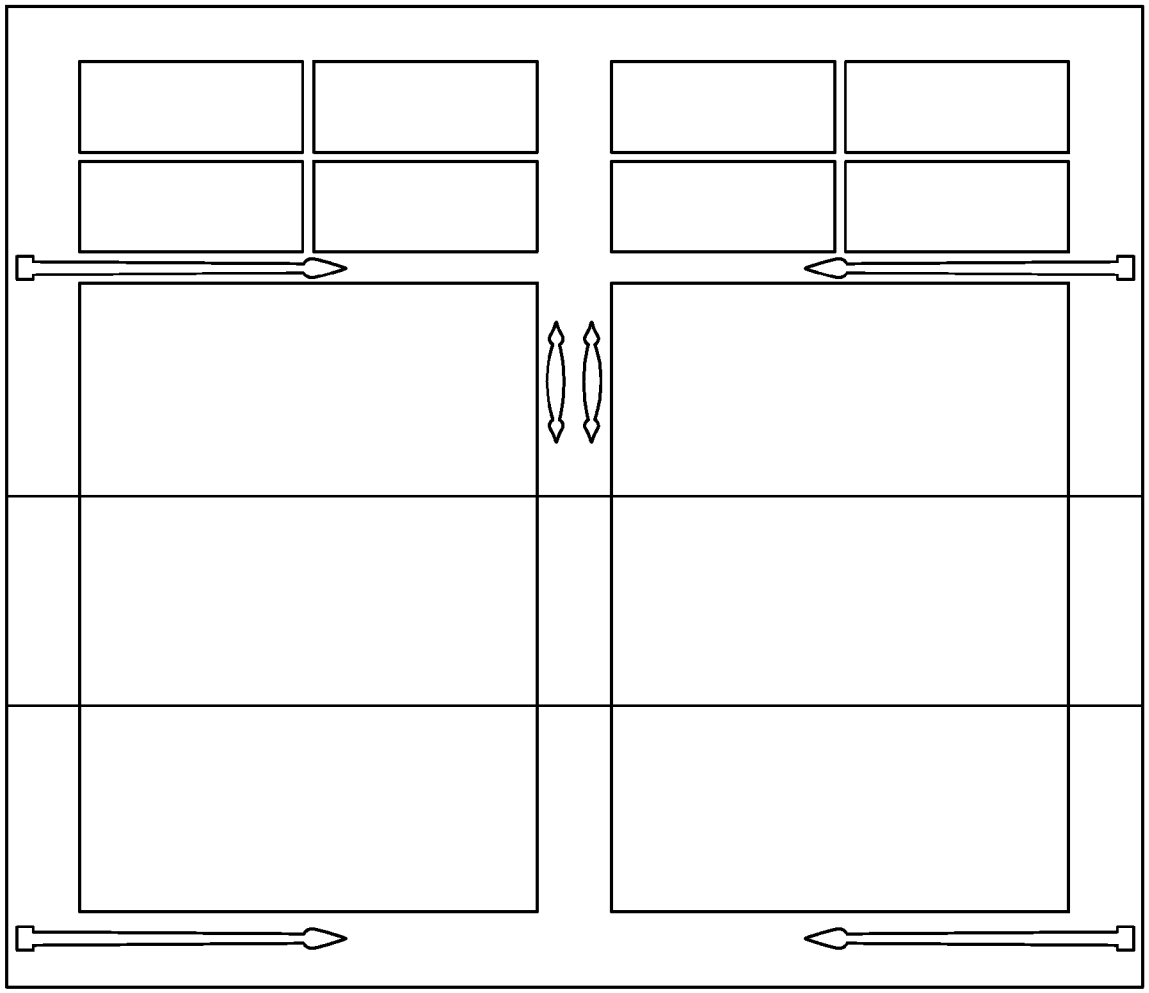
Figure 17U:
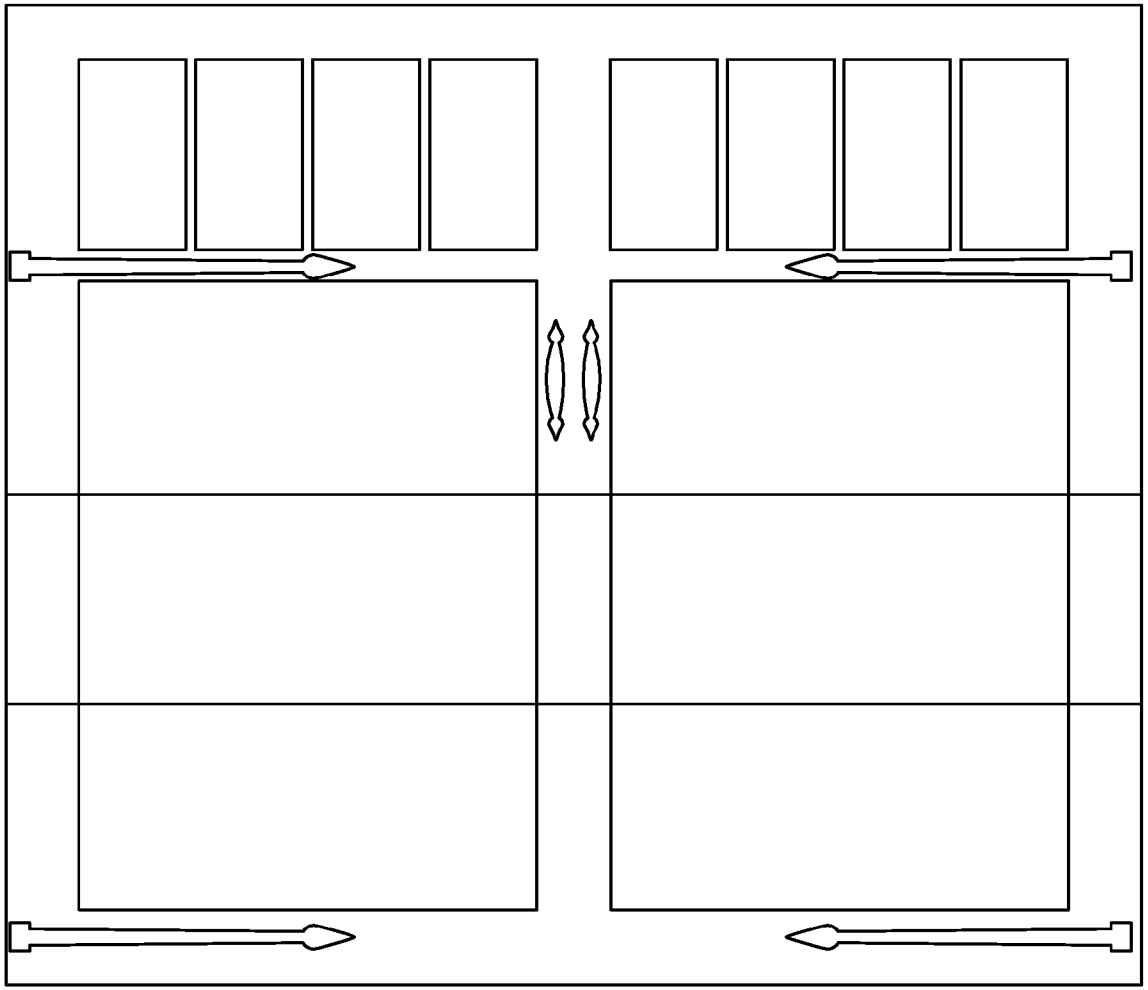
Figure 17V:
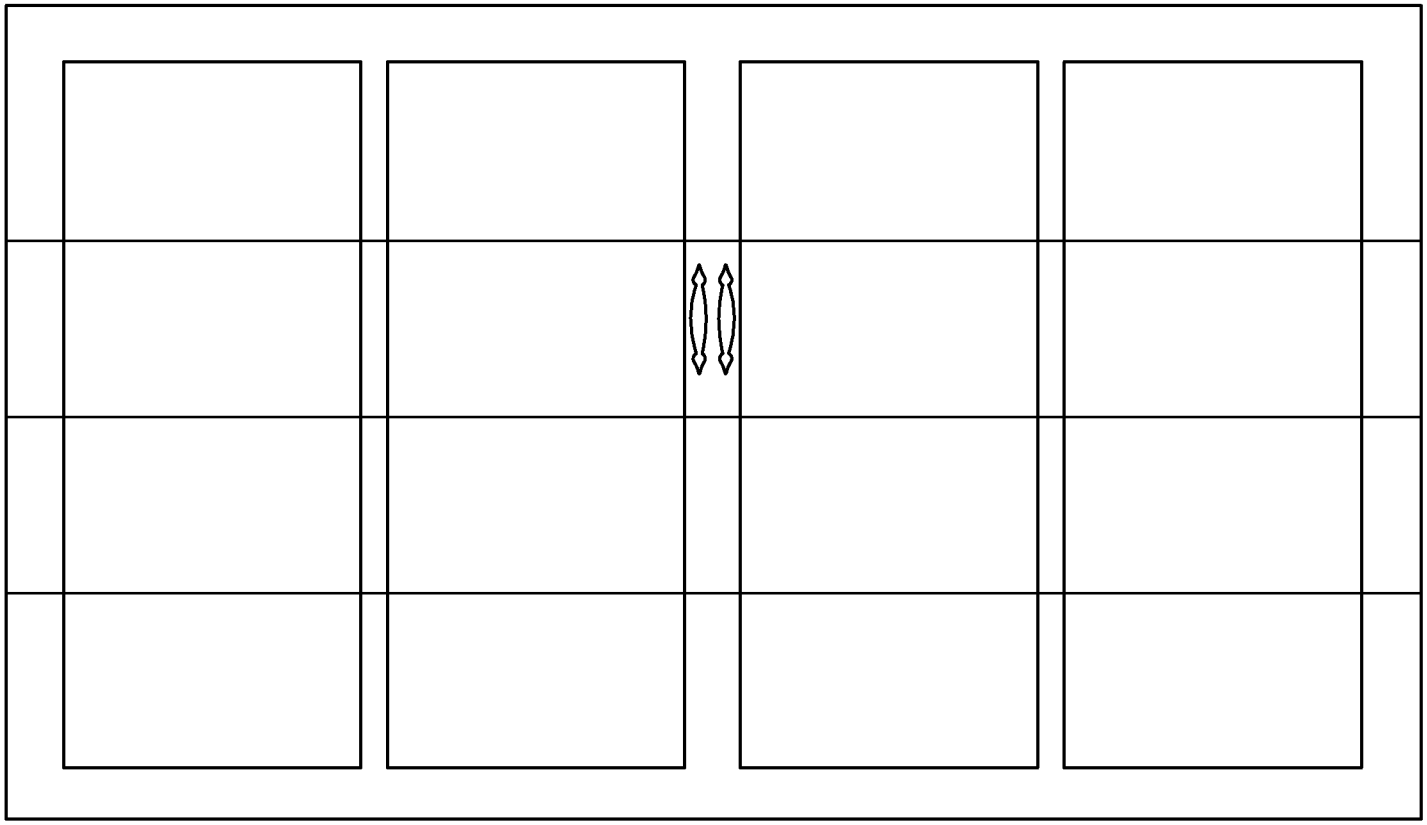
Figure 17W:
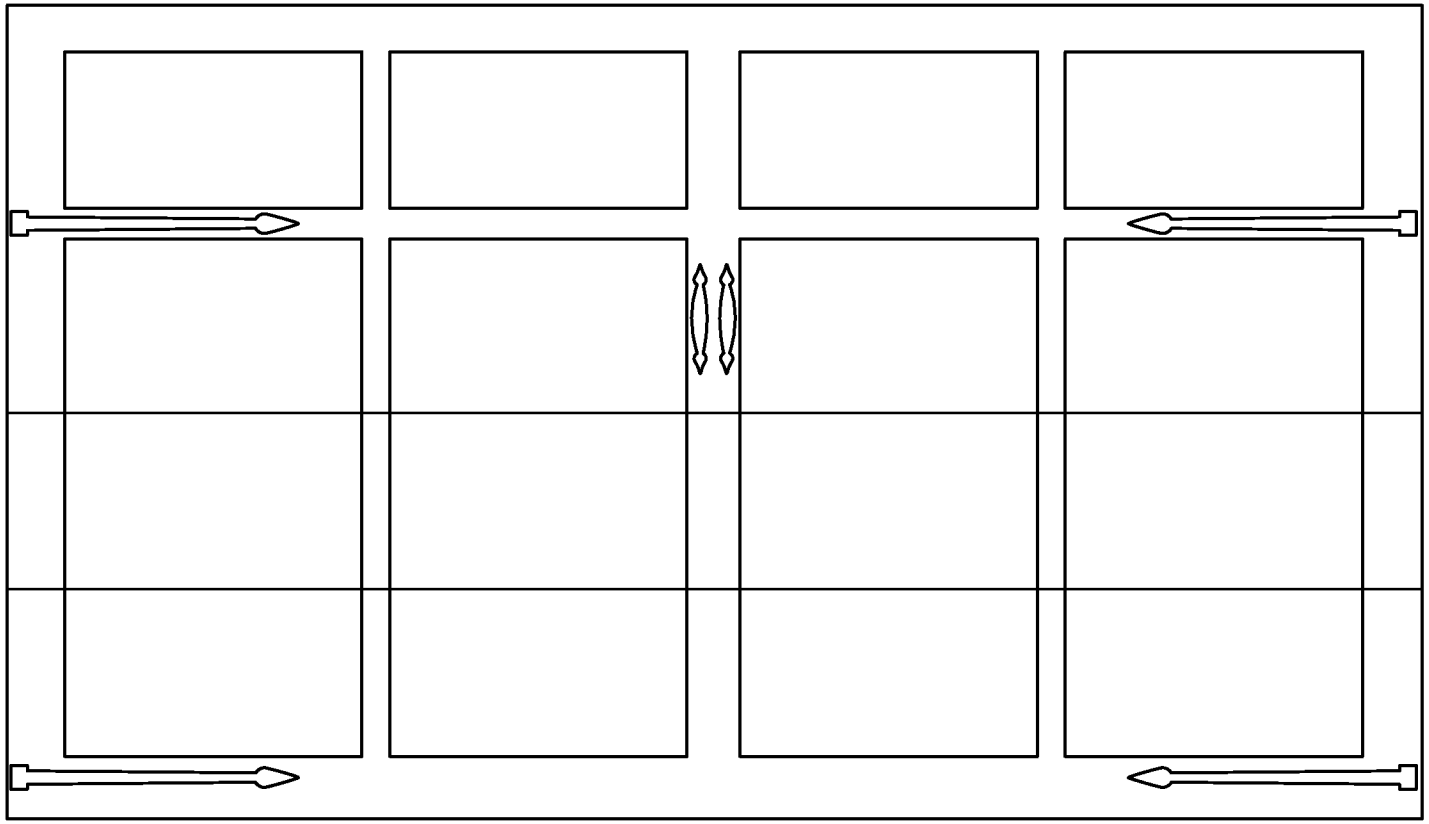

Referring now to FIGS. 17A-17W, various embodiments of the sectional door 10 are shown. As illustrated, various embodiments of the sectional door 10 may include various styles of windows 34 and other ornamental features 32. The versatility of the current invention permits incorporation of a plurality of designs and ornamental features into the final sectional door. As such, the sectional door 10 of the current invention is highly customizable and therefore may be easily designed to achieve a desired aesthetic appearance and functionality.

Figure 18:
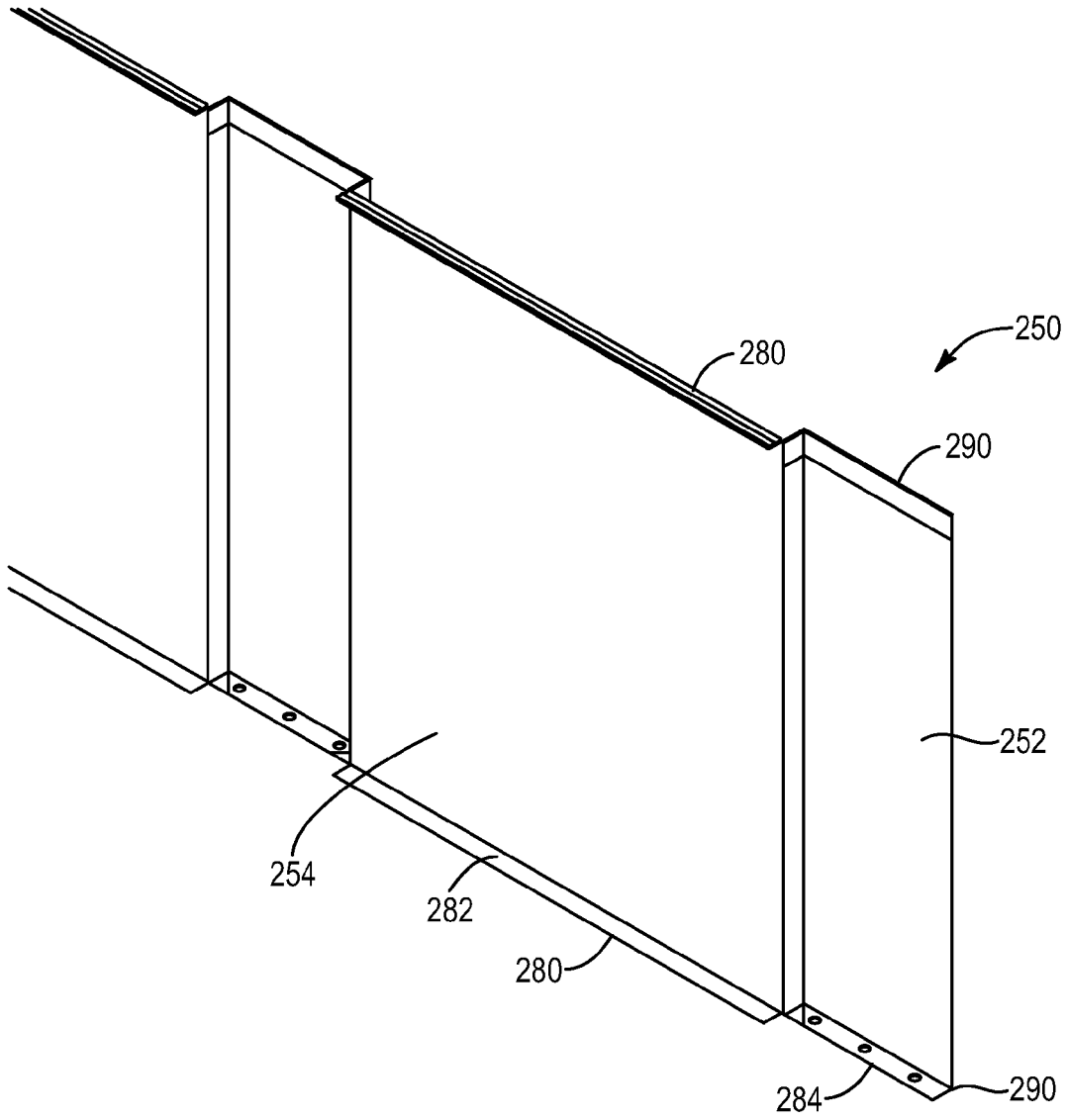
FIGS. 18-21B are perspective views of various implementations of the current invention utilizing bolt clamps to provide a sectional door in accordance with representative embodiments of the present invention.
Figure 19A:
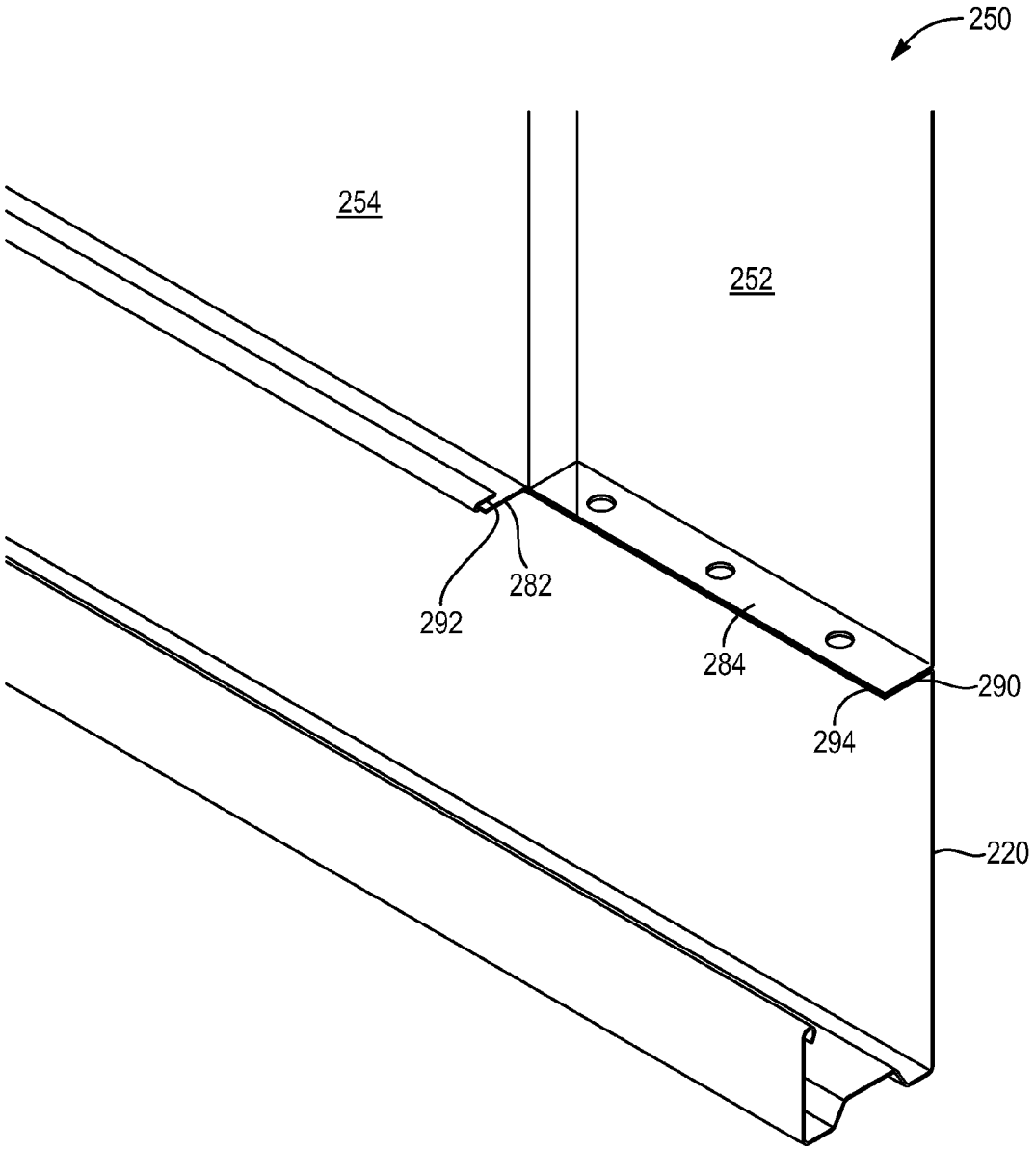
Figure 19B:
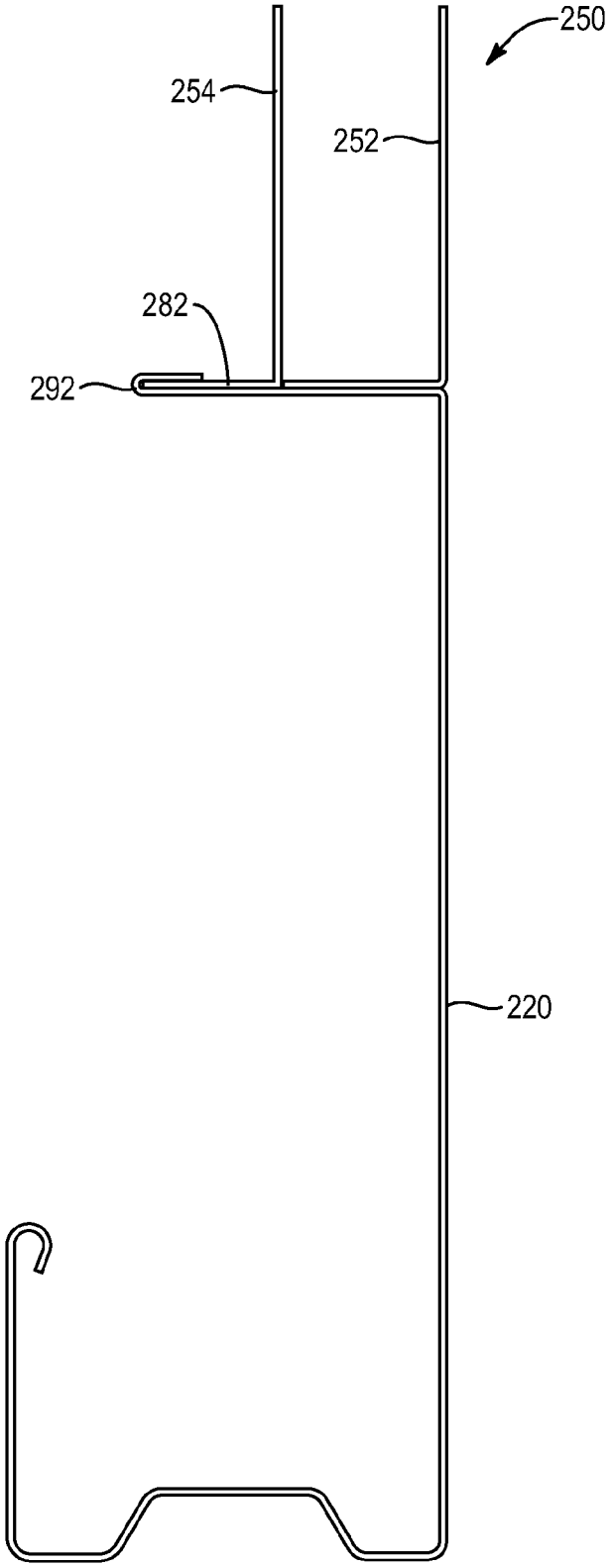

In some embodiments, the structural integrity and/or rigidity of the sectional door 10 are enhanced via use of a bolt clamp to join various components of the sectional door 10 in place of spot welds or rivets. Referring now to FIG. 18, a rear perspective view of the paneled skin 250 is shown. Of particular note are the generally horizontal edges 280 and 290 of the paneled skin 250. The horizontal edges of the paneled skin 250 are cut, shaped and bent to provide various surfaces and features to compatibly engage and fixedly attached upper and lower moldings of the door 10. For example, the horizontal perimeter edges 280 of the recessed surfaces 254 are bent to provide a lower lip 282 extending outwardly from the paneled skin 250 approximately perpendicular to the recessed surface 254. Thus, lip 282 provides an elongate, compatible surface to which a mounting channel 292 of a bottom rail 220 may be coupled and secured, as shown in FIGS. 19A and 19B. In some embodiments, lip 282 and mounting channel 292 are further secured by hemming or seaming lip 282 and mounting channel 292, as shown in FIGS. 20B and 20C. As shown, bottom rail 220 does not include any mating surfaces for receiving or inserting into an adjacent rail, as discussed previously. As such, bottom rail 220 is generally positioned at the bottom or top of sectional door 10.

With continued reference to FIGS. 19A and 19B, similarly, the perimeter edges 290 of the raised surfaces 252 are cut and bent to approximately 90° relative to the paneled skin 250. The perimeter edges 290 form a plurality of flanges 284 to which a mounting surface 294 of bottom rail 220 is attached. As such, the paneled skin 250 and the bottom rail 220 compatibly and permanently coupled to provide an aesthetically pleasing carriage style sectional door.

Figure 20A:
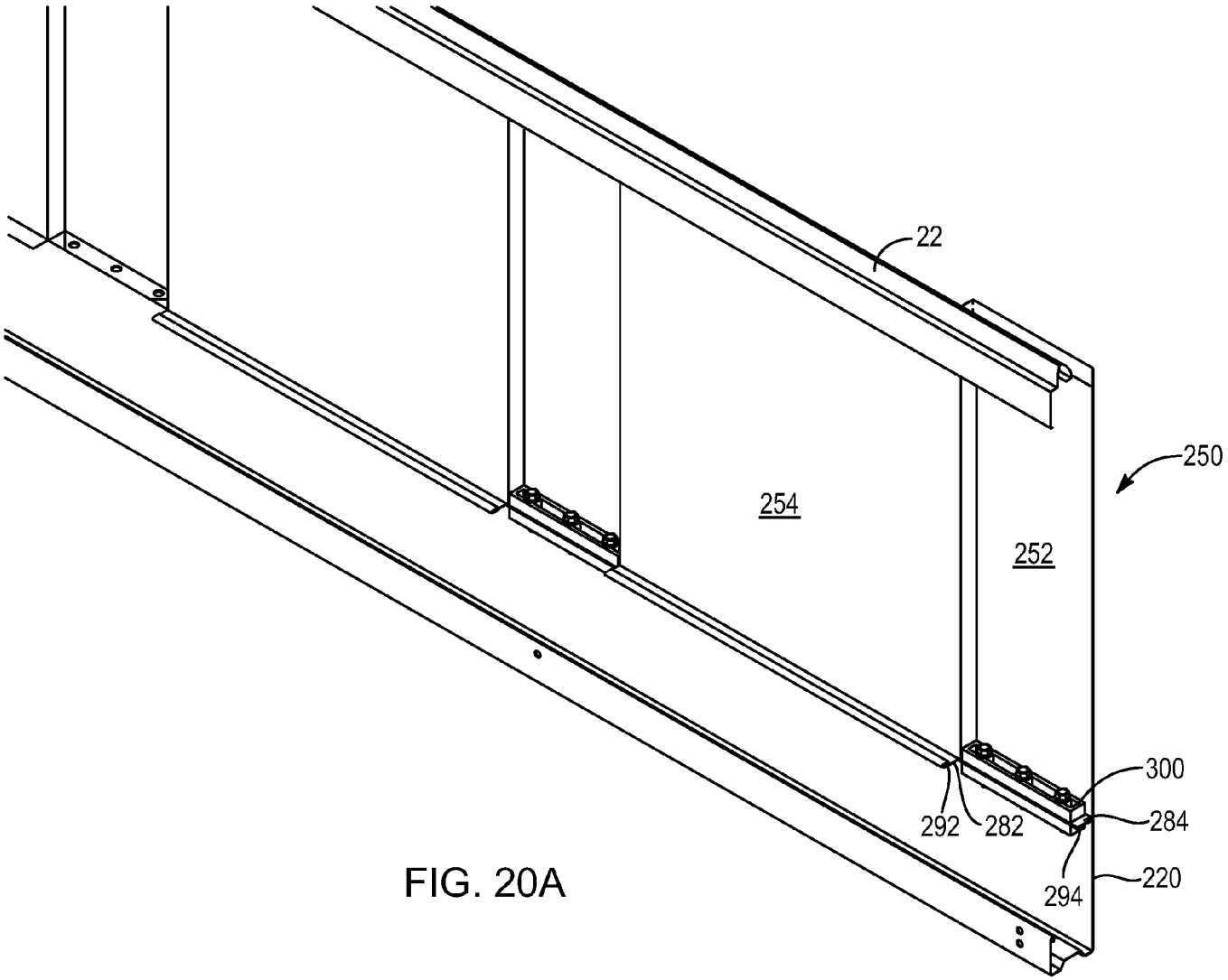
Figure 20B:
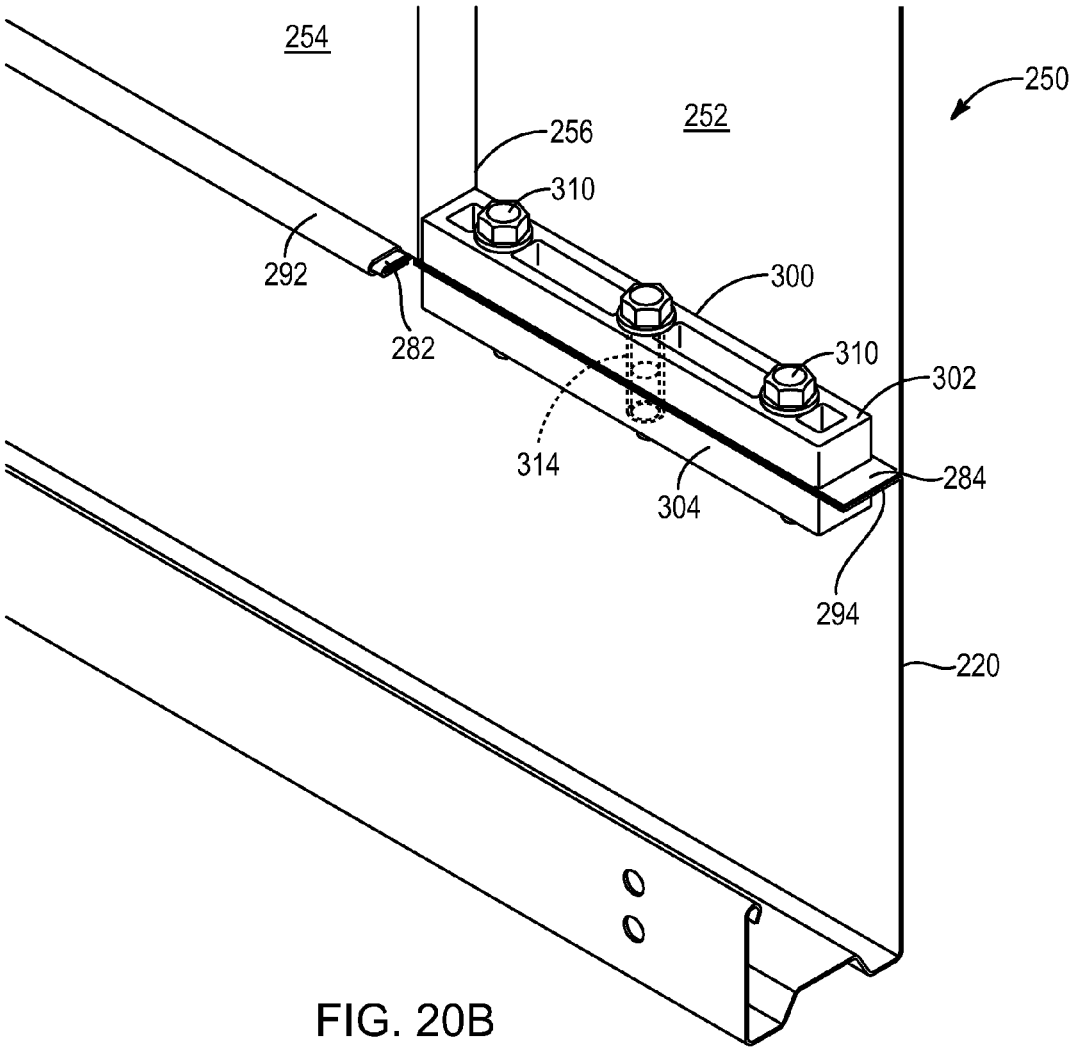
Figure 20C:
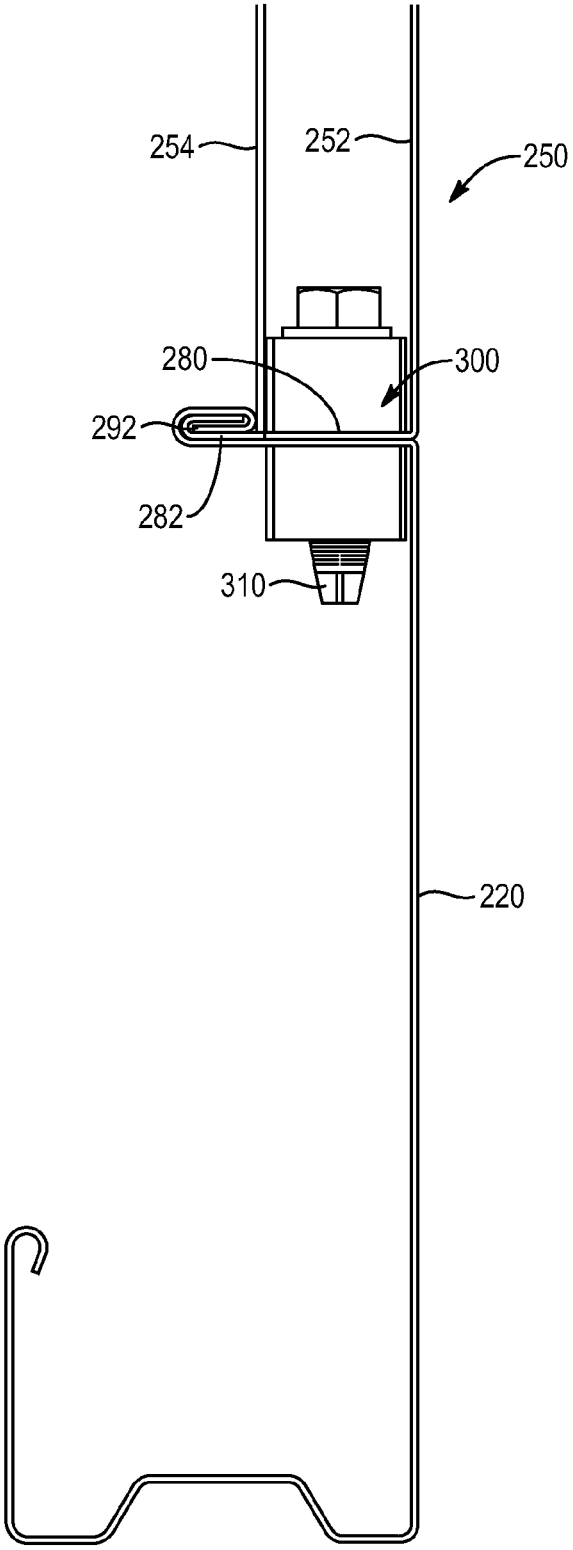

In some embodiments, flanges 284 and mounting surface 294 further include a plurality of pre-drilled holes whereby to accommodate placement of a bolt clamp 300, as shown in FIGS. 20A through 20C. In some embodiments, bolt clamps 300 are used to join adjacent components of sectional door 10 in place of screws, rivets, spot welds, seams, and other forms of joinery taught above. Bolt clamps 300 provide increased clamping pressure thereby preventing unwanted loosening of joints between adjacent components. Accordingly, in some embodiments a sectional door 10 is provided wherein adjacent components of the sectional door 10 are joined via at least one bolt clamp 300.

In some embodiments, bolt clamp 300 comprises an upper half 302 placed adjacent to flange surface 284 and a lower half 304 place opposite of upper half 302 adjacent to mounting surface 294 of lower molding. Paneled skin 250 is secured to bottom rail 220 as bolts 310 are threaded through first and second halves 302 and 304 of bolt clamp 300. In some embodiments, bolts 310 are secured via a nut (not shown). In other embodiments, bolt 310 comprises a self-tapping screw having a thread diameter greater than the mounting holes 314 provided through upper and lower halves 302 and 304. Thus, paneled skin 250 is secured to bottom rail 220 as the self-tapping screws are driven into mounting holes 314. One having skill in the art will appreciate that bolt clamp 300 may be secured via means other than bolts 310 or screws. For example, in some embodiments bolt clamp 300 is secured via spot welds. In other embodiments, bolt clamp 300 is secured via an adhesive or epoxy compound.

In some embodiments, bolt clamp 300 comprises an extrusion having a plurality of mounting holes 314 for receiving said bolts 310. In some embodiments, a continuous extrusion is provided whereafter the extrusion is cut or sectioned to provide multiple bolt clamps 300. Bolt clamps 300 may comprise any material having properties compatible with securing paneled skin 250 to bottom rail 220. For example, in some embodiments bolt clamps 300 comprise a metallic material, such as aluminum, steel, iron, and alloys thereof. In other embodiments, bolt clamps 300 comprise a polymer material. Further, in some embodiments bolt clamps 300 comprise a composite material.

In general, bolt clamps 300 are configured to extend along opposing surfaces 284 and 294 thereby distributing the clamping force of bolts or fasteners 310 and bolt clamp 300 along the entire interface of the opposing surfaces. In this way, a secure butt joint is provided between the adjacent sheet metal components. In some embodiments, a surface area of bolt clamp 300 is selected to be approximately equal to the surface area of opposing surfaces 284 and 294. In other embodiments, a portion of bolt clamps 300 is precisely positioned within an intervening corner 256 between raised surface 252 and recessed surface 254 to ensure solid contact between the two surfaces at the interface corresponding the corner 256.

Figure 21A:
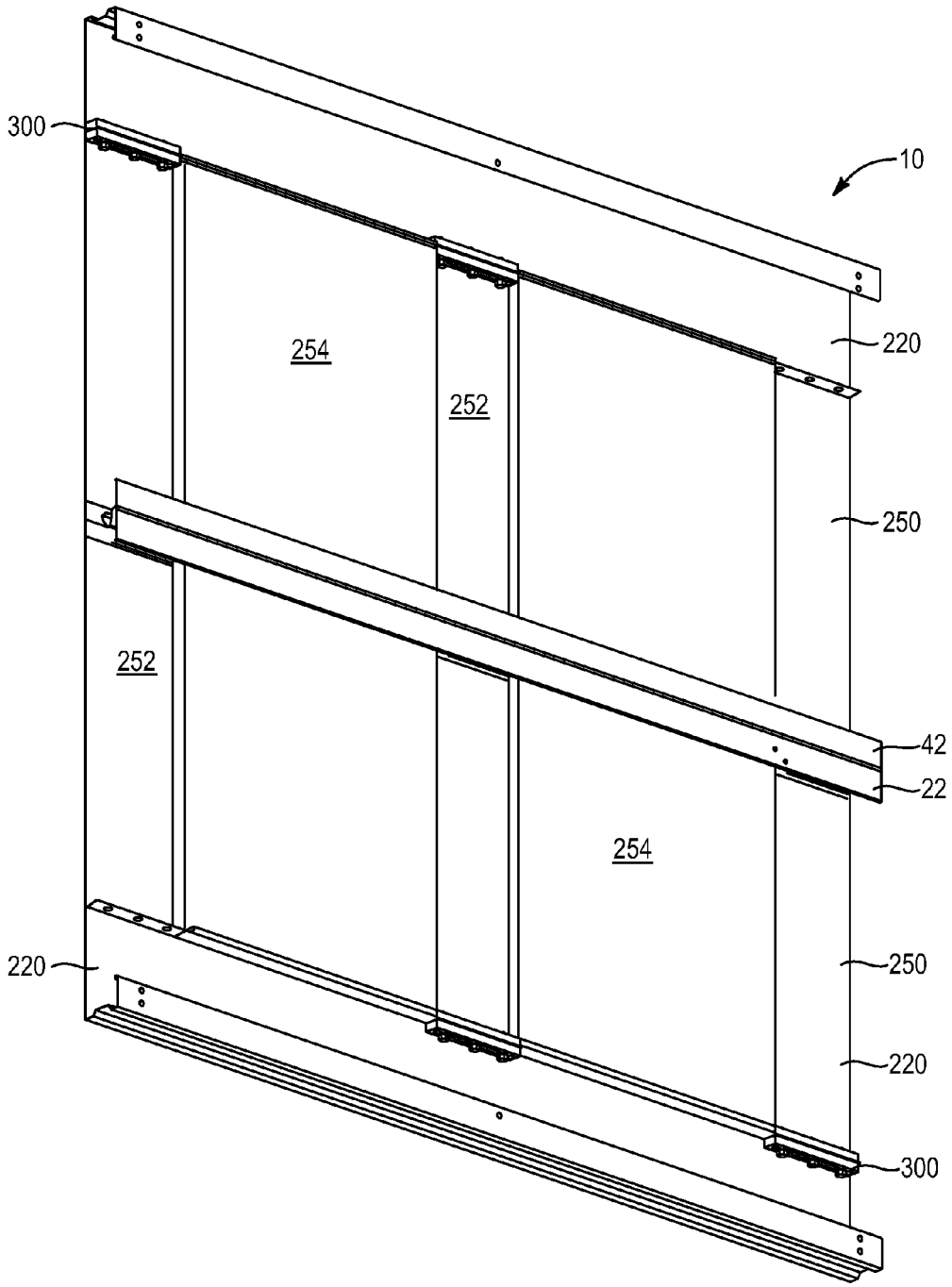
Figure 21B:
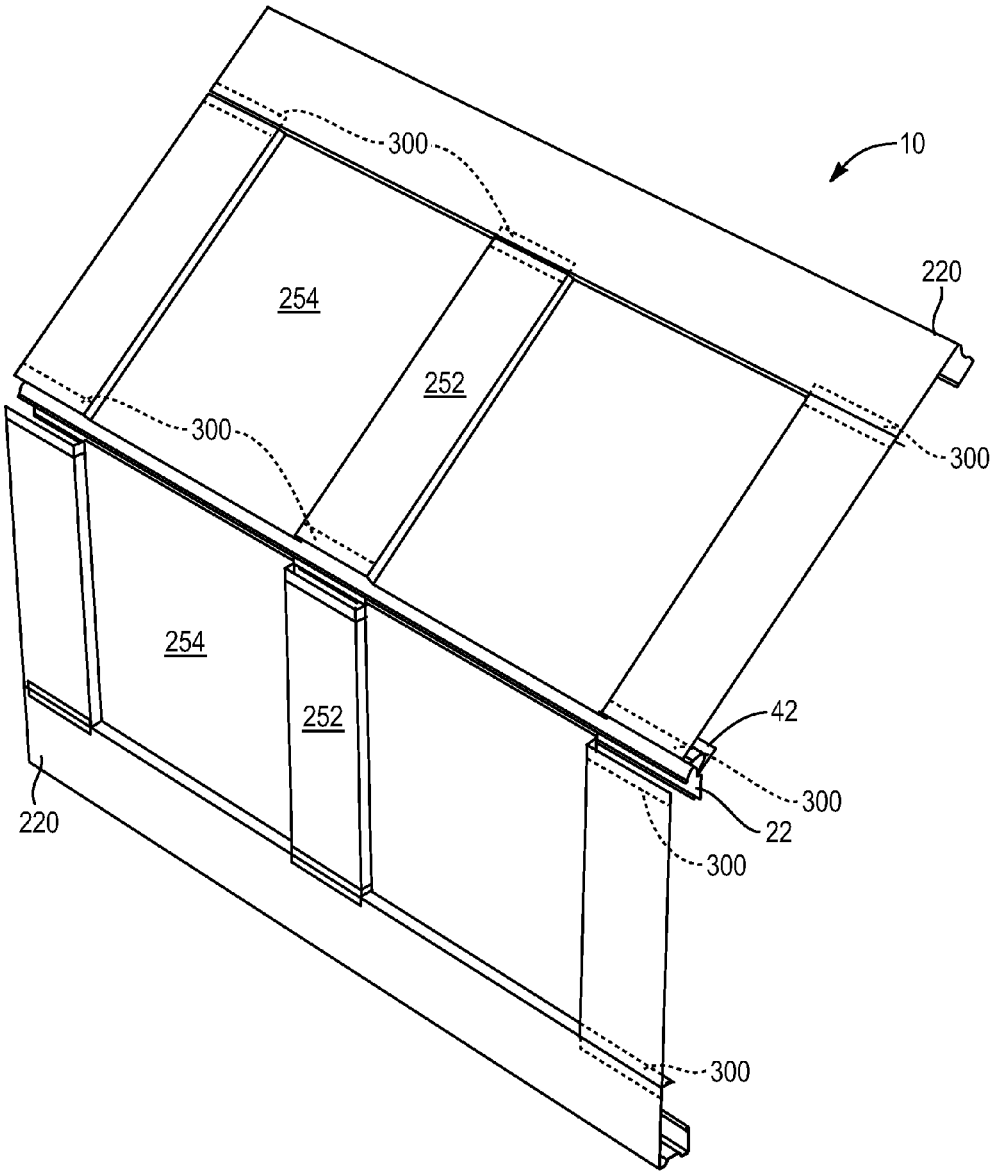

In some embodiments, flanges 284 and mounting surface 294 are alternatively secured via a plurality of bolts and opposing washers. In some embodiments, the washers comprise square washers wherein a portion of a washer is precisely positioned with the intervening corner 256. Further, in other embodiments a square-head bolt and opposing square washer and nut, or square plate and nut are used to secure flanges 284 and mounting surface 294. As previously mentioned, in some embodiments a sectional door 10 is provided wherein adjacent components of sectional door 10 are joined and secured via bolt clamps 300, as shown in FIGS. 21A and 21B.

Figure 22:
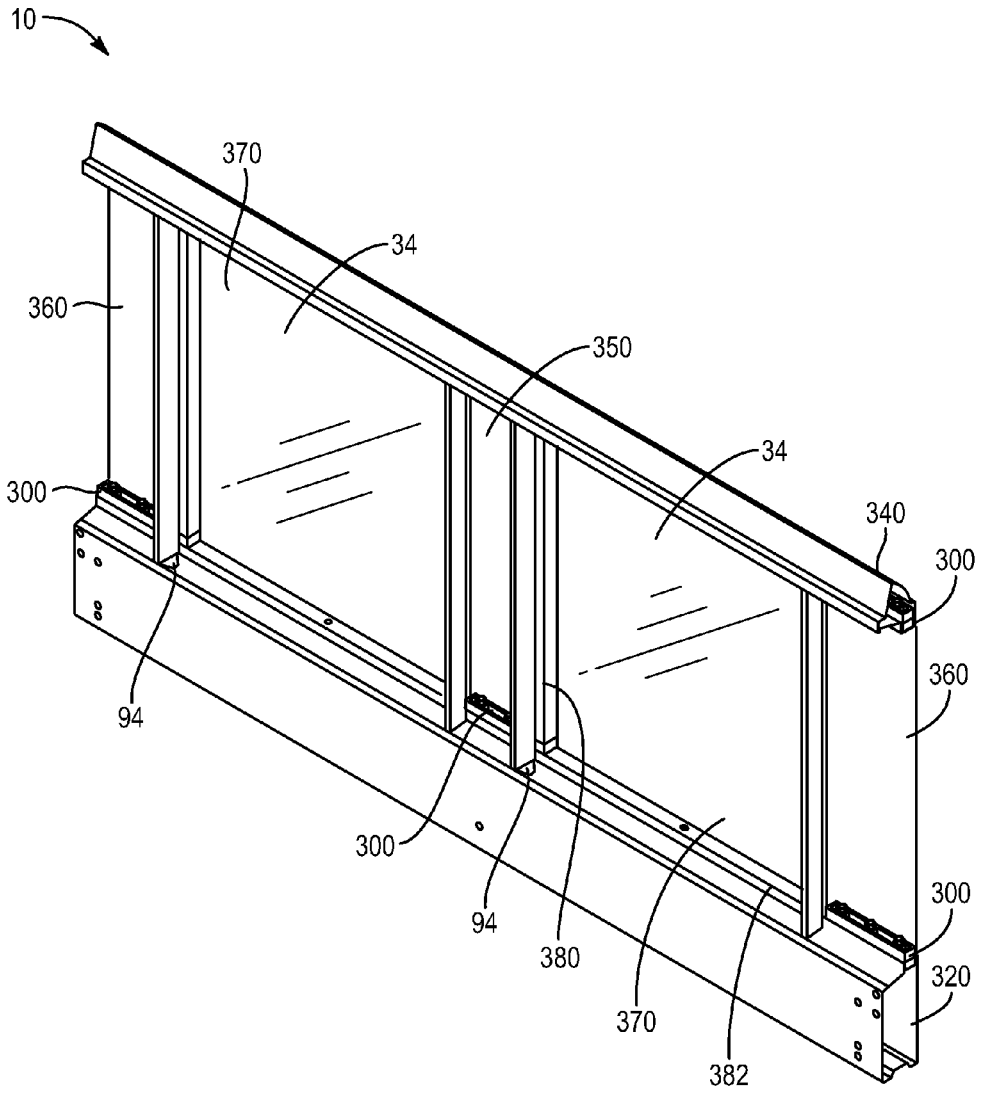
FIG. 22 is a perspective view of a sectioned door implementing tubular structure components in accordance with a representative embodiment of the present invention.

In some embodiments, the various components of sectional door 10 are configured and joined to accommodate windows 34, as shown in FIG. 22 and described below.

Figure 23A:
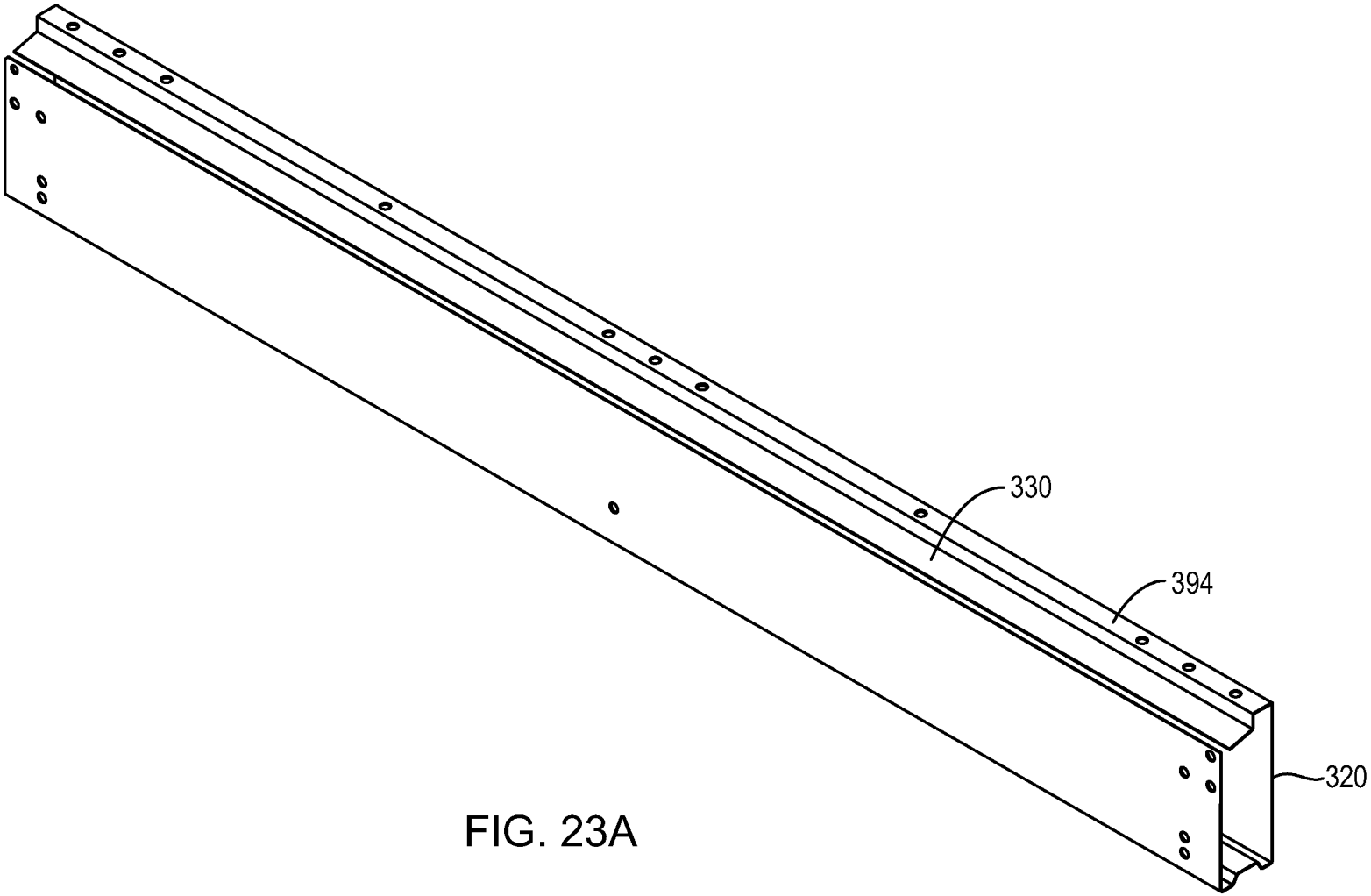
FIG. 23A is a perspective view of a tubular bottom rail in accordance with a representative embodiment of the present invention.
Figure 23B:
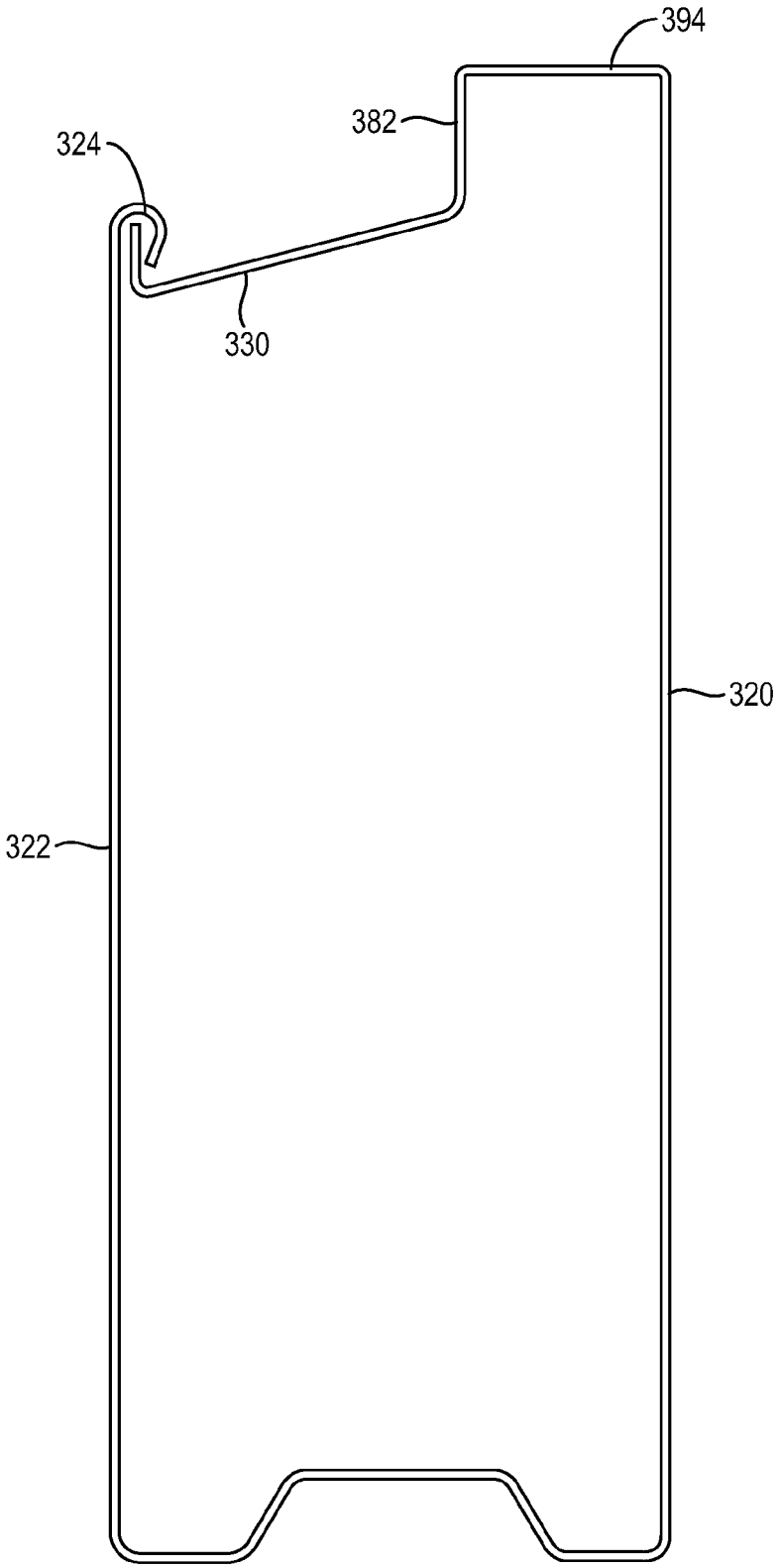
FIG. 23B is a cross-section view of a tubular bottom rail in accordance with a representative embodiment of the present invention.

In some embodiments, it is desirable to provide a sectional door 10 having increased structural rigidity and integrity so as to accommodate windows 34 and other desirable features. Referring now to FIGS. 22 through 23B, in some embodiments bottom rail 320 comprises a tubular structure. The tubular structure of bottom rail 320 provides additional strength and rigidity to sectional door 10 while maintaining mounting surface 394 for securing flanges 284 of paneled skin 250. In some embodiments, bottom rail 320 comprises a back plate 322 having an open hem 324 into which a portion of a connecting flap 330 is inserted, thereby completing the tubular structure of rail 320. In some embodiments, additional components of door 10 are coupled to bottom rail 320 via bolt clamps 300 and rivets or spot welds, prior to completing the tubular structure of rail 320.

Figure 24:
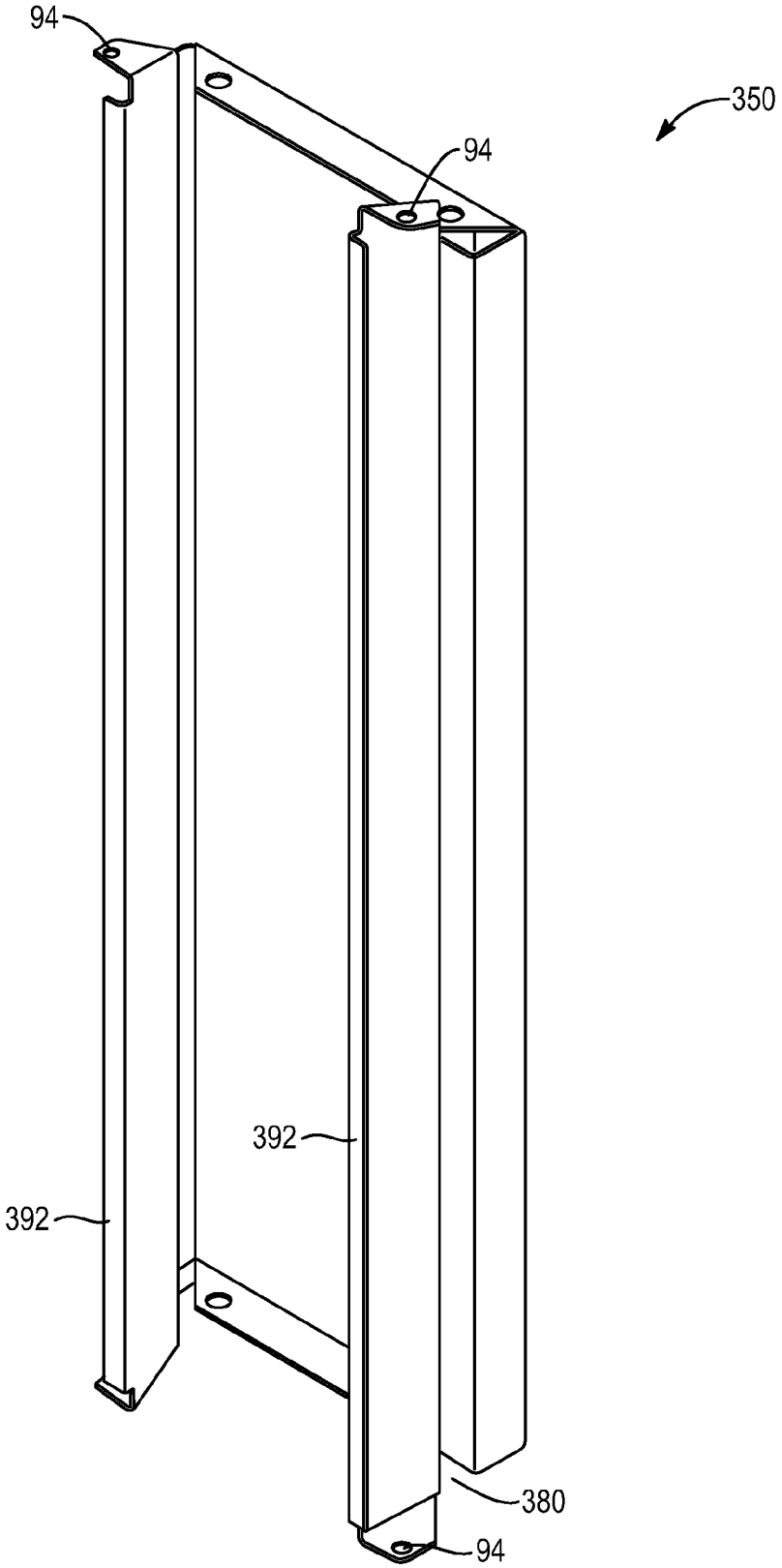
FIG. 24 is a perspective view of a mid stile in accordance with a representative embodiment of the present invention.
Figure 25:
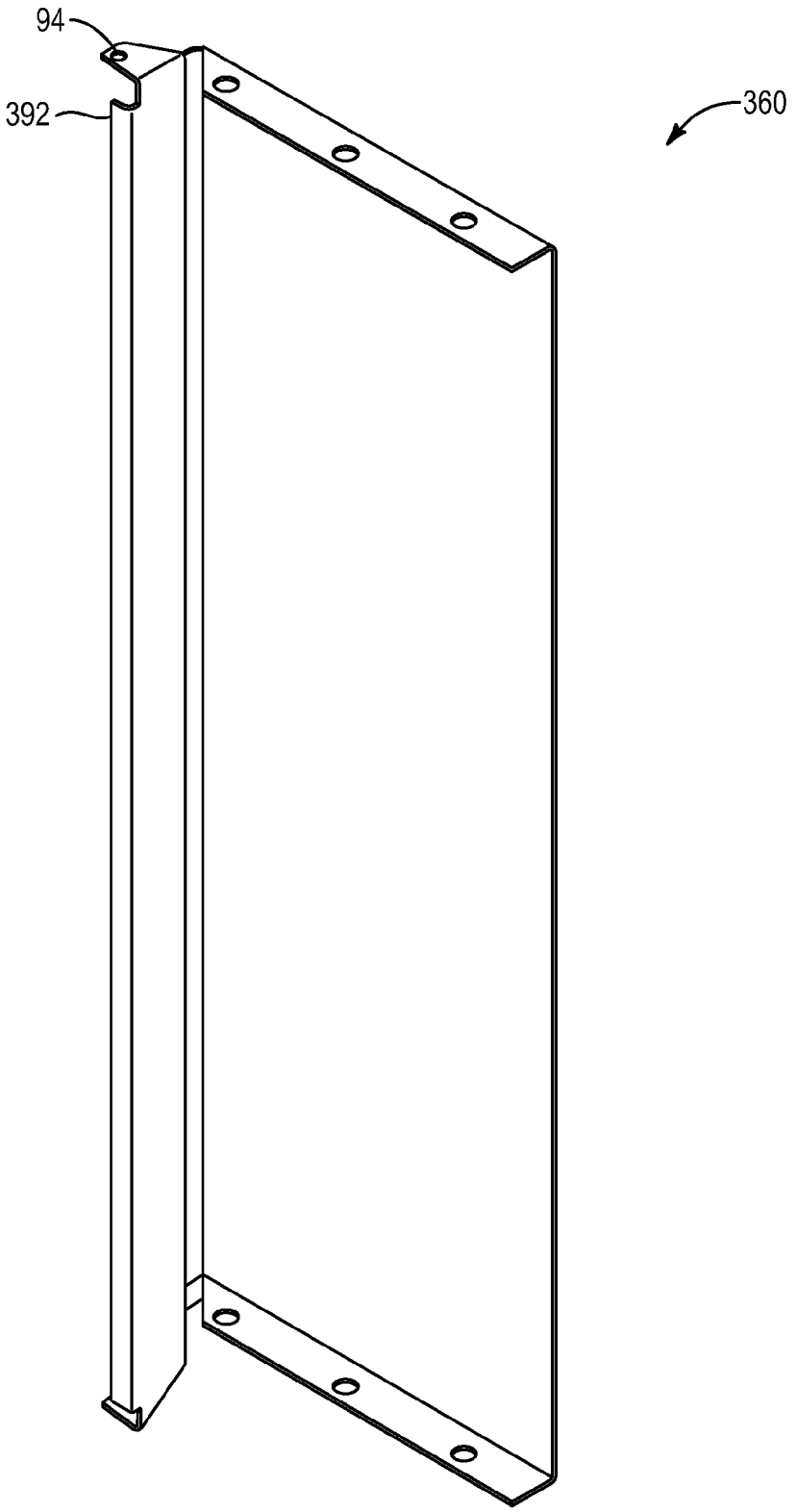
FIG. 25 is a perspective view of an end stile in accordance with a representative embodiment of the present invention.

With reference to FIGS. 22, 24 and 25, some embodiments of sectional door 10 further include mid stiles 350 and end stiles 360. In some embodiments, mid stiles 350 and end stiles 360 comprise a first end for being secured to mounting surface 394 of bottom rail 320 via bolt clamps 300 and spot welds or rivets 94, and a second end for being secured to a mounting surface 342 of upper molding 340, or a top rail, via bolt clamps 300 and spot welds or rivets 94. Accordingly, in some embodiments mid stiles 350 and end stiles 360 are bent, shaped and configured to provide a 3-dimensional structure that compatibly attaches to bottom rail 320 and upper molding 340 thereby providing a framed opening 370 for receiving windows 34.

Figure 26A:
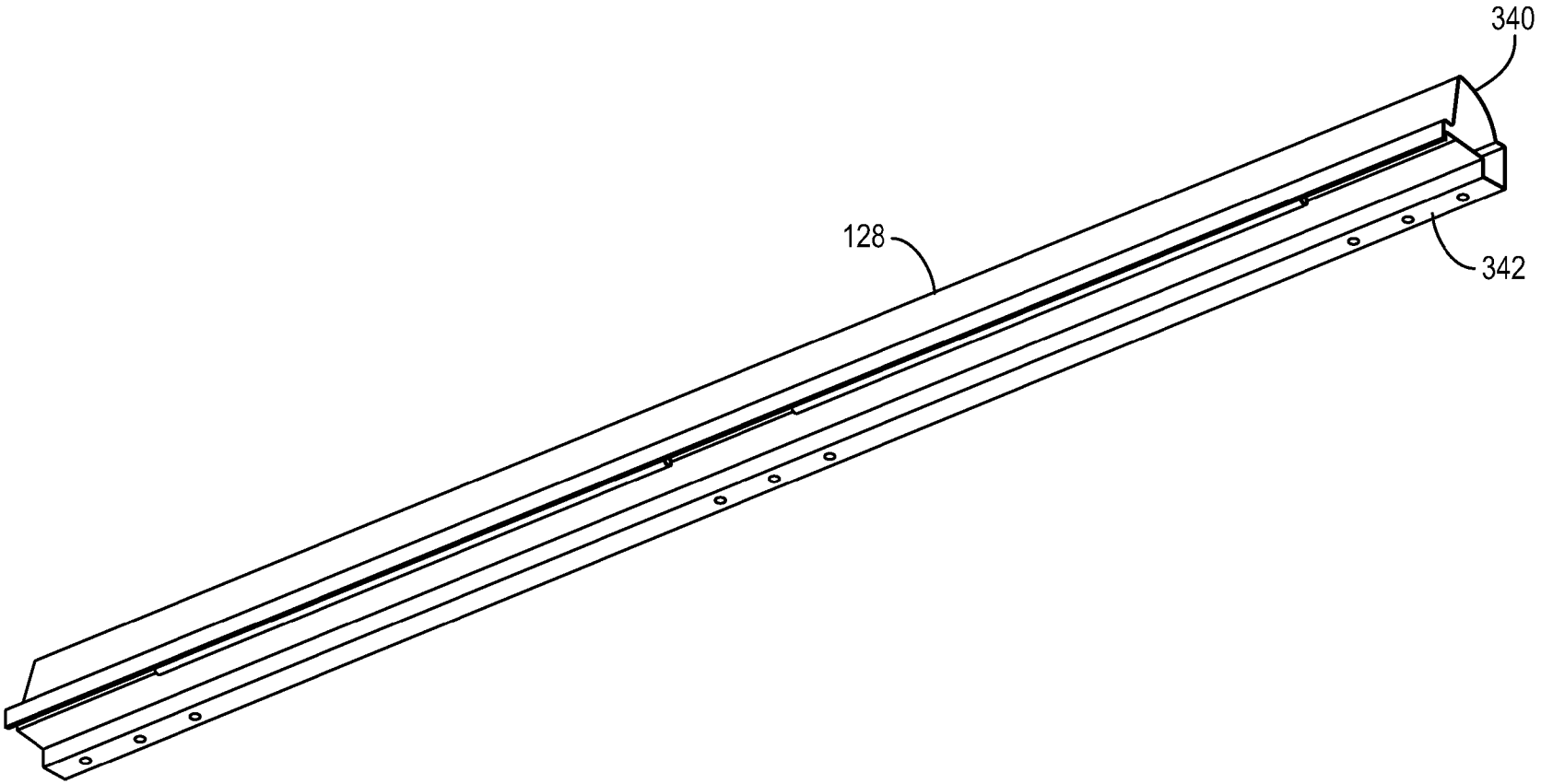
FIG. 26A is a perspective view of a tubular upper molding in accordance with a representative embodiment of the present invention.
Figure 26B:
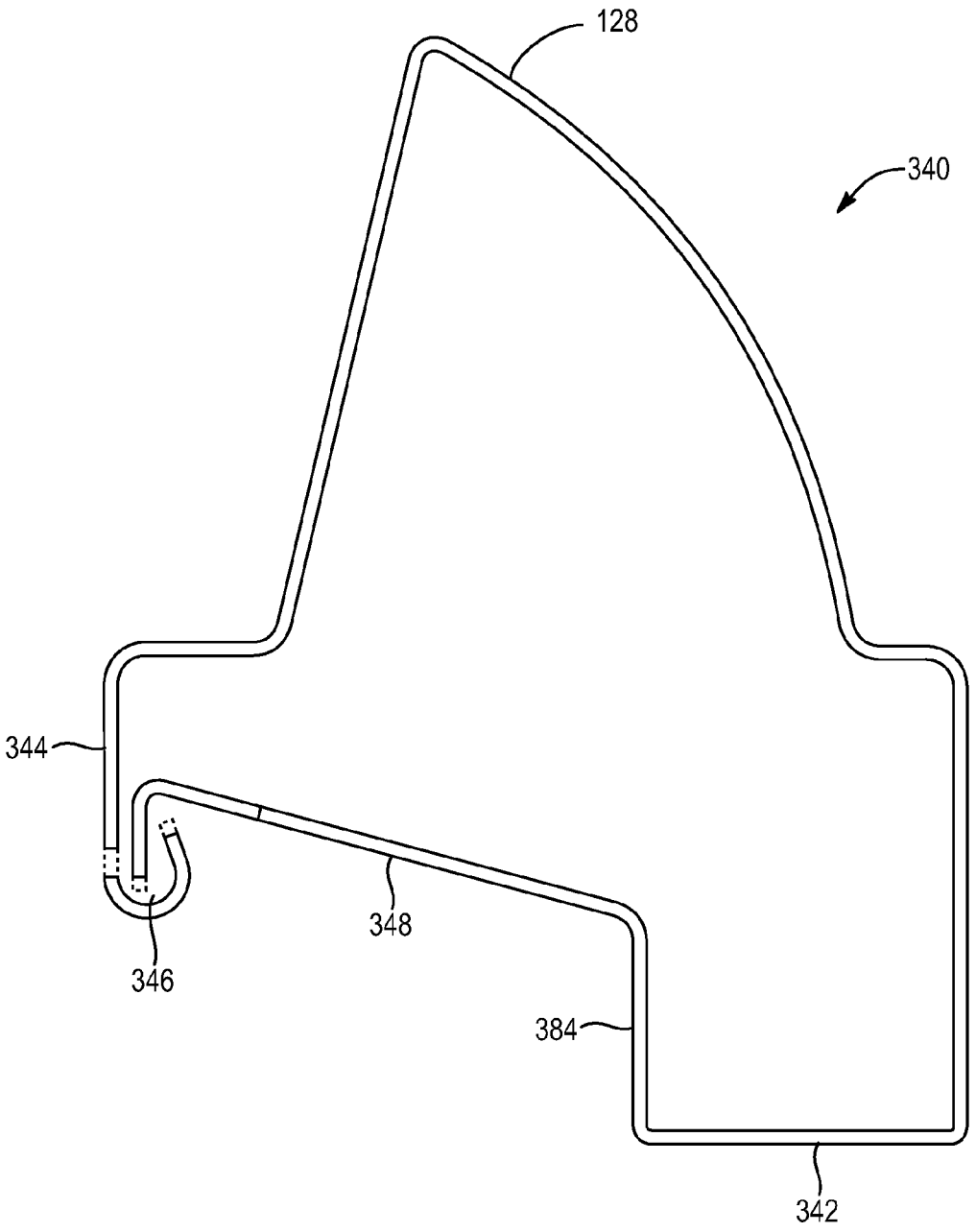
FIG. 26B is a cross-section view of a tubular upper molding in accordance with a representative embodiment of the present invention.

With reference to FIGS. 22, 26A and 26B, in some embodiments upper molding 340 comprises a tubular structure. The tubular structure of upper molding 340 provides additional strength and rigidity to sectional door 10 while maintaining mounting surface 342 for securing lip 82 of paneled skin 50, or securing a second end of mid and end stiles 350 and 360 via bolt clamps 300 and spot welds or rivets 94. In some embodiments, upper molding 340 comprises a back plate 344 having an open hem 346 into which a portion of connecting flap 348 is inserted, thereby completing the tubular structure of molding 340. In some embodiments, additional components of door 10 (such as mid styles 350, end stiles 360, and windows 34) are coupled to upper molding 340 via bolt clamps 300 and rivets or spot welds 94 prior to completing the tubular structure of molding 340.

Figure 27:
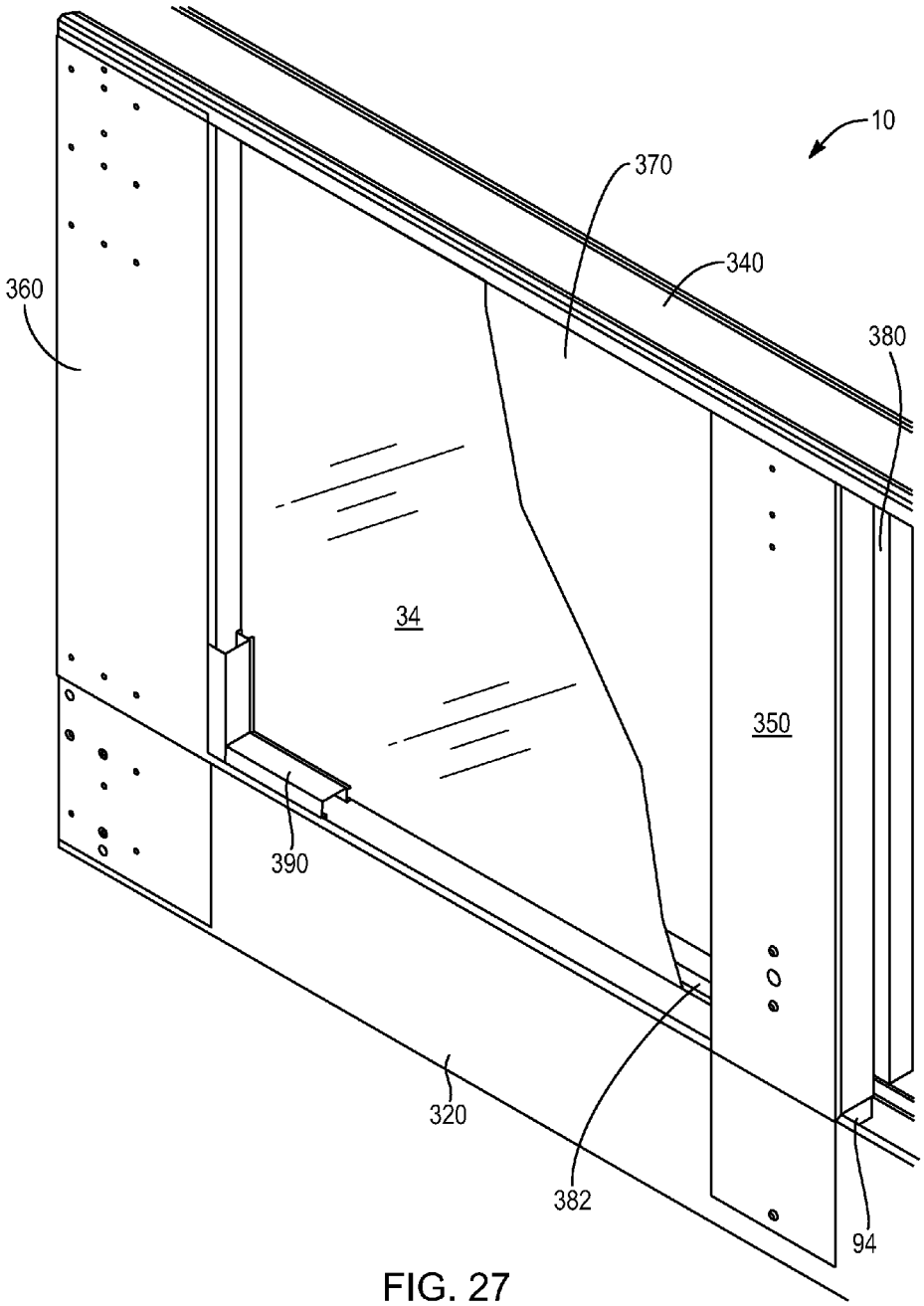
FIG. 27 is a perspective view of an assembled window section of a sectional door in accordance with a representative embodiment of the present invention.

A partially sectioned view of an assembled sectional door 10 is shown in FIG. 27. In some embodiments, the process for assembling sectional door 10 comprises a first step of providing a tubular bottom rail 320, wherein the connecting flap 330 is not yet inserted into open hem 324 of the rail 320. Mid stiles 350 and end stiles 360 are then attached to mounting surface 394 of bottom rail 320 via bolt clamps 300 and rivets 94. In some embodiments, a portion of connecting flap 330 is then inserted into open hem 324 to complete the tubular structure of bottom rail 320. Windows 34 are then inserted into channels 380 of stiles 350 and 360, and against step 382 of bottom rail 320. A tubular upper molding 340 is then provided, wherein connecting flap 348 is not yet inserted into open hem 346 of molding 340. Upper molding 340 is then coupled to stiles 350 and 360 via bolt clamps 300 and rivets 94, such that window 34 abuts step 384 of molding 340. In some embodiments, a portion of connecting flap 348 is then inserted into open hem 346 to complete the tubular structure of upper molding 340. Further, in some embodiments the components of door 10 are further secured via rivets and/or spot welds.

In some embodiments, windows 34 are further secured within framed opening 370 by addition of a window molding 390. Window molding 390 comprises semi-flexible extrusion having features for compatibly coupling to features of mid and end stiles 350 and 360, as well as features of upper molding 340 and bottom rail 320. For example, in some embodiments window molding 390 is interposedly positioned between open hem 346 of upper molding and window 34. Similarly, window molding 390 is interposedly positioned between open hem 324 of bottom rail 320 and window 34. Further, in some embodiments window molding 390 is interposedly positioned between flap 392 of mid and end stiles 350 and 360, and window 34. Thus, window molding 390 provides a finished look to the interior surface interface between sectional door components 320, 340, 350 and 360, and window 34.

The present invention may be embodied in other specific forms without departing from its structures, methods, or other essential characteristics as broadly described herein and claimed hereinafter. The described embodiments are to be considered in all respects only as illustrative, and not restrictive.

For example, one of skill in the art will appreciate that additional features, such as windows, stained glass, and iron works may be easily incorporated into the current methods and are anticipated within the scope of the present invention. Additionally, one of skill in the art will appreciate that any section of the sectional door can be modified to include additional features, such as windows. The scope of the invention is, therefore, indicated by the appended claims, rather than by the foregoing description. All changes that come within the meaning and range of equivalency of the claims are to be embraced within their scope.

What is claimed is:

1. A method for manufacturing a sheet metal carriage door, the method comprising:

forming a first tubular molding having a first mounting surface;

forming a second tubular molding having a second mounting surface;

shaping a piece of sheet metal into a paneled skin having a first end and a second end, the first end of the paneled skin having a first flange for attaching to the first mounting surface, and the second end of the paneled skin having a second flange for attaching to the second mounting surface; and assembling the metal carriage door, the process of assembly comprising:

attaching the first flange to the first mounting surface; and attaching the second flange to the second mounting surface;

wherein the first and second flanges are attached to the first and second mounting surfaces, respectively, via a bolt clamp.

2. The method of claim 1, wherein the paneled skin further comprises a recessed surface and a raised surface.

3. The method of claim 2, wherein the recessed surface comprises a plurality of recessed surfaces, and wherein the raised surface comprises a plurality of raised surfaces.

4. The method of claim 3, wherein the plurality of recessed and raised surfaces are alternating.

5. The method of claim 1, wherein the metal carriage door comprises a plurality of hingedly coupled door sections.

6. The method of claim 5, wherein at least one of the door sections further comprises a window.

7. The method of claim 6, wherein the window is positioned within a framed opening defined by a portion of the first tubular molding, a portion of the second tubular molding, a first stile, and a second stile.

8. The method of claim 7, wherein the first and second stiles are secured to the first and second tubular moldings via a bolt clamp.

9. A sheet metal carriage door, comprising:

a first tubular molding having a first mounting surface;

a second tubular molding having a second mounting surface; and a paneled skin having a first end and a second end, the first end having a first flange for attaching to the first mounting surface, and the second end having a second flange for attaching to the second mounting surface;

wherein the first and second flanges are attached to the first and second mounting surfaces, respectively, via a bolt clamp.

10. The door of claim 9, wherein the paneled skin further comprises a recessed surface and a raised surface.

11. The door of claim 10, wherein the paneled skin comprises a plurality of recessed surfaces, and wherein the raised surface comprises a plurality of raised surfaces.

12. The door of claim 11, wherein the plurality of recessed and raised surfaces are alternating.

13. The door of claim 9, wherein the door comprises a plurality of hingedly coupled door sections.

14. The door of claim 13, wherein at least one of the door sections further comprises a window.

15. The door of claim 14, wherein the window is positioned within a framed opening defined by a portion of the first tubular molding, a portion of the second tubular molding, a first stile, and a second stile.

16. The door of claim 15, wherein the first and second stiles are secured to the first and second tubular moldings via a bolt clamp.

17. A method for forming a butt joint between two sheet metal components, the method comprising:

providing a first sheet metal component having a first mounting surface, the first sheet metal component further having a first clamping surface positioned opposite the first mounting surface;

providing a second sheet metal component having a second mounting surface, the second sheet metal component further having a second clamping surface positioned opposite the second mounting surface;

abutting the first and second mounting surfaces;

providing a bolt clamp having a first half and a second half;

positioning the first half of the bolt clamp on the first clamping surface;

positioning the second half of the bolt clamp on the second clamping surface;

and securing the first half of the bolt clamp to the second half of the bolt clamp via a fastener.

18. The method of claim 17, wherein a surface area of the first half of the bolt clamp approximates a surface area of the first mounting surface, and a surface area of the second half of the bolt clamp approximates a surface area of the second mounting surface.

* * * * *